US006190435B1

(12) United States Patent
Miyamoto et al.

(10) Patent No.: US 6,190,435 B1
(45) Date of Patent: Feb. 20, 2001

(54) METHOD OF VACUUM DECARBURIZATION/REFINING OF MOLTEN STEEL

(75) Inventors: Kenichiro Miyamoto; Katsuhiko Kato; Akio Shinkai; Takayuki Kaneyasu, all of Kitakyushu; Shinya Kitamura, Futtsu; Hiroyuki Ishimatsu; Hiroshi Sugano, both of Kitakyushu; Keiichi Katahira, Futtsu; Ryuzou Hayakawa, Kitakyushu, all of (JP)

(73) Assignee: Nippon Steel Corporation, Tokyo (JP)

( * ) Notice: Under 35 U.S.C. 154(b), the term of this patent shall be extended for 0 days.

(21) Appl. No.: 09/101,859

(22) PCT Filed: Nov. 20, 1997

(86) PCT No.: PCT/JP97/04234

§ 371 Date: Aug. 17, 1998

§ 102(e) Date: Aug. 17, 1998

(87) PCT Pub. No.: WO98/22627

PCT Pub. Date: May 28, 1998

(30) Foreign Application Priority Data

| | | |
|---|---|---|
| Nov. 20, 1996 | (JP) | 8-326178 |
| Dec. 2, 1996 | (JP) | 8-337565 |
| Dec. 7, 1996 | (JP) | 8-342442 |
| Apr. 22, 1997 | (JP) | 9-120301 |
| Apr. 22, 1997 | (JP) | 9-120302 |
| Apr. 24, 1997 | (JP) | 9-123186 |
| May 7, 1997 | (JP) | 9-134299 |
| Jul. 31, 1997 | (JP) | 9-220640 |

(51) Int. Cl.[7] ..... C21C 7/10

(52) U.S. Cl. ..... 75/511; 75/512

(58) Field of Search ..... 75/511, 512

(56) References Cited

U.S. PATENT DOCUMENTS

| | | | |
|---|---|---|---|
| 3,971,655 | | 7/1976 | Takashima et al. . |
| 4,152,140 | | 5/1979 | Hori et al. . |
| 5,603,749 | * | 2/1997 | Stelts ..... 75/511 |
| 5,902,374 | * | 5/1999 | Kitamura et al. ..... 75/512 |

FOREIGN PATENT DOCUMENTS

| | | |
|---|---|---|
| 0785284 | 7/1997 | (EP) . |
| 58-55384 | 4/1983 | (JP) . |
| 3-226516 | 10/1991 | (JP) . |
| 5-271748 | 10/1993 | (JP) . |
| 6-116626 | 4/1994 | (JP) . |
| 6-228629 | 8/1994 | (JP) . |
| 6-330141 | 11/1994 | (JP) . |
| 8-278087 | 10/1996 | (JP) . |
| 4395042 | 6/2000 | (KR) . |

OTHER PUBLICATIONS

Patent Abstracts Of Japan, vol. 14, No. 265 (C–0726), Jun. 8, 1990, based on JP 2–77517, Mar. 16, 1990.

* cited by examiner

*Primary Examiner*—Melvyn Andrews
(74) *Attorney, Agent, or Firm*—Kenyon & Kenyon

(57) ABSTRACT

A method for vacuum decarburization refining of a molten steel includes providing a vacuum tank having a one-legged, straight barrel snorkel as a lower portion of the vacuum tank. The a degree of vacuum in the vacuum tank is regulated at a high carbon concentration region to a value in a range of −35 to −20 in terms of G defined by the following equation (1):

$$G=5.96\times10^{-3}\times T\times\ln(P/Pco) \quad (1),$$

wherein $$Pco=760\{10^{(-13800/T+8.75)}\}\times(\%\ C)/(\%\ Cr) \quad (2),$$

and wherein P<760, T represents molten steel temperature, K, and P represents the degree of vacuum in the vacuum tank, Torr.

13 Claims, 30 Drawing Sheets

METHOD OF VACUUM DECARBURIZATION/REFINING OF MOLTEN STEEL

TECHNICAL FIELD

The present invention relates to a method and apparatus for vacuum decarburization refining a molten steel and, more particularly, to a method and apparatus, for refining a molten steel, that can inhibit the deposition of a splash onto the inner wall of a vacuum tank and an oxygen lance and at the same time can prevent oxidation loss of metal in the molten steel.

BACKGROUND ART

Conventional methods for additional decarburization refining of a molten steel which has been once subjected to decarburization refining in an electric furnace or a converter to provide a molten steel having a carbon concentration of not more than 0.01% by weight include: (1) a VOD (vacuum oxygen decarburization) method, typified by the one disclosed in Japanese Unexamined Patent Publication (Kokai) No. 57-43924, wherein an oxygen gas is blown onto the surface of a molten steel in a ladle while holding the molten steel surface in vacuo; and (2) a straight barrel type snorkel method wherein an oxygen gas is blown onto the surface of a molten steel within a snorkel submerged in molten steel to carry out vacuum refining.

In the method (1), VOD, a satisfactory space cannot be ensured above the molten steel surface. This causes a splash of molten steel, scattered during oxygen blowing decarburization refining, to be deposited onto a top-blown lance and a cover of a vacuum vessel, adversely affecting the operation.

The method (2), straight barrel type snorkel method, unlike the method (1), has no significant limitation on equipment, and an example of this method is disclosed in Japanese Unexamined Patent Publication (Kokai) No. 61-37912. The method disclosed in this publication is shown in FIG. 35. Specifically, in this method for vacuum refining of molten steel, a molten steel 71 contained in a ladle 70 is sucked through a snorkel 72 into a vacuum tank 73. An inert gas is blown into the molten steel within the snorkel 72 through under the plane of projection of the snorkel 72 within the ladle 70, and, at the same time, an oxidizing gas is blown through a top lance 74 onto the surface of the molten steel within the vacuum tank 73. In this case, the inner diameter of the snorkel 72 is determined so that the ratio of the inner diameter ($D_1$) of the snorkel 72 to the inner diameter ($D_0$) of the ladle 70, that is, $D_1/D_0$, is 0.4 to 0.8. In addition, the depth of blowing of the inert gas is determined so that the ratio of the depth ($H_1$) of blowing of the inert gas as measured from the surface of the molten steel to the depth ($H_0$) of the molten steel within the ladle 70, that is, $H_1/H_0$, is 0.5 to 1.0. The above method for vacuum refining of molten steel aims to efficiently carry out decarburization without the deposition of the metal, slag and the like within the tank.

Japanese Unexamined Patent Publication (Kokai) No. 2-133510 proposes a vacuum treatment apparatus comprising: a ladle for placing therein a molten metal; a vacuum tank having a snorkel, submerged in the molten metal, provided at the lower end of the vacuum tank; an evacuation pipe connected to a vacuum source for evacuating the interior of the vacuum tank; and a shield disposed in the interior of the vacuum tank, wherein the shield is kept at a height of 2 to 5 m above the molten steel surface within the snorkel.

The method proposed in Japanese Unexamined Patent Publication (Kokai) No. 61-37912, however, had the following problems (i) to (iv).

(i) Conditions for decarburization refining, such as the flow rate of the oxygen gas blown onto the molten steel, the flow rate of the argon gas for agitation, and the degree of vacuum within the vacuum tank 73, are not properly specified. This causes excessive fluctuation of the molten steel surface and splashing, leading to operation troubles attributable to deposition of the metal.

(ii) In the oxygen blowing decarburization refining of chromium-containing molten steel, such as stainless steel, the chromium component contained in the molten steel is oxidized with the blown oxygen. A part of the chromium oxide produced by the oxidation is reduced with carbon contained in the molten steel in the course of descending through the molten steel. Most part of the chromium oxide, however, undergoes the convection due to the inert gas blown from below the molten steel and floats, without being reduced, on the surface of the molten steel between the snorkel and the inner wall of the ladle to form slag 75 which is then discharged from the molten steel, increasing the loss of the chromium component.

(iii) The presence of the slag 75 containing chromium oxide causes the surface of the molten steel present between the snorkel 72 and the inner wall of the ladle to come into contact with air and to be cooled. This increases the viscosity of the molten steel surface. In addition, the slag 75, the metal or the like is deposited around the above inner wall of the ladle, making it difficult to conduct sampling of the molten steel in the course of and at the end of the refining, or making it difficult to move the snorkel 72 from the position of the ladle 70 at the end of the refining, which is an obstacle to refining.

(iv) The oxygen efficiency in the decarburization, defined as the ratio of the amount of the oxygen gas contributed to the decarburization of the molten steel to the total amount of the oxygen gas blown onto the molten steel, is influenced by refining conditions, such as the degree of vacuum in the vacuum tank 73, the state of agitation of the molten steel, and the flow rate of the oxygen gas blown. These refining conditions are not proper, making it difficult to maintain the oxygen efficiency in decarburization at a high level.

The method described in Japanese Unexamined Patent Publication (Kokai) No. 2-133510, wherein a shield is provided within a vacuum tank (a snorkel) to prevent splash of the molten steel created by oxygen blowing, thereby preventing deposition and accumulation of a metal caused by solidification of the splash deposited onto an oxygen lance, a vacuum tank, an evacuation pipe, had the following problems.

(i) When an exhaust gas is passes between shields within the vacuum tank, the molten steel splash in the exhaust gas or dust produced by solidification of the splash is deposited and accumulated onto the shields, increasing the flow resistance of the exhaust gas, which in turn increases the pressure loss within the vacuum tank.

(ii) Since the spacing, between the shields, serving as a passage for the exhaust gas becomes narrow, a high-power evacuation apparatus is necessary to provide a high degree of vacuum.

(iii) When a metal or the like scattered by splashing or spitting is once deposited and accumulated onto the passage for the exhaust gas between the shields, removal of the deposited and accumulated metal cannot be achieved without difficulty due to the complicated structure and requires a lot of time and labor.

In the method disclosed in Japanese Unexamined Patent Publication (Kokai) No. 61-37912, when the oxygen blowing refining is carried out at a high speed in order to increase the productivity of vacuum refining, the splashing is remarkably increased, posing the following problems which will be described with reference to FIG. 35.

(i) Although the creation of the splash of the molten steel 71 per se can be inhibited, dust is still contained in the exhaust gas. Therefore, the dust is gradually deposited within the evacuation duct 76 particularly around its duct inlet section to form a deposit 77, clogging the passage or increasing the air-flow resistance, which lowers the attainable level of the degree of vacuum within the vacuum tank 73.

(ii) Dust is introduced into a gas cooler 78 and damages the gas cooler. This results in suspension of equipment and increased maintenance cost. Further, a dust deposit is formed within the gas cooler 78, which causes a markedly lowered cooling efficiency.

(iii) Once a dust deposit 77 is formed within an evacuation duct 76, the dust is strongly united and must be manually removed. This increases the dust removal burden.

The method described in Japanese Unexamined Patent Publication (Kokai) No. 61-37912 is disadvantageous in that, for example, chromium oxide ($Cr_3O_3$) formed during oxygen blowing decarburization flows out from the snorkel into the outside of the vacuum tank and, since $Cr_2O_3$ has a high melting point, slag on the ladle is solidified, making it difficult to sample the molten steel, that is, posing a problem in the operation. An additional problem involved in this method is that $Cr_2O_3$, which has once flowed out into the outside of the tank, does not contribute to a later decarburization reaction, inevitably resulting in lowered oxygen efficiency in decarburization.

RH—OB is widely known as a method for oxygen blowing decarburization refining in vacuo. When this method is used, for example, in the finishing of stainless steel, aluminum is added to the molten steel before the oxygen blowing decarburization and combustion is carried out using top-blown oxygen to raise the temperature of the molten steel (aluminum temperature elevation or temperature elevation by aluminum). In this case, when aluminum temperature elevation is carried out under a high degree of vacuum, the depth of a cavity, of the molten steel, formed by a blown oxygen jet (cavity depth) becomes large, leading to a fear of bricks at the bottom of the tank being damaged by the blown oxygen jet, which makes it difficult to conduct temperature elevation by aluminum under a high degree of vacuum.

Further, the straight barrel snorkel type vacuum refining method is disadvantageous in that, as can be seen in the process for producing an ultra low carbon high chromium steel disclosed in Japanese Unexamined Patent Publication (Kokai) No. 57-43924, there is a limitation on the decarburization in a degassing period due to the difficulty of maintaining the agitating force and, as can be seen in the vacuum refining method disclosed in Japanese Unexamined Patent Publication (Kokai) No. 2-305917, an attempt to improve the reduction rate in the degassing period results in remarkable wear of refractories.

Furthermore, after the oxygen blowing decarburization, introduction of aluminum as a reducing agent into the molten steel within the vacuum tank in order to recover a metal by reduction of a metal oxide, for example, chromium oxide, causes a rise in temperature of the molten steel by heat generated by thermit reaction, or scattering (bumping) of the molten steel or slag by a reduction reaction involving instantaneous evolution of CO gas, resulting in melt loss of refractories within the tank and deposition of the metal or slag, which is an obstacle to the operation.

DISCLOSURE OF INVENTION

A general object of the present invention is to solve the above problems created in oxygen blowing decarburization of a molten steel by the above-described RH—OB, VOD, or a refining method using a vacuum refining apparatus comprising a vacuum tank having a one-legged, straight barrel snorkel.

A more specific object of the present invention is to provide a method for vacuum decarburization refining of a molten steel that, even when the concentration of carbon in the molten steel is in a high concentration region, can inhibit the deposition of a splash onto the inner wall of the vacuum tank, the nozzle submerged in the molten steel, and the top-blown lance, prevent loss of a metal in the molten steel, for example, loss of chromium by oxidation, and, at the same time, reduce the fixation between the snorkel and the ladle by the slag.

Another object of the present invention is to provide means that does not increase flow resistance of an exhaust gas in a passage, shields the upper part of the vacuum tank and the oxygen lance from radiated heat during the vacuum decarburization refining, inhibits the entry of dust created by splashing of the molten steel into an evacuation system, and at the same time prevents clogging of the evacuation system with the dust.

A still another object of the present invention is to provide means that, during oxygen blowing decarburization in a high carbon concentration region, can prevent a metal oxide formed during the oxygen blowing decarburization from flowing out into the outside of the tank.

A further object of the present invention is to provide a method for adding aluminum that, at the time of raising the temperature using aluminum, can prevent the production of a metal oxide other than $Al_2O_3$ and the deposition of a large amount of the metal.

A still further object of the present invention is to provide a degassing method that can efficiently produce an ultra low carbon steel while preventing the production of a metal oxide in the molten steel.

The above various objects of the present invention can be attained by the following refining methods and apparatus.

At the outset, according to one aspect of the present invention, there is provided a refining method wherein a molten steel, which has been decarburized in a converter to regulate the carbon content to not more than 1% by weight (all "%" in the following description being by weight) is charged through a vacuum tank snorkel into a vacuum tank in a straight-barrel type vacuum refining apparatus; and in the vacuum tank, decarburization refining is carried out in such a manner that the carbon content of the molten steel is divided into a high carbon concentration region, which is a reaction region where the decarburization reaction rate is governed by the feed of an oxygen gas blown through a top-blown lance into the molten steel, and a low carbon concentration region which is a reaction region where the decarburization reaction rate is governed by movement of carbon in the molten steel, the degree of vacuum within the vacuum tank is regulated for each carbon concentration region and, at the same time, the flow rate of the oxygen gas blown through the top-blown lance is regulated to an optimal value (oxygen blowing conditions) for each carbon concentration region, and, in addition, the flow rate of an inert gas fed through a nozzle provided at a low portion of a ladle of the refining apparatus is also regulated for each region.

The above refining method can enhance the oxygen efficiency in decarburization and at the same time can prevent the occurrence of splash within the snorkel and the fixation of slag in the nozzle submersed portion.

Further, according to the present invention, at the time of oxygen blowing decarburization, particularly when a temperature elevation due to oxidation of aluminum (an aluminum temperature elevation in the following description being the same) is carried out, the degree of vacuum within the vacuum tank in the aluminum temperature elevation period, particularly in an oxygen blowing decarburization period in a region where the carbon concentration is not less than the critical carbon concentration region, is closely regulated according to the following conditions. This can prevent the deposition of the metal caused by splash or the oxidation of the metal.

Aluminum temperature elevation period: $G \leqq -20$

Oxygen blowing decarburization period: $-35 \leqq G \leqq -20$ $$G = 5.96 \times 10^{-3} \times T \cdot \ln(P/P_{co})$$

wherein $$P_{co} = 760 \cdot [10^{(-13800/T+8.76)}] \cdot [\%\ C]/[\%\ Cr];$$

P: less than 760;

wherein

T: molten temperature, K; and

P: degree of vacuum within the tank, Torr.

For example, when the steel comprises 0.1% of carbon and 3% of chromium with the balance consisting of iron and T is 1700° C., Pco is 1476 Torr. In this case, in order to regulate G to −20, P may be kept at 270 Torr. On the other hand, when the steel comprises 0.1% of carbon and 12% of chromium with the balance consisting of iron and T is 1700° C., Pco is 370 Torr. In this case, in order to regulate G to −20, P may be kept at 67 Torr.

Introduction of aluminum and quick lime in an amount of 0.8 to 4.0 times the amount (kg) of aluminum added in the aluminum temperature elevation period and, in addition, introduction of a slag component, such as quick lime, in the oxygen blowing decarburization period in a high carbon concentration region to maintain the slag thickness at 100 to 1000 mm are also effective in preventing splash and in accelerating the softening of slag.

Further, the regulation of the depth of immersion of the snorkel in the molten steel in the aluminum temperature elevation period and the regulation of the immersion depth of the snorkel in the molten steel in the oxygen blowing decarburization period respectively to 200 to 400 mm and 500 to 700 mm can accelerate the reduction of a metal oxide (for example, $Cr_2O_3$ in refining of stainless steel) by a reaction with carbon contained in the steel, permitting the oxygen efficiency in decarburization to be kept on a high level.

According to the present invention, after the oxygen blowing decarburization, degassing is carried out under reduced pressure. In this case, an inert gas is injected from the low position of the ladle into the molten steel, of which the carbon concentration has been brought to around 0.01% by the oxygen blowing decarburization, in such an atmosphere that the degree of vacuum within the snorkel is in the range of from 10 to 100 Torr, so as to bring K value, defined by the following equation, to the range of from 0.5 to 3.5, thereby agitating the molten steel.

$$K = \log\{S \cdot H_v \cdot Q/P\}$$

wherein

K: agitation intensity at the activated surface;

S: activated surface area (plume eye area), $m^2$;

$H_v$: depth of injected inert gas, m;

Q: flow rate of injected inert gas, Nl/min/ton-steel; and

P: degree of vacuum within the tank, Torr.

The degassing treatment can maintain the renewal of the interface at a activated surface, which is a substantial gas/metal reaction interface, enabling a high-purity molten steel having an attained carbon concentration of not more than 10 ppm to be effectively produced.

When introduction of aluminum for reduction, after the degassing treatment, to reduce a metal oxide (for example, $Cr_2O_3$ in the case of refining of stainless steel) produced during oxygen blowing, thereby recovering the metal, is necessary, an inert gas for agitation is injected into the molten steel in the flow rate range of from 0.1 to 3.0 Nl/min/ton-steel (in terms of flow rate per ton of molten steel to be refined; hereinafter referred to as "Nl/min/t") in an atmosphere having a low degree of vacuum of not more than 400 Torr, or alternatively, it is possible to employ a method wherein, immediately after the degassing treatment, the pressure is returned to the atmospheric pressure, the vacuum tank is lifted, and, simultaneously with the lifting of the tank, aluminum for reduction is introduced into the molten steel and an inert gas for agitation is injected into the molten steel at a flow rate of 0.1 to 3.0 Nl/min/t during the introduction of aluminum for reduction and at a flow rate of 5 to 10 Nl/min/t after the introduction of aluminum for reduction. The injecting of the inert gas by the above method can prevent a rapid rise in temperature of the molten steel or bumping of the molten steel and at the same time can prevent nitrogen pickup in the reduction period.

The present invention provides a vacuum decarburization refining apparatus that can inhibit the deposition of splash (droplets) created by splashing or bumping, or dust formed by solidification of the splash onto the inner wall of the vacuum tank and the snorkel submerged in the molten steel, which is a major problem to be solved by the invention. The vacuum decarburization refining apparatus has the following construction.

At least one burner is provided on the side wall, in an upper tank, in the vicinity of the canopy of the vacuum tank, and a space having a larger inner diameter than the inner diameter of the snorkel is provided in a lower tank in the vacuum tank. In addition, a shielding section, which has at its center a space having an inner diameter smaller than each tank and larger than the outer diameter of the top-blown lance, is provided, between the lower tank and the upper tank at a position which receives enough radiated heat to melt the deposited metal, integrally with the side wall of the vacuum tank.

The vacuum tank having the above construction permits the influence of a high temperature, around a hot spot created by the blowing of oxygen through the top-blown lance and the decarburization reaction, on the refractories in the side wall of the lower tank to be avoided, and at the same time enables the metal deposited on the shielding section to be melted by radiated heat. Further, dust, constituted by splash which has ascended to the upper tank without being deposited onto the shielding section and has been deposited in the vicinity of the canopy, is melted by means of the burner, flows downward and is removed.

Further, the evacuation duct disposed between the vacuum tank and a gas cooler for cooling an exhaust gas comprises an ascendingly inclined section inclined upward from an duct inlet provided in the upper tank of the vacuum tank and a descendingly inclined section inclined downward from the top of the ascendingly inclined section. Therefore, splash of the molten steel and dust, which, together with an exhaust gas, have entered the evacuation duct are collected in a dust pot provided below the descendably inclined section without being deposited within the evacuation duct.

As described above, a major object of the present invention is to increase the oxygen efficiency in decarburization while minimizing splash, bumping and other unfavorable phenomena created in the course of refining. Since, however, means is provided which, even when splashing or the like is created, can effectively avoid or remove droplets or dust derived from the splashing and the like, the degree of vacuum within the vacuum tank can be always kept on a desired level, realizing stable operation.

BEST MODE FOR CARRYING OUT THE INVENTION

The best mode for carrying out the invention will be described with reference to the accompanying drawings.

At the outset, a vacuum decarburization refining system used for carrying out the method according to the present invention will be described.

Figure 1:
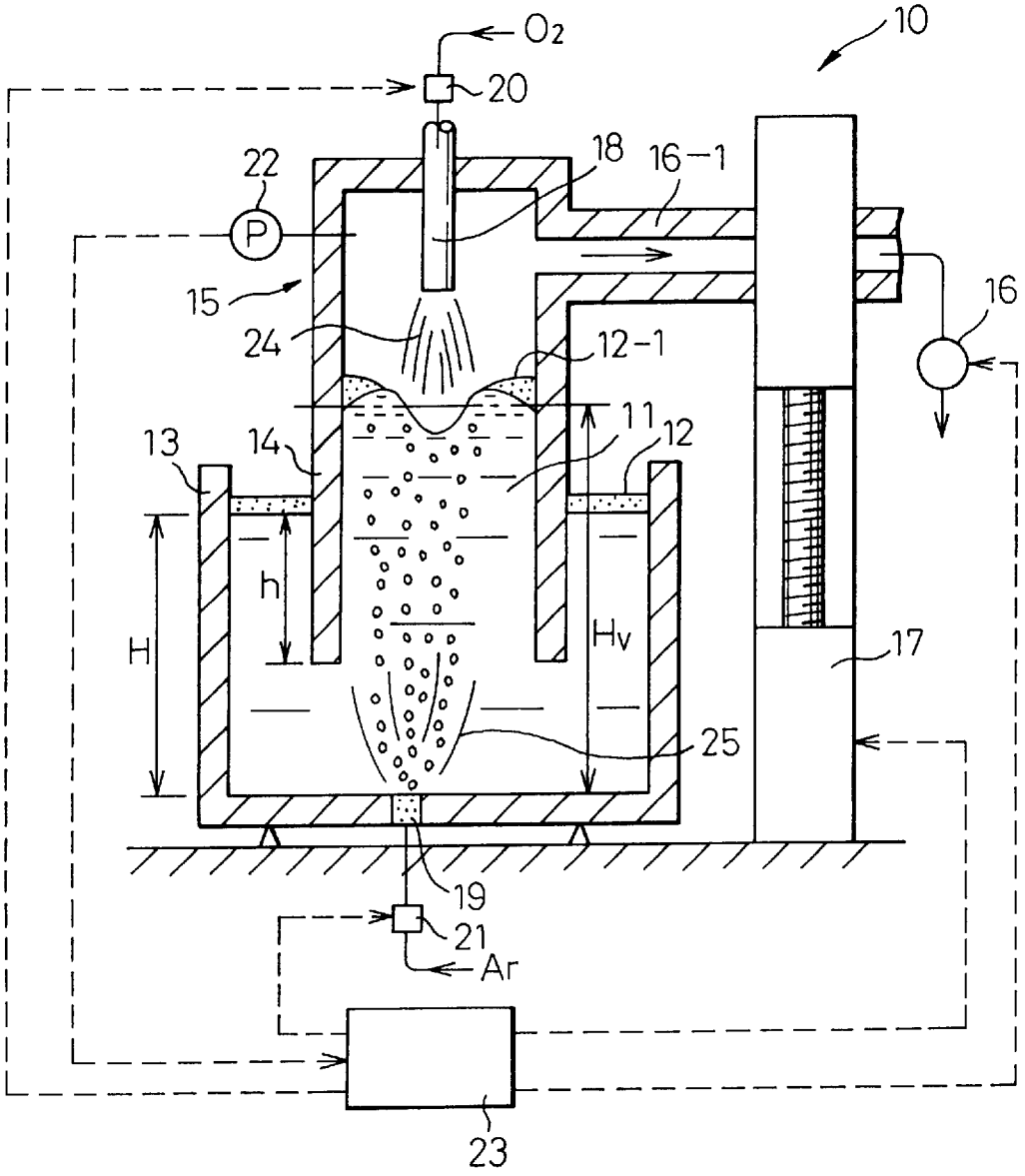
FIG. 1 is an explanatory view of a vacuum decarburization refining system which is applied to a method for vacuum decarburization refining of a stainless steel according to an embodiment of the present invention.

As shown in FIG. 1, a vacuum decarburization refining system 10 comprises: a vacuum tank 15 comprising a cylindrical refractory; a ladle 13 containing a molten steel 11; and an evacuating apparatus 16 for evacuating the interior of a vacuum tank 15.

The vacuum tank 15 comprises a lower tank and an upper tank. The lower tank constitutes a snorkel 14 submerged in the molten steel 11, while a top-blown lance 18 for blowing an oxygen gas into the molten steel 11 is liftably provided in the canopy of the upper tank.

Further, the vacuum tank 15 is provided with a lift drive 17 for vertically moving the vacuum tank 15, and a nozzle (a porous plug) 19 for blowing an inert gas into the molten steel is provided at the low position of the ladle 13, for example, the bottom.

An oxygen gas flow rate control valve 20 for regulating the flow rate of the oxygen gas blown through the top-blown lance 18 is disposed on the inlet side of the top-blown lance 18, and an inert gas flow rate control valve 21 for regulating the flow rate of the inert gas is provided on the inlet side of an inert gas suction nozzle. These control valves for regulating the flow rates of the oxygen and inert gases are controlled by a controller 23 and the like.

Further, a vacuum gage 22 for measuring the degree of vacuum within the vacuum tank 15 is provided at a predetermined position of the vacuum tank 15 or the evacuation system.

The vacuum decarburization refining system is constructed so that a signal corresponding to the degree of vacuum measured with the vacuum gage 22, a signal on the position of the snorkel 14 relative to the ladle 13, a signal indicating the concentration of carbon in the molten steel 11 and other signals are input into the controller 23 and, according to these input signals and an operating procedure described later, the controller 23 controls the evacuating apparatus 16 and the lift drive 17 so that the evacuating apparatus 16 and the lift drive 17 perform respective necessary operations.

In determining the concentration of carbon in the molten steel 11, the carbon concentration of the molten steel 11 may be directly measured, or alternatively may be determined by calculation based on the carbon concentration before the refining and the history of a change in concentration of a CO gas in the exhaust gas.

It is also possible to use a method wherein a change in carbon concentration over time for each treatment step is previously determined and the carbon concentration at a specified time is estimated based on the data.

The ladle 13 is a nearly cylindrical vessel, for a molten steel, lined with a refractory such as an alumina-silica refractory.

According to the method of the present invention, decarburization refining of a molten steel is carried out under reduced pressure using the above apparatus. Regarding a series of steps constituting the method of the present invention, a decarburization refining process, as a finishing process of a stainless steel, wherein decarburization is carried out through aluminum temperature elevation-oxygen blowing decarburization-degassing-optional reduction with aluminum to bring a carbon concentration to a predetermined value, will be described by way of example.

The step of aluminum temperature elevation and the subsequent step of oxygen blowing decarburization will be first described.

A snorkel 14 provided at the lower part of the vacuum tank 15 is submerged, for example, in a molten stainless steel 11 having a chromium concentration of 16% and a carbon concentration of 0.7% within the ladle 13. The interior of the vacuum tank 15 is evacuated by means of an evacuating apparatus 16 to maintain the degree of vacuum, P, within the vacuum tank on a predetermined level. This permits the molten steel 11 within the snorkel 14 to be sucked, causing the surface of the molten steel to ascend through the snorkel 14, which, as shown in FIG. 1, results in a change in depth h of immersion of the snorkel 14 and depth H of the molten steel within the ladle 13.

Thereafter, aluminum (Al) is added to the vacuum tank and an oxygen jet 24 is injected and blown into the molten steel 11 within the snorkel 14 through the oxygen blowing lance 18 to conduct temperature elevation and decarburization refining of the molten steel 11.

According to this embodiment, in the temperature elevation and decarburization refining of the molten steel 11, bringing the G value, defined by the following equation (1), to not more than −20 in an aluminum combustion period in an early stage (temperature elevation period) can inhibit excessive production of chromium oxide during the blowing of oxygen.

$$G=5.96\times10^{-3}\times T\times\ln(P/P_{co}) \quad (1)$$

wherein $$P_{co}=760\times[10^{(-13800/T+8.76)}]\times[\%\ C]/[\%\ Cr];$$

P: less than 760;

wherein

T: molten temperature, K; and

P: degree of vacuum within the tank, Torr.

In the vacuum decarburization refining of a molten stainless steel, it is important to carry out the operation so as to ensure a preferential decarburization region in the Hilty equilibrium equation represented by the following equation (2).

$$\log([\%\ Cr]\cdot Pco/[\%\ C])=-13800/T+8.76 \quad (2)$$

In refining under reduced pressure, an important operating factor in the application of the equation (2) is the partial pressure of CO ($P_{CO}$) in an atmosphere represented by the degree of vacuum during operation, and the molten steel temperature (T) is a very important additional factor. Therefore, introduction in advance of aluminum or the like having higher affinity for oxygen than chromium and carbon followed by oxygen blowing to raise the molten steel temperature by utilizing the heat of oxidation is effective in inhibiting the oxidation of chromium in the oxygen blowing decarburization period.

Since, however, the oxidation of chromium occurs also during the aluminum temperature elevation, the prevention of oxidation of chromium during the temperature elevation period has been an important factor for prevention of the oxidation of chromium in the whole stage of oxygen blowing, that is, for reducing the unit requirement for a reducing agent used after oxygen blowing is stopped.

For this reason, according to the present invention, in order to prevent the oxidation of chromium during temperature elevation/decarburization refining, the degree of vacuum in the aluminum temperature elevation period is kept on a high level as much as possible to burn only aluminum in this period.

Figure 2:
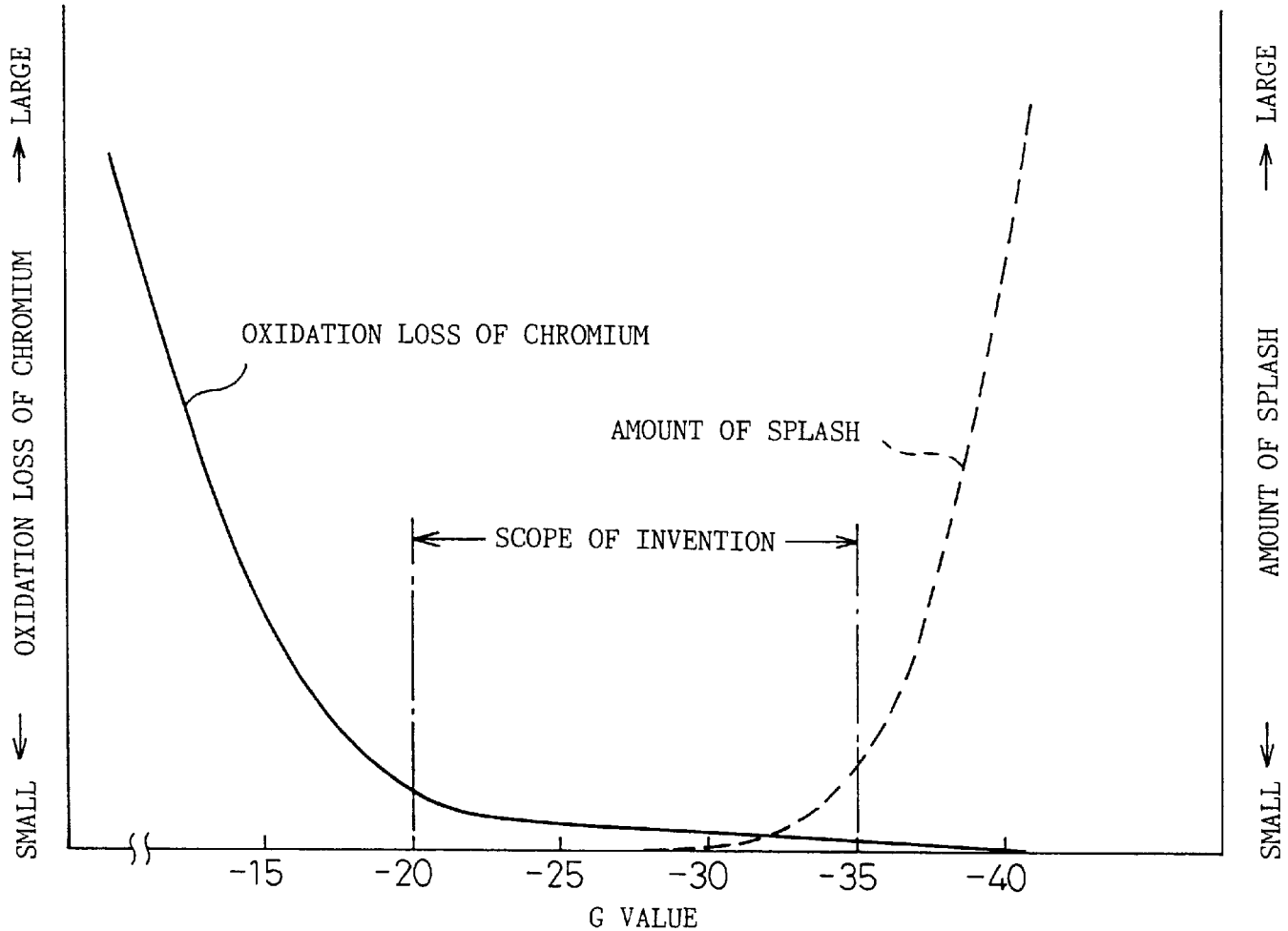
FIG. 2 is a diagram showing the relationship between the total weight of chromium oxidized (chromium oxidation loss) and the amount of splash created in the aluminum temperature elevation period and the decarburization refining period and the G value.
Figure 3:
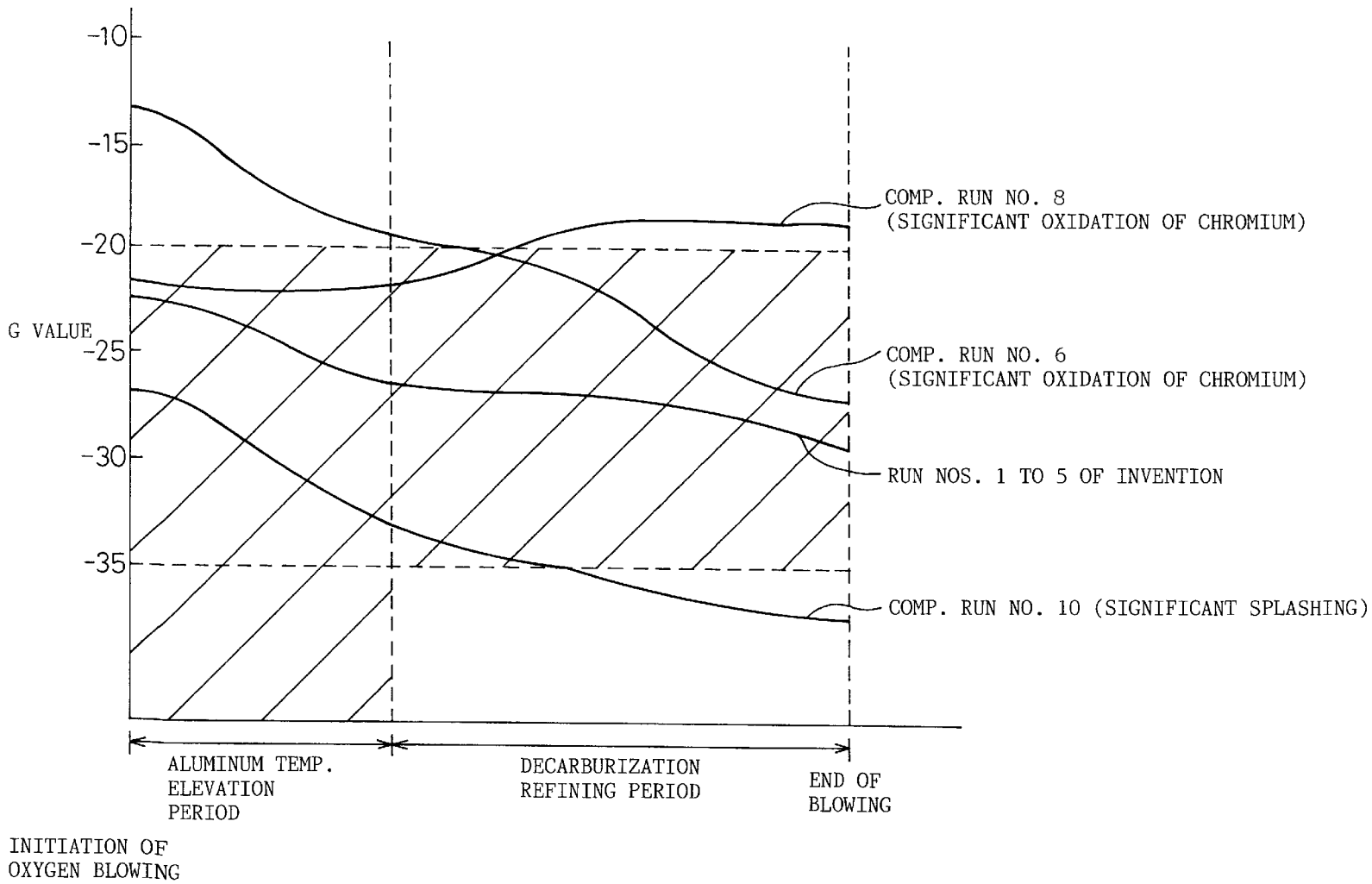
FIG. 3 is a diagram showing a change in G value in the temperature elevation period and the decarburization refining period with respect to the present invention in comparison with comparative examples.

More specifically, during the aluminum temperature elevation period, the oxidation of chromium is prevented during the temperature elevation period by regulating the degree of vacuum within the tank so as to maintain the G value, defined by the equation (1), at a value of not more than −20. This is because, as indicated by a solid line in FIG. 2, maintaining the G value at a value of not more than −20 reduces loss of chromium by oxidation to accelerate the combustion of aluminum or carbon.

In this case, preferably, aluminum for temperature elevation is introduced in portions during temperature elevation/oxygen blowing, because introduction of aluminum all at once before the oxygen blowing followed by temperature elevation while oxygen blowing with aluminum dissolved in the molten steel creates such an unfavorable phenomena that aluminum in the molten steel within the vacuum tank is temporarily used up during the temperature elevation period and, in this state, even when the G value is brought to not more than −20, the oxidation of chromium often occurs.

The distance between the surface of the molten steel sucked into the snorkel in the oxygen blowing period and the canopy of the vacuum tank, that is, the freeboard, is preferably not less than 6 m from the viewpoint of preventing spitting in the aluminum temperature elevation period and preventing splash, created in the subsequent decarburization refining period, from reaching the canopy.

In this case, the term "temperature elevation period" refers to a period between the initiation of oxygen blowing and the point of time when the oxygen blowing proceed to the accumulated amount of oxygen represented by the following equation (3).

$$\text{Amount of oxygen blown in temperature elevation period } (Nm^3) = \text{Amount of aluminum added (kg)} \times \text{purity of aluminum} \times 33.6/54 \quad (3)$$

In the decarburization refining period after the completion of the temperature elevation, the G value is brought to the range of from −35 to −20. As described above, when the degree of vacuum is such that the G value exceeds −20, as indicated by a solid line in FIG. 2, the oxidation of chromium is promoted. On the other hand, oxygen blowing decarburization under such a high vacuum that the G value is less than −35, as indicated by a dotted line in FIG. 2, leads to splashing, resulting in a remarkably deteriorated operation efficiency.

The G value in each of the above periods is regulated to a predetermined value as follows. The degree of vacuum P is measured with the vacuum gage 22. The temperature T of the molten steel is previously provided based on the temperature history for each carbon concentration predicted from the temperature before the treatment. Based on these data, the G value is determined in the controller 23 according to the equation (1). The degree of vacuum P is regulated based on the results so that the G value falls within the above range.

Further, according to the present invention, in order to avoid a operation problem, attributable to an outflow of $Al_2O_3$, produced by the aluminum temperature elevation, into the outside of the tank, quick lime (CaO) in an amount corresponding to $0.8W_{Al}$ to $4.0W_{Al}$ (kg), wherein $W_{Al}$ represents the amount of aluminum added at the time of the temperature elevation (kg), is introduced.

In the method for vacuum decarburization refining according to the present invention, the resultant slag should be discharged into the outside of the tank before the degassing as a later step. When $Al_2O_3$, produced by the aluminum temperature elevation as such, flows out into the outside of the tank, however, the slag floating in the ladle is solidified in an early stage because $Al_2O_3$ per se is an oxide having a very high melting point. This makes it difficult to conduct sampling of the molten steel and, in addition, leads to a problem of fixing the snorkel to the ladle.

For this reason, in order to avoid the above operation problems, CaO is added in the above amount in the aluminum temperature elevation period to form a calcium aluminate compound ($12CaO.7Al_2O_3$), a low-melting compound, improving the percentage liquid phase of the slag and consequently avoiding the above operation problems.

In this case, when the amount of CaO added is less than $0.8W_{Al}$ (kg), the amount of calcium aluminate produced is insufficient, leading to the precipitation of a large amount of a single phase of $Al_2O_3$, a high-melting oxide, which results in unsatisfactory melting of the slag. On the other hand, when the amount of CaO added exceeds $4.0W_{Al}$ (kg), the amount of calcium aluminate produced is sufficient. In this case, however, a large amount of a single phase of CaO, a high-melting oxide, is precipitated, accelerating the solidification of slag which has flowed out. Further, the amount of slag within the snorkel is excessively increased. In the oxygen blowing decarburization period as a later step, this inhibits the arrival of the top-blown oxygen jet at the surface of the molten steel, resulting in lowered oxygen efficiency in decarburization.

Figure 5:
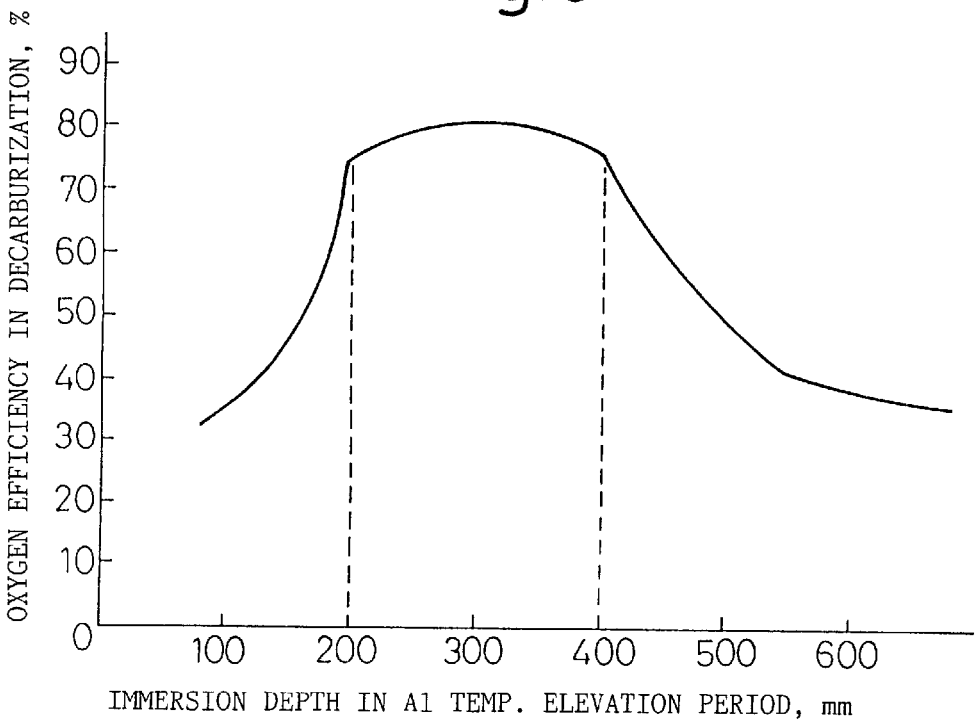
FIG. 5 is a diagram showing the relationship between the immersion depth of the snorkel in the aluminum temperature elevation period and the oxygen efficiency in decarburization.
Figure 6:
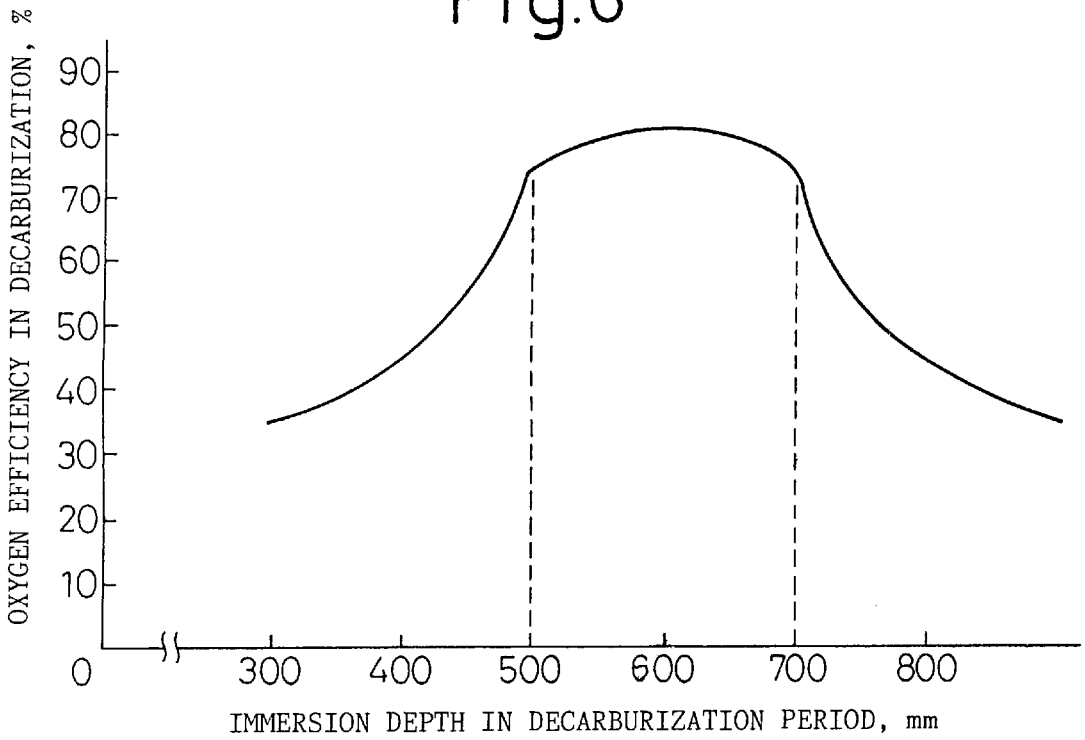
FIG. 6 is a diagram showing the relationship between the immersion depth of the snorkel in the decarburization period and the oxygen efficiency in decarburization.
Figure 7:
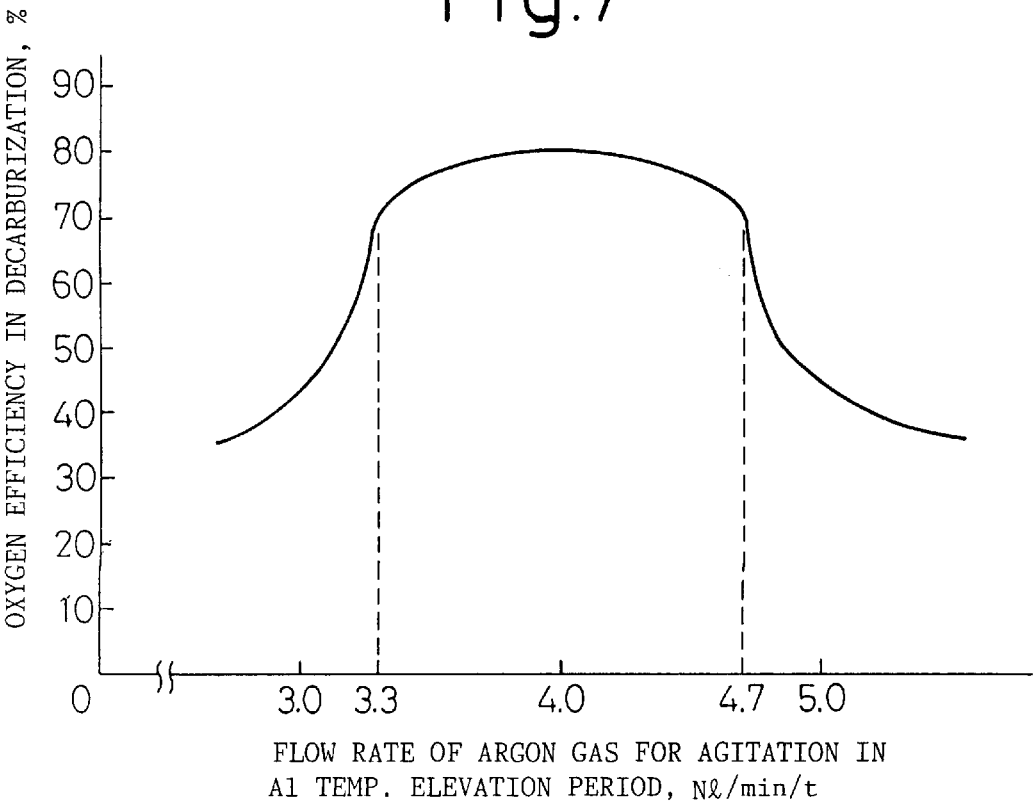
FIG. 7 is a diagram showing the relationship between the flow rate of an argon gas for agitation in the aluminum temperature elevation period and the oxygen efficiency in decarburization.
Figure 8:
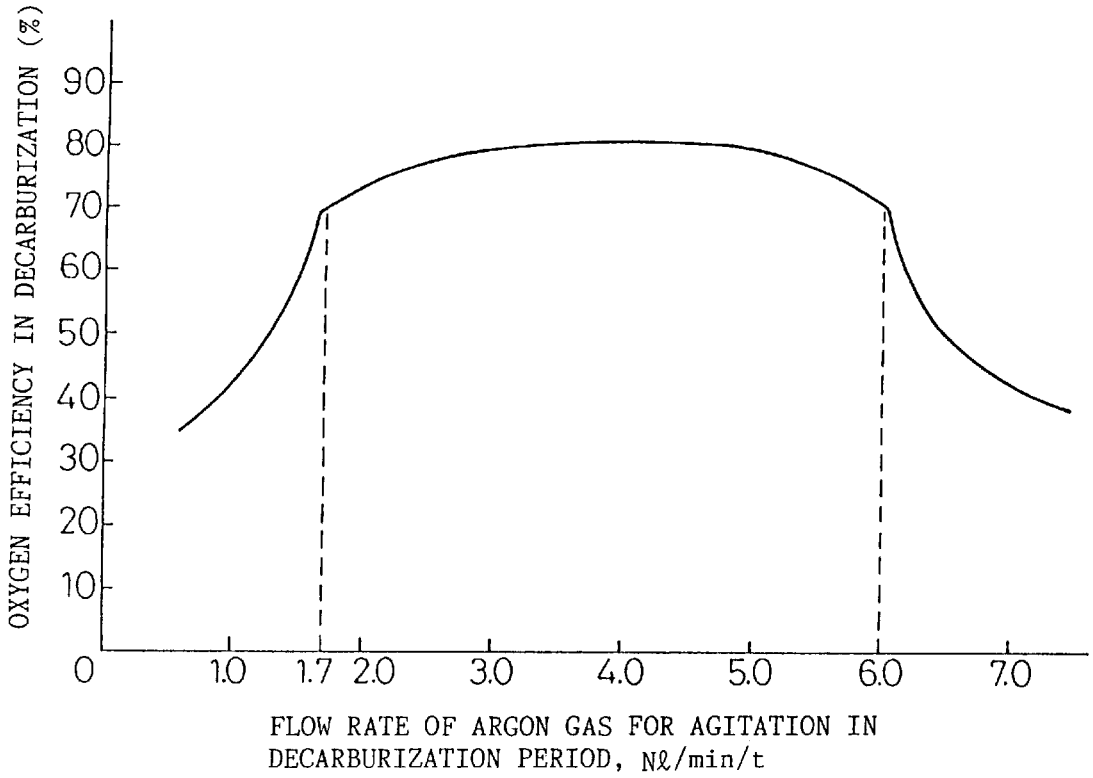
FIG. 8 is a diagram showing the relationship between the flow rate of an argon gas for agitation in the decarburization period and the oxygen efficiency in decarburization.

Further, the depth of the snorkel submerged in the molten steel in the vacuum tank in the aluminum temperature elevation period is preferably in the range of from 200 to 400 mm, from the viewpoint of suitably bringing $Al_2O_3$ and CaO produced by the oxygen blowing temperature elevation into contact with each other in the molten steel within the snorkel to accelerate the production of a calcium aluminate compound. When the immersion depth is less than 200 mm, as shown in FIG. 5, the time of contact between $Al_2O_3$ and CaO in the molten steel within the snorkel is so short that $Al_2O_3$ and CaO are discharged outside the system before the production of the calcium aluminate compound. This causes the slag on the ladle to be solidified, making it difficult to sample the molten steel and posing other problems. On the other hand, when the immersion depth exceeds 400 mm, the residence time of the calcium aluminate compound within the snorkel becomes long, accelerating melt loss of the refractory in the submerged portion. This further creates an excessively large amount of residual slag within the submerged portion in the later oxygen blowing decarburization period, inhibiting the arrival of the blown oxygen jet at the molten steel, which results in deteriorated oxygen efficiency in decarburization.

In the oxygen blowing decarburization period after the aluminum temperature elevation period, in order to prevent the occurrence of a large amount of splash while maintaining the oxygen efficiency in decarburization on a high level, preferably, the G value is brought to the range of from −35 to −20 in a high carbon concentration region where the carbon concentration is the critical carbon concentration (0.1 to 0.3 wt %) or more, and, at the same time, the following requirements are satisfied.

(i) The activated surface is regulated so as to occupy not less than 10% of the total surface area of the molten steel and not less than 100% of a surface blown by an oxygen gas jet, i.e., a projection surface of the oxygen gas jet.

(ii) In the high carbon concentration region where the carbon concentration is not less than the critical carbon concentration, the depth of the snorkel submerged in the molten steel is brought to the range of from 500 to 700 mm, and, at the same time, the flow rate of an inert gas for agitation injected by the low portion of the ladle is maintained in the range of from 0.3 to 10 Nl/min/t, preferably from 0.3 to 4 Nl/min/t, while blowing oxygen gas at a flow rate of 3 to 25 $Nm^3/h/t$ onto the molten steel through an oxygen blowing lance provided in the canopy of the vacuum tank.

(iii) In the high carbon concentration region, quick lime or the like is added at once or in portions to regulate the thickness of slag on the surface of the molten steel within the snorkel to 100 to 1000 mm, in terms of the thickness, in a stationary state.

(iv) In a subsequently formed low carbon concentration region where the carbon concentration is in the range of from 0.1–0.3% by weight to 0.01% by weight, the degree of vacuum within the tank is continuously shifted toward a high degree of vacuum, and, at the same time, the flow rate of the oxygen gas is reduced to a range of 0.5 to 12.5 $Nm^3/h/t/min$. At the same time, the flow rate of the inert gas is brought to a range of from 0.3 to 10 Nl/min/t, preferably from 5 to 10 Nl/min/t, and the immersion depth of the snorkel is increased and/or decreased in the predetermined range.

It is known that, regardless of whether the oxygen blowing decarburization refining of the molten steel is carried out under atmospheric pressure or in vacuo, metallic elements (iron, chromium and the like) contained in a steel bath are oxidized with oxygen fed in the bath to form metal oxides (such as FeO and $Cr_2O_3$) and are then reduced with carbon contained in the molten steel to permit decarburization to proceed.

In this connection, in oxygen blowing decarburization refining of a chromium-containing molten steel typified by a molten stainless steel, the metal oxide is composed mainly of chromium oxide ($Cr_2O_3$). Since $Cr_2O_3$ is a high-melting oxide, the presence of $Cr_2O_3$ results in a remarkably lower percentage of liquid phase of the slag. In the method for vacuum oxygen blowing decarburization refining of a molten steel wherein the lower part of a one-legged, straight-barrel cylindrical vacuum tank is submerged in the molten steel specified in the present invention and the interior of the vacuum tank is then evacuated to carry out oxygen blowing decarburization refining, when $Cr_2O_3$ formed within the snorkel is discharged outside the snorkel in an early stage in such a state that the reduction of $Cr_2O_3$ with carbon contained in the molten steel is unsatisfactory, the reduction of $Cr_2O_3$ with carbon contained in the molten steel does not take place because the slag on the ladle is in a stationary state. This leads to oxidation loss of a large amount of chromium. In addition, the slag on the ladle becomes very rich in $Cr_2O_3$, and, even when the calcium aluminate is formed, the solidification of the slag on the surface of the molten steel within the ladle remarkably proceeds. This deteriorates the workability and, for example, makes it difficult to sample the molten steel.

For this reason, maximizing the opportunity for contact of a metal oxide produced by oxygen blowing (in the present invention, the metal oxide will be hereinafter described as $Cr_2O_3$ by taking oxygen blowing decarburization refining of a stainless steel as an example) with carbon contained in the molten steel within the snorkel of the vacuum tank to accelerate the reduction reaction within the snorkel is important from the viewpoint of preventing the oxidation loss of chromium in the oxygen blowing decarburization period and efficiently carrying out the oxygen blowing decarburization while maintaining the oxygen efficiency in decarburization on a high level.

One requirement for this according to the present invention is to form the activated surface, in the oxygen blowing decarburization period, in a proportion of not less than 10% of the total surface area of the molten steel and not less than 100% of the surface blown by the oxygen gas jet.

This is because the formation of $Cr_2O_3$ at the activated surface, which is the most active reaction site on the surface of the molten steel, reduces the size of $Cr_2O_3$ particles to increase the area of the contact interface of the $Cr_2O_3$ particles and the carbon contained in the molten steel. When the activated surface is formed in a proportion of less than 10% based on the total surface area of the molten steel, the reduction in size of the $Cr_2O_3$ particles per se does not proceed. In this case, the $Cr_2O_3$ remains as coarse particles. Therefore, without satisfactorily reacting with carbon in the molten steel within the snorkel, $Cr_2O_3$ is discharged outside the tank, posing problems of increased chromium loss and deteriorated workability. Likewise, when the activated surface is formed in a proportion of less than 100% based on the oxygen blown surface, there arises a problem associated with coarsening of the resultant $Cr_2O_3$ particles.

Further, in the present invention, the carbon content of the molten steel to be decarburization-refined has been divided into a high carbon concentration region and a low carbon concentration region with the critical carbon concentration as a boundary between the high carbon concentration region and the low carbon concentration region, and, for each region, the optimal flow rate of an oxygen gas (oxygen blowing rate), the rate of a reduction in flow rate of the oxygen gas, the flow rate of an inert gas for agitation, the degree of vacuum in the vacuum tank, the immersion depth (immersion ratio) of the snorkel and the like have been investigated.

Figure 9:
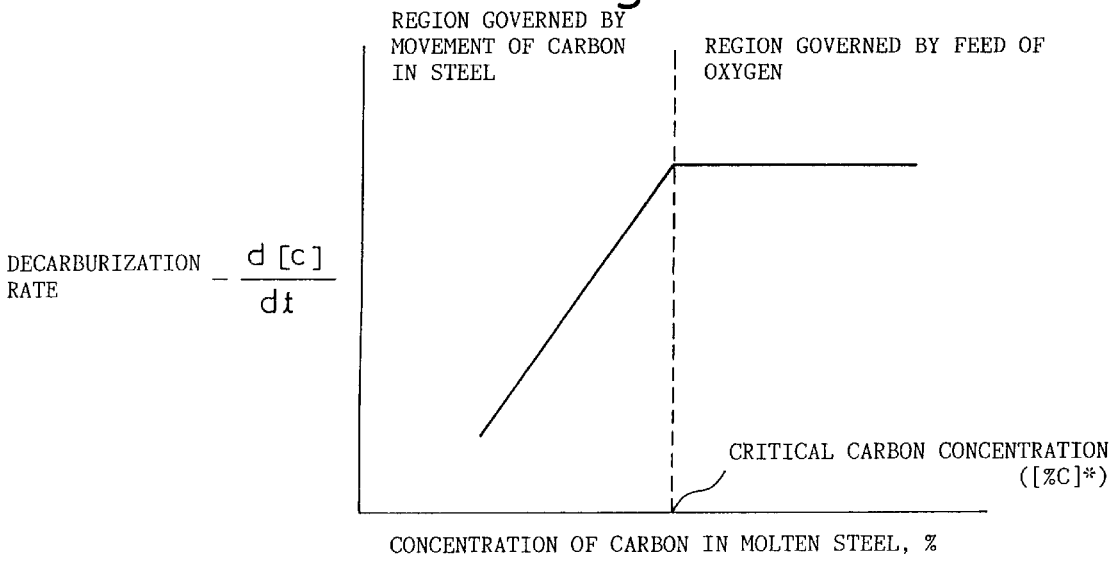
FIG. 9 is a typical diagram showing the relationship between the concentration of carbon in the molten steel and the decarburization rate during decarburization refining.

As shown in FIG. 9, the oxygen blowing decarburization refining reaction is generally divided into a high carbon concentration region, which is a reaction region where the decarburization rate ($-d[C]/dt$) is governed by the feed rate of the oxygen gas (a region governed by the feed of oxygen), and a low carbon concentration region which is a reaction region where the decarburization rate is governed by the moving speed of carbon in the molten steel (a region governed by the movement of carbon in the steel).

In the oxygen blowing decarburization refining of the molten stainless steel in vacuo, the critical carbon concentration ([% C]*), at which the region changes from the region governed by the feed of oxygen to the region governed by the movement of carbon in the steel, is approximately in the range of from 0.1 to 0.3% by weight, although the critical carbon concentration somewhat varies depending upon the chromium content and the operating conditions.

In the present invention, the flow rate of the oxygen gas in the high carbon concentration region is limited to 3 to 25 $Nm^3/h/t$. The reason for this is as follows. When the flow rate of the oxygen gas in the high carbon concentration region is less than 3 $Nm^2/h/t$, the decarburization rate of the molten steel is likely to fall, making it necessary to prolong the refining time, which lowers the productivity.

On the other hand, when the flow rate of the oxygen gas exceeds 25 $Nm^3/h/t$, the rate of CO gas generated in the decarburization reaction is excessively increased, leading to the occurrence of a large amount of splash. This unfavorably develops an adverse effect, such as lowered yield, and increased chromium loss attributable to the fact that the production rate of the metal oxide is excessive relative to the feed of carbon, in the molten steel, which should serve as a reducing material, into the snorkel.

When the flow rate of the inert gas for agitation in the high carbon concentration region is less than 0.3 Nl/min/t, the circulation between the molten steel within the snorkel and the molten steel in the ladle is deteriorated, resulting in lowered mixing efficiency, which lowers the oxygen efficiency in decarburization and increases the chromium loss.

On the other hand, when the flow rate of the inert gas for agitation exceeds 10 Nl/min/t, a problem associated with the outflow in an early stage of the metal oxide produced within the snorkel into the outside of the tank, or remarkable acceleration of the damage to refractories constituting the snorkel unfavorably occurs. In this case, the upper limit of the flow rate of the inert gas for agitation is preferably 4.0 Nl/min/t.

When the oxygen blowing decarburization refining is carried out in vacuo, the occurrence of splash in the high carbon concentration region becomes the most serious problem in stabilizing the operation. The high carbon concentration region is the so-called "most active decarburization period." During this period, the evolution of the CO gas is most active, which induces splashing. Therefore, in order to prevent splashing and to carry out oxygen blowing decarburization refining without causing significant deposition of the metal, the prevention of splashing in the high carbon concentration region is very important.

According to the present invention, in the oxygen blowing decarburization period in the high carbon concentration region, quick lime or the like is added all at once or in portions to the tank, and oxygen blowing decarburization is carried out in such a state that slag having a thickness of 100 to 1000 mm in terms of the thickness in a stationary state is held on the surface of the molten steel within the snorkel.

Splashing created in the oxygen blowing decarburization is known to be created by rebounding of a top-blown jet and by bursting of CO gas bubbles, produced within the molten steel (bubble breaking) on the surface of the molten steel. The attainable height of the splash is governed by the initial speed at the time of formation of splash (initial speed) and the CO gas evolution rate (that is, flow rate of the exhaust gas). Therefore, lowering the oxygen blowing speed per se is effective in reducing the attainable eight of the splash. The lowering in oxygen blowing speed leads directly to lowered throughput speed. Therefore, this means cannot be useful means from the viewpoint of maintaining the high productivity. Thus, the reduction in initial speed immediately after the formation of splash is important from the viewpoint of reducing the attainable height and scattering distance of splash while maintaining the high productivity.

Further, in the present invention, in order to reduce the initial speed immediately after the formation of splash, a suitable slag layer is formed on the surface of the molten steel. When splash particles penetrate the slag layer, the slag layer reduces the energy of the splash particles, thereby significantly relaxing the later scattering behavior.

In this case, the thickness of the slag layer to be held on the molten steel within the vacuum tank is preferably 100 to 1000 mm in terms of the thickness in a stationary state on the surface of the molten steel within the snorkel. When the thickness of the slag layer is less than 100 mm, the energy loss of the splash is small, making it impossible to relax the later scattering behavior. On the other hand, when the thickness exceeds 1000 mm, the arrival of the top-blown oxygen jet onto the surface of the molten steel per se is inhibited, resulting in lowered oxygen efficiency in decarburization.

The composition of the slag to be accumulated on the surface of the molten steel can be provided by incorporating a slag material, such as quick lime, all at once or in portions into the vacuum tank in the high carbon concentration region, where splash particles are most actively produced in the oxygen blowing decarburization period and the carbon concentration is the critical carbon concentration or more. In this case, the composition is preferably such that (% CaO)/(% $SiO_2$)=1.0 to 4.0, (% $Al_2O_3$)=5 to 30%, and ($Cr_2O_3$)≦40%. This composition can protect the refractories constituting the snorkel and can prevent the solidification of the cover slag. When the slag, for covering the splash, within the vacuum tank is solidified, the effect of preventing the splashing attained by the slag is remarkably reduced. Further, in this case, as described above, the solidification of the slag in the ladle in an early stage at the time of outflow into the outside of the tank is accelerated. Specifically, when (% CaO)/(% $SiO_2$) is less than 1.0, the effect of preventing splashing can be attained. In this case, however, the melt loss of the refractories is significant. On the other hand, when (% CaO)/(% $SiO_2$) exceeds 4, even though the other constituents of the slag fall within the above respective ranges, the slag is solidified. This leads to the disappearance of the effect of covering the splash, resulting in deposition of a large amount of the metal. Likewise, when the concentration of (% $Al_2O_3$) is less than 5%, a large amount of the splash is unfavorably created due to the solidification of the slag. On the other hand, when the concentration exceeds 30%, the melt loss of the refractories is significant. Further, in the production of a stainless steel or the like by the melt process, a concentration of $Cr_2O_3$ in the slag exceeding 40% is unfavorable from the viewpoint of the solidification of slag.

Figure 17:
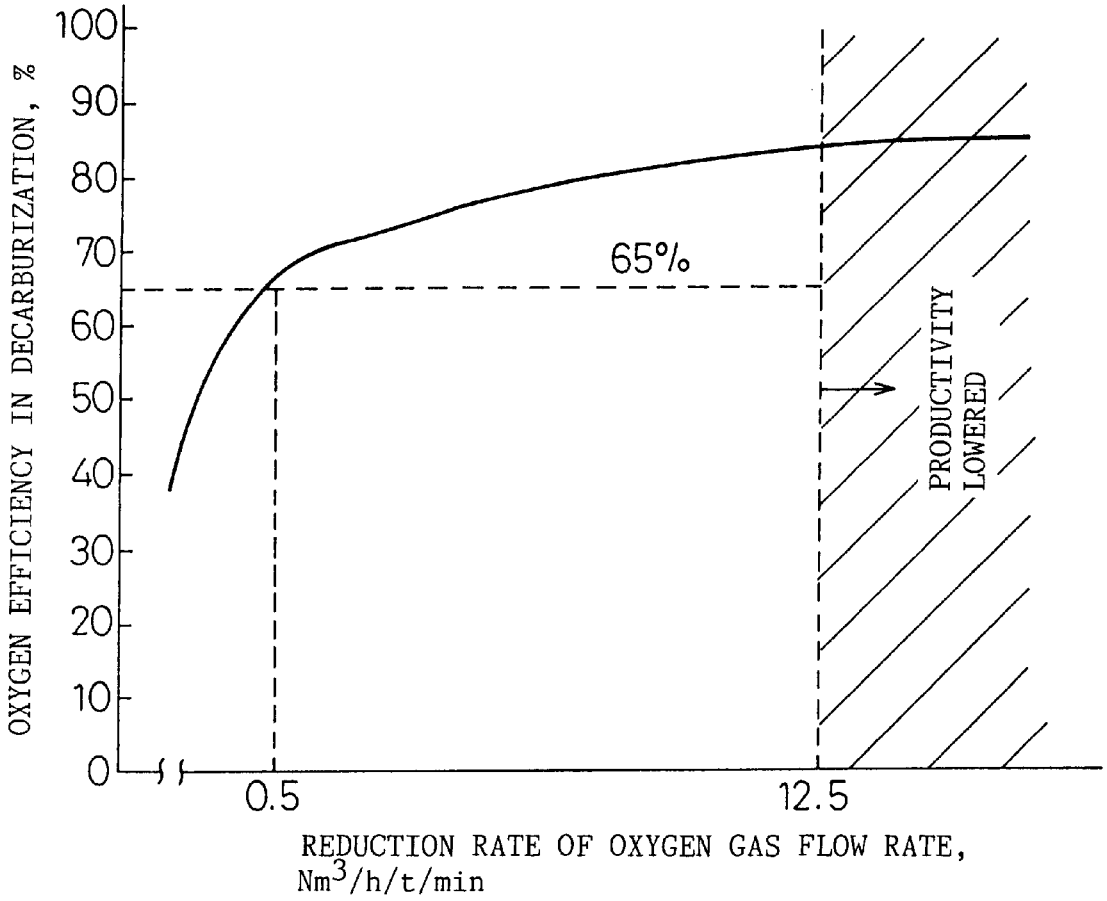
FIG. 17 is a diagram showing the relationship between the oxygen efficiency in decarburization and the rate of a reduction in flow rate of an oxygen gas.

The oxygen blowing conditions according to the present invention are characterized by the rate of reduction in flow rate of the oxygen gas (oxygen blowing rate) in the low carbon concentration region. In the prior art, the reduction rate in this region has not been fully taken into consideration. According to the present invention, as shown in FIG. 17, bringing the reduction rate to the range of from 0.5 to 12.5 $Nm^3/h/t/min$ has realized very effective operation.

When the reduction rate of the flow rate of the oxygen gas in the low carbon concentration region is less than 0.5 $Nm^3/h/t/min$, the reduction in evolution of CO gas is so small that the amount of splash created is excessive. Further, the amount of chromium oxidized attributable to excessive feed of the oxygen gas is increased.

On the other hand, when the reduction rate exceeds 12.5 $Nm^3/h/t/min$, the oxygen efficiency in decarburization in the low carbon concentration region is lowered. Further, in this case, the excessively rapid reduction in flow rate of the oxygen gas requires prolongation of the time of oxygen blowing at a low flow rate. As a result, disadvantageously, the productivity is likely to fall.

In the low carbon concentration region, since the evolution rate of the CO gas is gradually lowered, the occurrence of splash per se is reduced, posing no significant problem associated with the stabilization of the operation. Further, as described above, since the decarburization reaction in the low carbon concentration region is in a "region governed by the movement of carbon in the steel," the mass transfer of the carbon in the molten steel should be accelerated beyond the mass transfer in the high carbon concentration region in order to maintain the oxygen efficiency in decarburization at a high level. Further, in order to efficiently carry out degassing as a later step, the cover slag, within the snorkel, used for the prevention of splash in the high carbon concentration region, should be discharged outside the tank as much as possible during the oxygen blowing decarburization period in the low carbon concentration region.

In the present invention, in addition to a continuous fall in the flow rate of the oxygen gas, the flow rate of the inert gas for agitation is brought to a range of from 0.3 to 10 Nl/min/t, preferably 5 to 10 Nl/min/t, in the low carbon concentration region, and the immersion depth of the snorkel is increased and/or decreased in a predetermined range.

This is done from the viewpoint of more actively feeding carbon contained in the molten steel to the metal oxide ($Cr_2O_3$) produced by oxygen blowing to more effectively carry out the decarburization reaction and, in addition, of accelerating the discharge of slag. When the flow rate of the inert gas for agitation in the low carbon concentration region is less than 0.3 Nl/min/t, the following problems arise. Specifically, in this case, the agitating force is unsatisfactory, resulting in unsatisfactory feed of carbon to $Cr_2O_3$ produced within the tank, which in turn results in lowered oxygen efficiency in decarburization and increased chromium loss. Further, in the above case, disadvantageously, the discharge of the slag is unsatisfactory, leading to lowered reaction efficiency in the later step of degassing.

On the other hand, when the inert gas is fed at a flow rate exceeding 10 Nl/min/t, the effect of feeding carbon into the tank is not improved. This unfavorably renders an attack by the gas more severe, accelerating the damage to refractories constituting the snorkel.

Even when the composition of the slag in the aluminum temperature elevation period and the high carbon concentration region is regulated, the slag, which, with the elapse of the blowing time is discharged outside the tank and floated on the ladle, is partially cooled and solidified upon contact with the air.

This in some cases causes the snorkel to be partially fixed to the ladle. In the present invention, in order to avoid this unfavorable phenomenon, the immersion depth of the snorkel in the low carbon concentration region is decreased and/or increased in a predetermined range. This fluctuates the surface of the molten steel in the ladle and accelerates the heat transfer from the molten steel to the slag on the ladle, causing remelting of the slag, which facilitates sampling of the molten steel and, in addition, enables fixation between the snorkel and the ladle to be fully avoided. The variation in the immersion depth of the snorkel may be semi-continuously carried out in a range of from 0.1 to 0.6 in terms of h/H wherein h represents the immersion depth of the snorkel and H represents the depth of the molten steel within the ladle. Preferably, however, the immersion depth of the snorkel is varied only by decreasing the immersion depth from the viewpoint of promoting the circulation of the molten steel and discharging the slag in an earlier stage. In this case, when the h/H value is less than 0.1, the discharge of the slag is significantly promoted. This, however, causes $Cr_2O_3$ produced by oxygen blowing to be simultaneously discharged outside the tank before the reduction of $Cr_2O_3$ with carbon contained in the molten steel, leading to increased chromium loss. On the other hand, when the h/H value exceeds 0.6, the circulation between the molten steel within the snorkel and the molten steel within the ladle becomes unsatisfactory. This unfavorably results in increased chromium loss and deteriorated discharge of the slag.

Next, the vacuum decarburization refining method will be described in more detail based on the above various conditions with reference to FIG. 1 and FIGS. 10 to 14.

Figure 10:
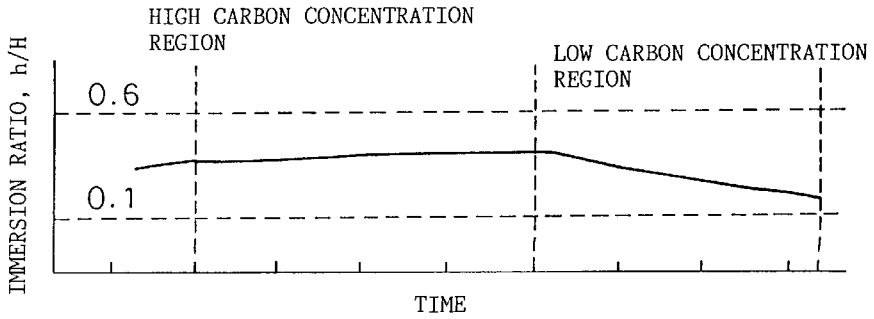
FIG. 10 is a typical diagram showing a change in immersion ratio (h/H) over time during decarburization refining.
Figure 11:
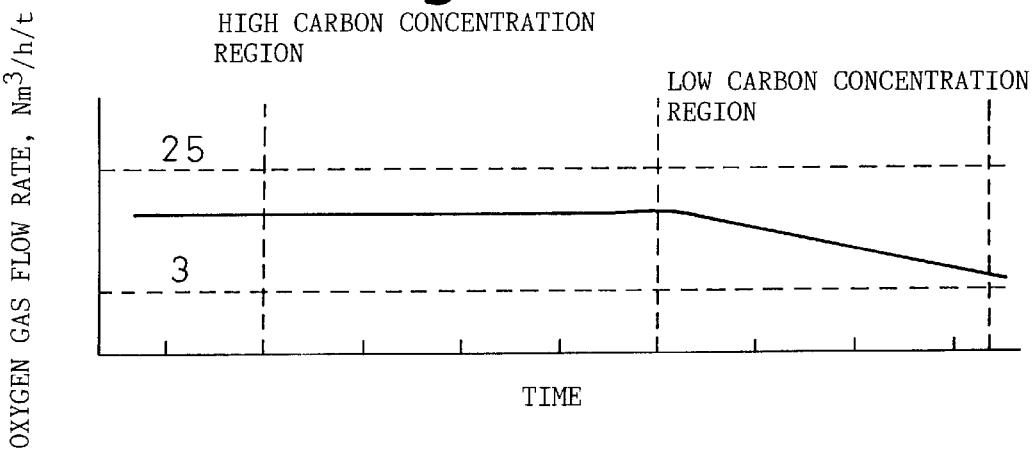
FIG. 11 is a typical diagram showing a change in flow rate of an oxygen gas over time during decarburization refining.
Figure 12:
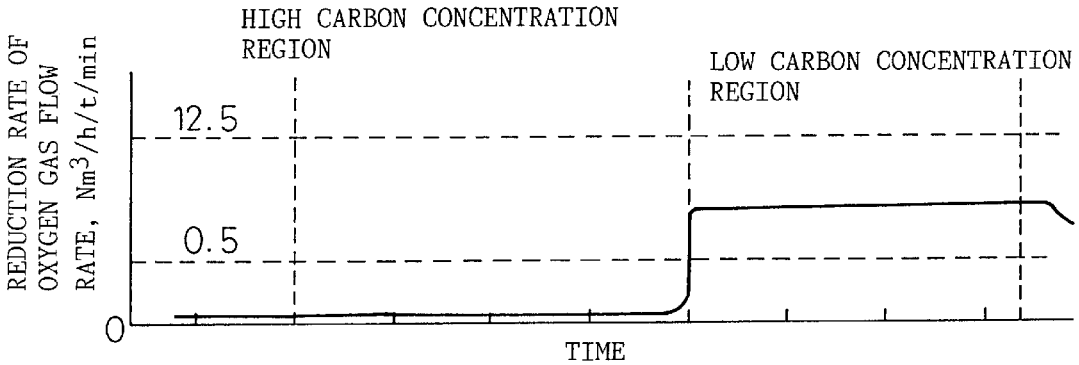
FIG. 12 is a typical diagram showing a change in reduction rate of the flow rate of an oxygen gas over time during decarburization refining.
Figure 13:
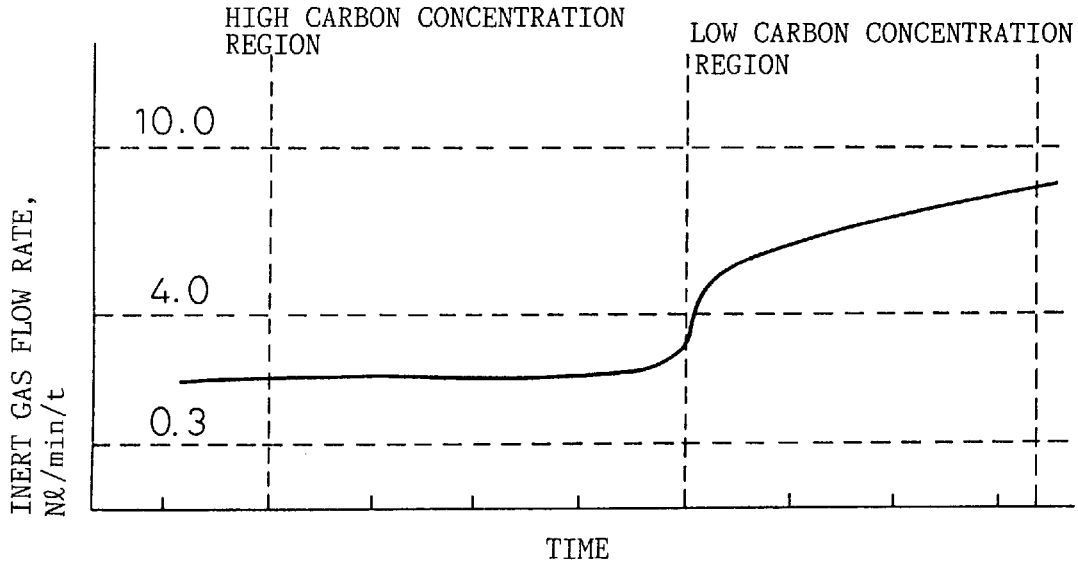
FIG. 13 is a typical diagram showing a change in flow rate of an inert gas over time during decarburization refining.
Figure 14:
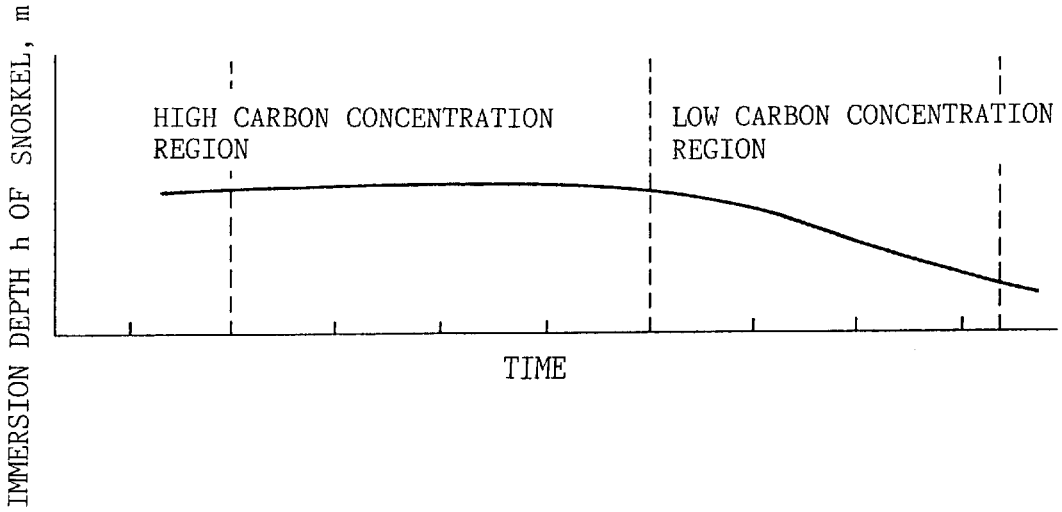
FIG. 14 is a typical diagram showing a change in immersion depth (h) of the snorkel over time during decarburization refining.

In the high carbon concentration region, the decarburization refining is carried out in such a manner that an oxygen gas flow rate control valve 20, an inert gas flow rate control valve 21, a lift drive 17, and an evacuating apparatus 16 are controlled to maintain the oxygen gas flow rate (Q) at 3 to 25 $Nm^3/h/t$, the inert gas flow rate (N) at 0.3 to 4.0 Nl/min/t, and the immersion ratio (h/H) at 0.1 to 0.6 as shown respectively in FIGS. 11, 13, and 10 through the operation of the controller 23 or by the operations of an operator while monitoring or estimating a change in the concentration of carbon in the molten steel 11 within the snorkel 14 in the vacuum tank.

Figure 16:
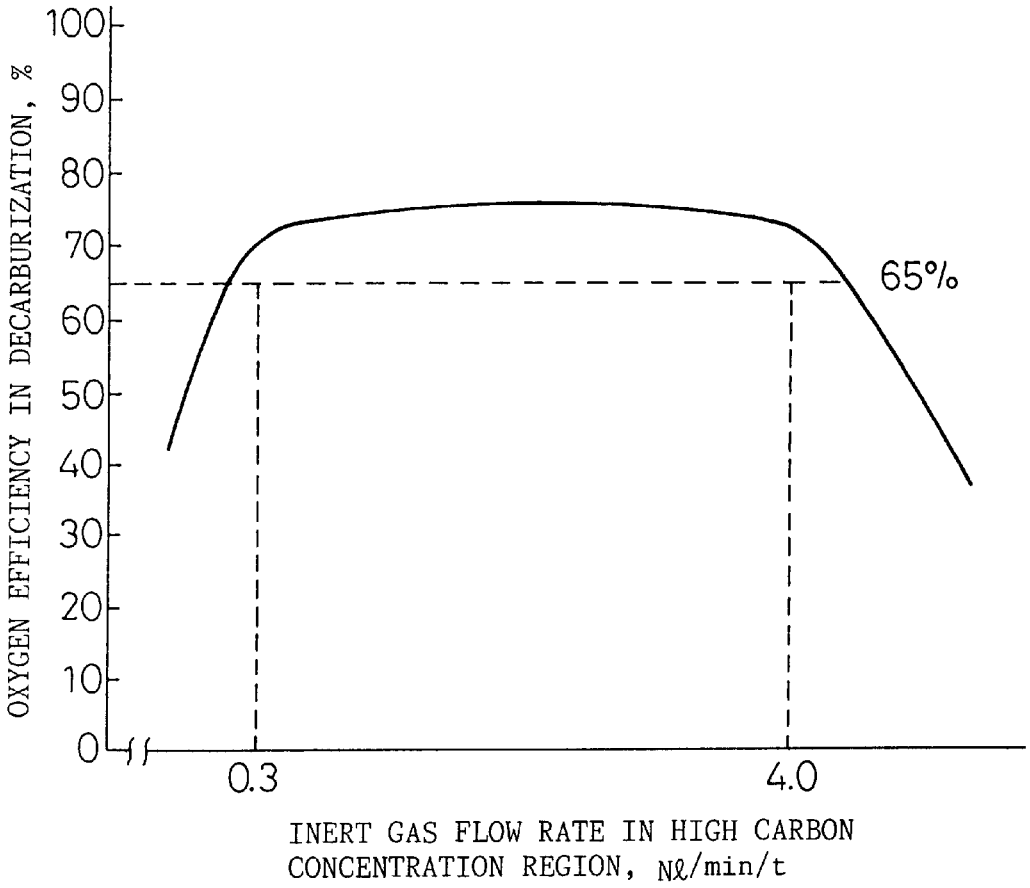
FIG. 16 is a diagram showing the relationship between the oxygen efficiency in decarburization and the flow rate of an inert gas in a high carbon concentration region.

In the subsequent low carbon concentration region, the decarburization refining is continued in such a manner that, as shown in FIGS. 10 to 14, the oxygen gas flow rate (Q) is reduced at a reduction rate (R) of 0.5 to 12.5 $Nm^3/h/t/min$ by regulating the oxygen gas flow rate control valve 20 and, in addition, as shown in FIG. 16, the immersion depth (h) of the snorkel in the molten steel 11 is reduced in a predetermined range by operating the lift drive 17.

The reduction rate of the oxygen gas flow rate (Q) is the magnitude of the slope of the oxygen gas flow rate (Q) over the time, that is, the derivative time of the oxygen gas flow rate (Q), and is expressed in $Nm^3/h/t/min$.

Thus, according to this embodiment, in the decarburization refining operation of chromium-containing molten steel 11, the oxygen gas flow rate (Q), the inert gas flow rate (N), the degree of vacuum (P) (regulation based on G value), the immersion ratio (h/H), the immersion depth (h) of the snorkel in the molten steel 11, the thickness of the slag having a regulated composition and the like are regulated to respective predetermined values, thereby simultaneously satisfying the following objects (i) to (iii).

(i) Prevention of splashing also in the high carbon concentration region while maintaining the oxygen efficiency in decarburization on a high level.

The object can be attained by maintaining the oxygen gas flow rate, the inert gas flow rate, the degree of vacuum, and the thickness of slag in respective proper ranges.

(ii) Prevention of chromium loss.

Chromium loss occurs because the chromium component, contained in the molten steel 11, oxidized on the molten steel surface within the snorkel 14 is discharged through the lower end of the snorkel 14 into the outside of the tank and floats between the wall of the snorkel 14 and the inner wall of the ladle 13. Therefore, maintaining the immersion depth, the inert gas flow rate, the oxidizing gas flow rate and the like balanced in a predetermined range permits the state of convection of the chromium component (chromium oxide) in the molten steel 11 within the snorkel 14 to be properly maintained. This causes chromium oxide to be efficiently reduced with carbon in the steel within the snorkel 14, preventing migration of the chromium component into the slag 12.

(iii) The fixation between the outer wall of the snorkel 14 and the inner wall of the ladle 13 through the slag 12 can be avoided.

Since the relative position of the snorkel 14 and the ladle 13 is varied in a predetermined range in the low carbon concentration region, the fixation through the slag 12 can be prevented.

The molten steel, which has been subjected to oxygen blowing decarburization in this way, is then degassed under a high degree of vacuum.

At the outset, degassing will be explained. For both common steel and stainless steel, in preparing high-purity steels, such as ultra low carbon steel, by the melt process, degassing under a high degree of vacuum should be carried out after oxygen blowing decarburization as the step of secondary refining. In this case, it is known that decarburization proceeds through a reaction of oxygen and carbon contained in the steel represented by the equation (4).

$$\underline{C}+\underline{O}\rightarrow CO \tag{4}$$

Therefore, maintaining the concentration of oxygen in the steel on a high level during degassing is effective in efficiently accelerating the decarburization reaction in the degassing period. In particular, in an early stage of the degassing, spontaneous evolution of a CO gas from the interior of the molten steel (internal decarburization) is known to be a major decarburization reaction site. Thus, maintaining the concentration of oxygen in the steel on a high level is useful particularly in an early stage of the degassing.

In this connection, it should be noted that, in the production of a high-purity stainless steel by the melt process, degassing is carried out after decarburization conducted by blowing oxygen gas in vacuo in the step of secondary refining. Therefore, it is important that satisfactory dissolved oxygen concentration be maintained by optimizing the carbon concentration and the degree of vacuum when decarburization conducted by blowing oxygen gas ends.

In the oxygen blowing decarburization refining under reduced pressure followed by ending the oxygen blowing (after a stop of the blowing) and degassing under a high degree of vacuum, preferably, the oxygen 5 blowing decarburization is carried out to [% C]=0.01 to 0.1%, the degree of vacuum within the tank during the stop of oxygen blowing is brought to 10 to 100 Torr, and the attained degree of vacuum in the subsequent degassing is brought to a high value of not less than 5 Torr. This enables degassing refining of a chromium steel, such as a stainless steel, to be effectively carried out. This method is based on the optimization of the concentration of oxygen in the steel specified by equilibrium condition of the partial pressure of CO ($P_{CO}$) represented by the carbon concentration and the degree of vacuum within the tank and makes it possible to maintain the degassing rate on a high level during degassing.

When the carbon concentration [% C] during the stop of oxygen blowing is less than 0.01%, the oxidation of chromium during oxygen blowing is significant due to a shortage of carbon, even though the degree of vacuum within the tank during the stop of oxygen blowing is in a proper range (that is, 10 to 100 Torr), posing a problem that the unit requirement of the reducing agent for the reduction treatment is increased. On the other hand, when the carbon concentration [% C] during the stop of oxygen blowing exceeds 0.1%, the degassing time should be prolonged, leading to a problem of productivity.

When the degree of vacuum within the tank is higher than 10 Torr, the solubility of carbon in the steel based on the equilibrium condition specified in this case is unsatisfactory, even though the carbon concentration during the stop of oxygen blowing is in the range of from 0.01 to 0.1%. The amount of oxygen to be consumed by the degassing reaction is insufficient, disadvantageously making it difficult to produce a high-purity steel by the melt process. On the other hand, when the degree of vacuum within the tank is lower than 100 Torr, chromium is excessively oxidized in the last stage of the oxygen blowing period.

The attained degree of vacuum at the time of degassing should be as high as not less than 5 Torr. When the degree of vacuum is low and less than 5 Torr, it is difficult to ensure a satisfactory driving force in the production of a high-purity steel by the melt process, disadvantageously resulting in lowered degassing rate.

In order to more efficiently carry out degassing, preferably, in addition to the above conditions, when the degree of vacuum in the course of evacuation at the time of the degassing reaches the range of from 5 to 30 Torr, oxygen is reblown (reblowing) in an amount of 0.3 to 5 $Nm^3$ per ton of the molten steel preferably for about 2 to 3 min, and, in addition, the flow rate of the gas for agitation during the degassing is regulated to the range of 2.5 to 8.5 Nl/min/t while bringing the amount of the slag 12-1 within the tank during the stop of oxygen blowing to not more than 1.2 tons/$m^2$ per unit sectional area of the steel bath portion in the vacuum tank.

Reblowing of oxygen is carried out from the viewpoint of increasing the concentration of oxygen in the steel in order to further accelerate the internal decarburization. At that time, the degree of vacuum is most preferably in the range of from 5 to 30 Torr. In this case, when the degree of vacuum is excessively high and exceeds 5 Torr, the dissolution of oxygen in the molten steel based on the equilibrium condition becomes difficult. On the other hand, when oxygen is reblown under a low degree of vacuum of less than 30 Torr, the blown oxygen is consumed by the oxidation of chromium rather than enrichment of oxygen in the molten steel.

Further, the amount of oxygen blown at that time is preferably in the range of from 0.3 to 5 $Nm^3$ per ton of the molten steel. When the amount of oxygen reblown is less than 0.3 $Nm^3$/t, oxygen to be consumed in the degassing is not satisfactorily enriched, even though the degree of vacuum within the tank at the time of reblowing is in the proper range. On the other hand, when oxygen is reblown in an amount exceeding 5 $Nm^3$/t, the oxygen enrichment effect is saturated. In this case, on the contrary, there is a fear of oxygen being consumed by the oxidation of chromium.

The reason why the flow rate of the gas for agitation is regulated in the range of 2.5 to 8.5 Nl/min/t is as follows. In the case of a gas flow rate of less than 2.5 Nl/min/t, the amount of circulated molten steel is unsatisfactory due to a shortage of agitating force, inhibiting the promotion of the internal decarburization, which disadvantageously lowers the degassing rate per se. On the other hand, when the gas flow rate exceeds 8.5 Nl/min/t, the circulation acceleration effect is saturated. On the contrary, an attack on the refractory by the gas is intensified, unfavorably resulting in damage to the refractory.

In addition, preferably, the amount of the slag within the tank during the stop of oxygen blowing is brought to not more than 1.2 tons/$m^2$ per unit sectional area of the steel bath portion in the vacuum tank. When the amount of the residual slag within the tank exceeds 1.2 tons/$m^2$ per unit sectional area of the steel bath portion in the vacuum tank, the contact between the molten steel surface to be a reaction site in the decarburization reaction and the high vacuum atmosphere is blocked, resulting in a remarkably lowered area of effective reaction interface. This makes it difficult to maintain the degassing rate on a high level.

In the production of a high-purity stainless steel having a carbon content of not more than 20 ppm by the melt process, decarburization on the molten steel surface as a major reaction site in the last stage of the degassing should be accelerated. To this end, it is important to ensure the activated surface (free surface area of the molten steel surface which is vigorously agitated by blown gas bubbles) and, at the same time, to maintain the renewal of the interface in the activated surface.

What is particularly important in ensuring the activated surface is to completely discharge chromium oxide and slag into the outside of the snorkel at the time of surface decarburization, because when chromium oxide or slag produced during the oxygen blowing decarburization is left even in a small amount on the activated surface, the surface decarburization is inhibited, leading to a lowering in decarburization rate.

For this reason, during the degassing period, an inert gas should be injected from the low portion of the ladle which is distant by Hv from the molten steel surface within the snorkel (molten still steel surface), imparting a predetermined agitation intensity K to the activated surface.

Figure 18:
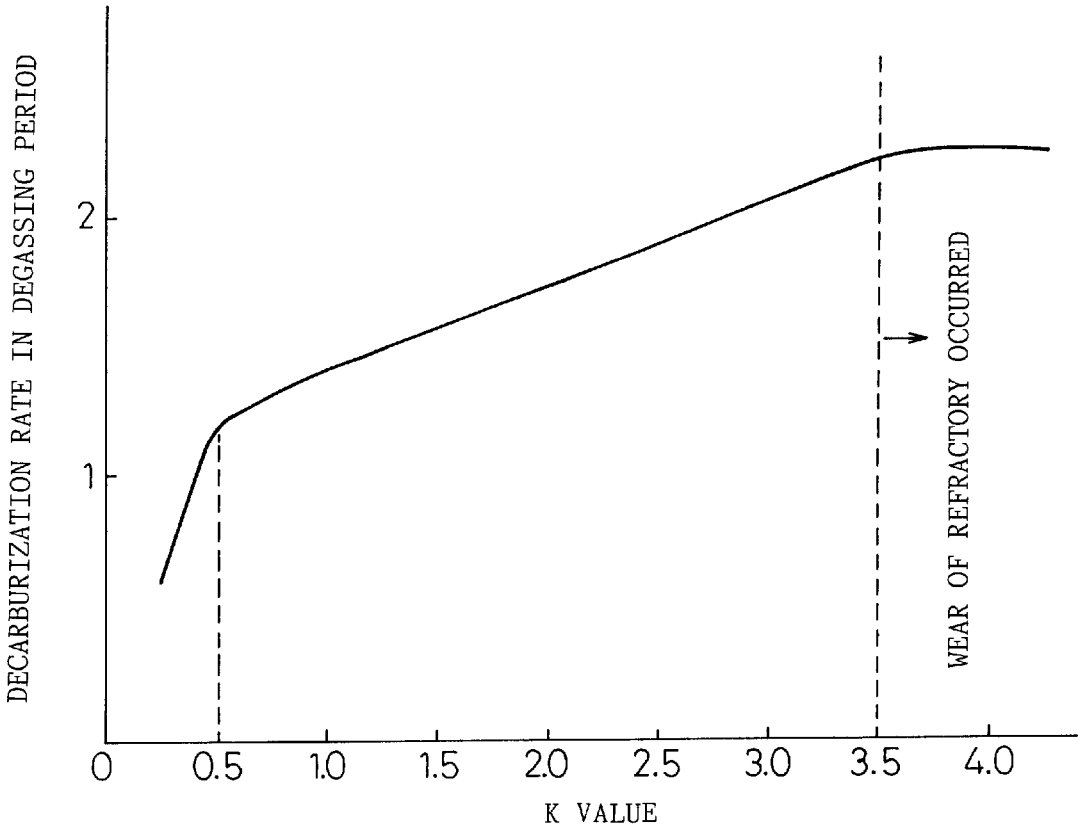
FIG. 18 is a diagram showing the relationship between K value and the decarburization rate in the decarburization period.

Accordingly, regarding conditions for maintaining the renewal of the interface in the activated surface and completely discharging chromium oxide into the outside of the snorkel, as shown in FIG. 18, regulation of the K value defined by the following equation in a range of from 0.5 to 3.5 is important:

$$K=\log\{S\cdot Hv\cdot Q/P\} \quad (5)$$

wherein P represents the degree of vacuum, Torr; S represents the gas bubble activated area, $m^2$; Q represents the flow rate of an inert gas blown, Nl/min/t; and Hv represents the distance from the molten steel surface within the snorkel to the position where the inert gas is blown, m.

In this case, when the K value is smaller than 0.5, the renewal of the gas bubble activated surface and the discharge of chromium oxide are unsatisfactory, resulting in a deteriorated decarburization rate. On the other hand, when the K value exceeds 3.5, the effect of renewal of the gas bubble activated surface is substantially saturated, posing problems such as loss of the refractory due to excessively high flow rate of the blown gas.

After the completion of the degassing, if necessary, aluminum for reduction is further introduced to reduce a metal oxide (for example, $Cr_2O_3$) produced during the oxygen blowing, followed by recovery of the metal.

For example, in the oxygen blowing decarburization refining of a stainless steel having a chromium content of not less than 5%, independently of whether the decarburization refining is carried out under the atmospheric pressure or in vacuo, the oxidation of chromium contained in the molten steel, that is, the production of $Cr_2O_3$, is unavoidable. In this case, after the end of oxygen blowing, a reducing agent should be added to recover the chromium component.

In general, silicon (a ferrosilicon alloy), which exhibits a low heating value in the reduction reaction, is in many cases used as a reducing agent after the oxygen blowing decarburization under the atmospheric pressure. After the oxygen decarburization in vacuo as finish refining, however, when the silicon content of the product is limited, aluminum should be used as the reducing agent.

When aluminum is used as the reducing agent, however, a thermit reaction represented by the following equation (6) occurs. This reaction involves the generation of a large amount of heat and necessarily results in a temperature rise in the molten steel.

$$Cr_2O_3+2\,Al\rightarrow 2\,Cr+Al_2O_3 \quad (6)$$

When the molten steel temperature is raised, the equilibrium carbon concentration in a reduction reaction with carbon contained in the molten steel represented by the following equation (7) is lowered, causing the reaction involving the evolution of a CO gas to simultaneously proceed:

$$Cr_2O_3+3\,C\rightarrow 2\,Cr+3CO\uparrow \quad (7)$$

In addition, the equilibrium carbon concentration in the equation (7) is greatly influenced by the equilibrium partial pressure of CO, that is, the degree of vacuum in operation.

The reaction represented by the equation (7) proceeds more significantly with an increase in the degree of vacuum.

When the violent reaction represented by the equation (7) takes place in a short time, a bumping reaction occurs wherein, with the ascent of the CO gas, the molten steel and the slag are scattered.

Therefore, in order to prevent the reaction involving rapid evolution of the CO gas, that is, bumping, it is important to inhibit the progress of the reaction represented by the equation (7), that is, to conduct the operation under a low degree of vacuum of a certain value or less.

When the operation of the reduction is carried out under a low degree of vacuum, however, the absorption of nitrogen in the molten steel (saturated solubility) is enhanced with an increase in the partial pressure of nitrogen ($P_{N2}$) within the tank, leading to an increase in the concentration of nitrogen in the molten steel. Therefore, this is unfavorable in the case of steel species wherein there is a limitation on the nitrogen content.

Thus, in the reduction under a low degree of vacuum, it is very important to simultaneously attain the prevention of bumping and the inhibition of pick-up of nitrogen.

In order to solve this problem, the present invention provides a technique that solid aluminum, immediately after the introduction of aluminum, is brought into contact with solid slag to allow the thermit reaction to proceed moderately to form molten slag which covers the molten steel to inhibit the pick-up of nitrogen.

Specifically, the flow rate of the argon gas for agitation during the introduction of aluminum for reduction is brought to the range of from 0.1 to 3 Nl/min/t, and the degree of vacuum is brought to a low value of not more than 400 Torr. Thereafter, the pressure is returned to the atmospheric pressure, and the tank is lifted. At the same time, the flow rate of the argon gas for agitation is brought to the range of from 5 to 10 Nl/min/t.

Maintaining the flow rate of the argon gas for agitation in the proper range during the introduction of aluminum for reduction and, at the same time, bringing the degree of vacuum to a low degree of vacuum of not more than 400 Torr permits the agitation force within the vacuum tank to be suitably maintained and can inhibit the suspension of the molten steel and the slag, inhibiting excessive progress of the thermit reaction represented by the equation (6), which can inhibit an extreme increase in the temperature of the molten steel. Suppression of the agitation during the introduction of aluminum for reduction can inhibit the dissolution of aluminum in the molten steel and permits a direct reaction of aluminum with the slag to improve the reduction rate of $Cr_2O_3$.

The reason for this is as follows. Previously forming slag in a semi-molten state by direct reduction with aluminum, rather than the dissolution of aluminum directly in the molten steel followed by a reduction reaction of the aluminum-containing molten steel with the solid slag, markedly improves the entanglement (emulsion) of the $Cr_2O_3$-containing slag in the molten steel, resulting in improved reduction efficiency. Further, melting of the slag in an early stage can offer a covering effect which prevents the contact between the molten steel surface and the air. Therefore, the above method is advantageous also from the viewpoint of the effect of preventing the pick-up of nitrogen.

In this connection, preferably, the flow rate of the argon gas for agitation in the aluminum introduction period is brought to the range of from 0.1 to 3 Nl/min/t. When the argon gas flow rate in this period exceeds 3 Nl/min/t, the thermit reaction represented by the equation (6) excessively proceeds and, at the same time, the emulsion of the slag and the metal is also intensified, making it difficult to prevent bumping. On the other hand, when the argon gas flow rate is less than 0.1 Nl/min/t, the introduced aluminum is deposited within the vacuum tank, often making it impossible to properly introduce aluminum, or otherwise creating the penetration of the molten steel into a porous plug provided at the bottom of the ladle. This raises an operation problem that, when the flow rate is increased in the subsequent stage, a desired flow rate cannot be ensured.

Further, when the degree of vacuum in the aluminum introduction period is high and exceeds 400 Torr, the agitating force becomes excessive. Specifically, the effective contact area between the slag and the metal is increased, and, in addition, the equilibrium partial pressure of CO, having a close relationship with the degree of vacuum at that time, is lowered. This shifts the reaction equilibrium in the equation (7) towards the right side, instantaneously causing significant acceleration of the reaction involving the evolution of the CO gas. This makes it difficult to prevent bumping.

After the completion of the introduction of aluminum, returning of the pressure to the atmospheric pressure followed by lifting of the vacuum tank and, at the same time, bringing the flow rate of the argon gas for agitation to the range of from 5 to 10 Nl/min/t can suppress the increase in the molten steel temperature and, in addition, can prevent the progress of the reduction in an early stage and the pick-up of nitrogen.

Lifting of the vacuum tank permits the reaction zone confined within the snorkel in the vacuum tank up to that point to be released into the whole interior of the ladle. Therefore, even though the thermit reaction takes place, an increase in the temperature of the molten steel is so small that the reaction represented by the equation (7) is less likely to take place. Consequently, the bumping can be avoided. Further, bringing the flow rate of the argon gas for agitation to 5 to 10 Nl/min/t after the lifting of the tank can allow the reduction reaction to proceed in an early stage and reduces the concentration of $Cr_2O_3$ in the slag to further accelerate the melting of the slag, enhancing the covering effect exerted by the slag. As a result, the pick-up of nitrogen can be prevented. When aluminum has been introduced under atmospheric pressure, the tank may be lifted in this state.

In this case, when the flow rate of the argon gas for agitation is less than 5 Nl/min/t, the reduction rate of $Cr_2O_3$ is lowered due to an unsatisfactory agitating force, leading to lowered productivity. On the other hand, when the argon gas flow rate exceeds 10 Nl/min/t, the effect of improving the reduction rate is substantially saturated. Further, in this case, the covering effect by the slag is reduced because the fluctuation of the molten steel surface is intensified due to the increased flow rate. This induces the pick-up of nitrogen, abnormal damage to refractories constituting the ladle, and other unfavorable phenomena.

Further, when a large amount of $Cr_2O_3$ is produced during the oxygen blowing due to any operation problem during the oxygen blowing decarburization and, in addition, $Cr_2O_3$ flows into the outside of the vacuum tank and is deposited and solidified on the upper part of the wall of the ladle, introduction of aluminum into the molten steel is quite unsatisfactory for completely reducing and recovering in a short time $Cr_2O_3$ that has been deposited and solidified on the upper part of the wall of the ladle. This is because, in the gas bubbling from the low portion of the ladle, although the rising of the molten steel around the center of the ladle is satisfactory, the rising of the molten steel around the wall of the ladle is unsatisfactory, resulting in reduced opportunity for the contact of the molten steel with the $Cr_2O_3$-containing slag.

A preferred method for solving this problem is that, immediately after degassing, the pressure is returned to the atmospheric pressure, the vacuum tank is lifted, and aluminum is then introduced. Direct contact of aluminum, for reduction, with the slag deposited onto the upper part of the wall of the ladle improves the reduction efficiency of $Cr_2O_3$.

Further, as described above, when a large amount of $Cr_2O_3$ is produced during the oxygen blowing, the amount of slag within the vacuum tank inevitably becomes large. In this case, the slag on the upper part of the ladle after the lifting of the vacuum tank heaps into a mound. Therefore, when aluminum is added from the top of the ladle, the added aluminum inevitably advances toward the foot of the mound, permitting aluminum to come into contact with the $Cr_2O_3$-containing slag around the wall in the upper part of the ladle. As a result, the reduction of $Cr_2O_3$ proceeds, although the reduction reaction takes place between solid phases. Fluctuation of the molten steel by gas additing from the low portion of the ladle permits the contact of the slag with the high-temperature molten steel to be added, accelerating the melting of the slag. This further enhances the reduction efficiency of $Cr_2O_3$.

The present invention will be described in more detail with reference to the accompanying drawings.

Figure 19A:
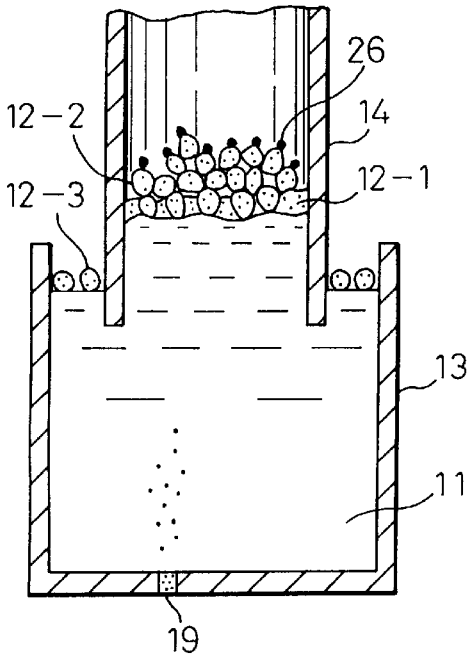
FIGS. 19(A) and (B) are diagrams showing the step of reduction treatment in finishing of a stainless steel according to one embodiment of the present invention (where neither deposition nor solidification of slag onto the upper part of the wall of the ladle occurs)
Figure 21:
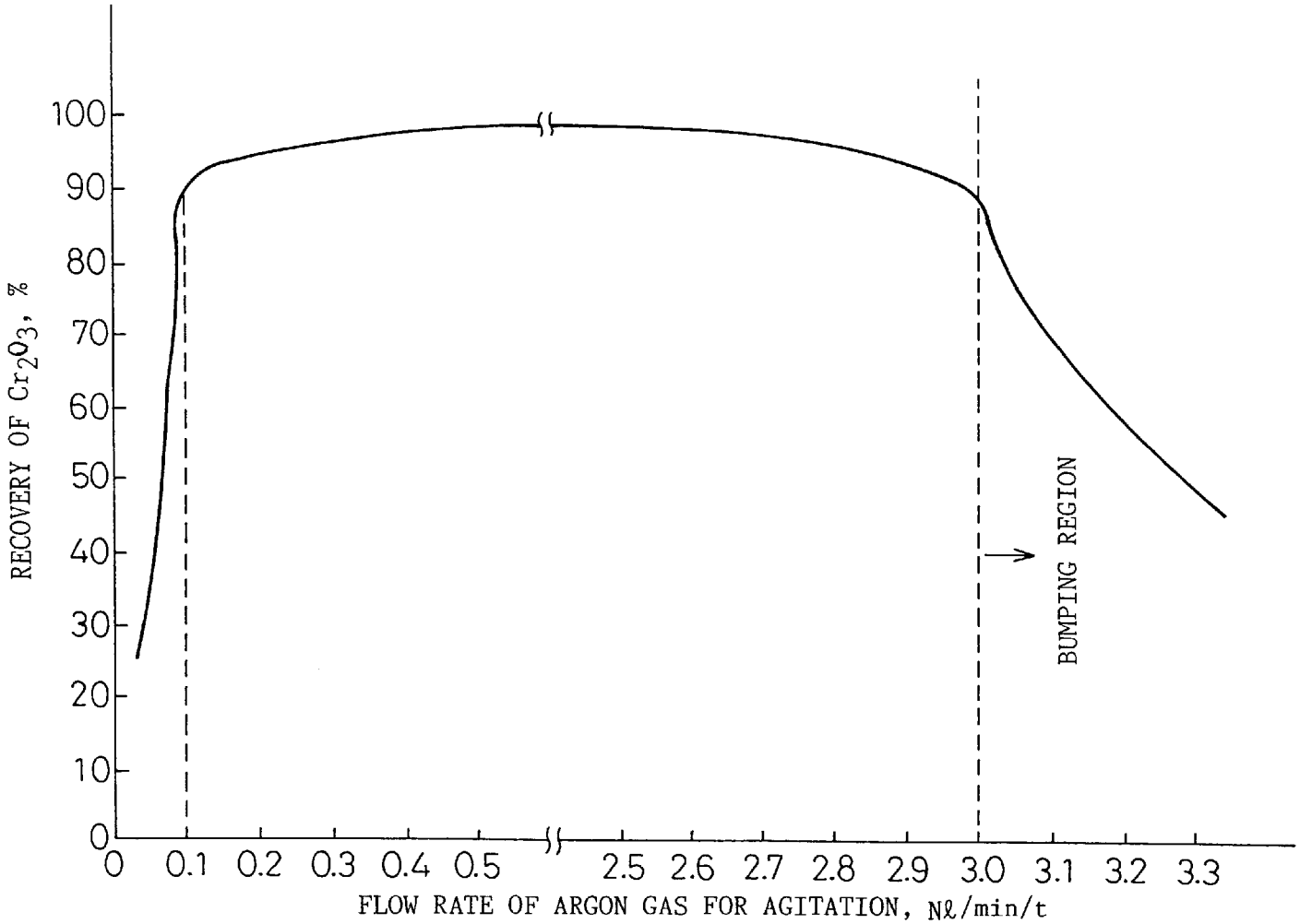
FIG. 21 is a diagram showing the relationship between the flow rate of an argon gas for agitation during the reducing aluminum introduction period and the recovery of chromium oxide.

As shown in FIG. 19(A), a snorkel 14 of a straight-barrel type vacuum tank is submerged in a molten steel 11 having a chromium concentration of not less than 5% contained in a ladle 13. The interior of the snorkel 14 is evacuated. In addition, an argon gas as an inert gas for agitation is fed through a porous plug 19 provided at the bottom of the ladle 13 into the molten steel while blowing an oxygen gas onto the molten steel from above the molten steel within the vacuum tank, thereby carrying out oxygen blowing decarburization refining in vacuo. After the oxygen blowing is stopped, degassing is carried out under a high degree of vacuum. Thereafter, aluminum 26 for reduction is introduced from above solid slag 12-2 to cause the reaction represented by the equation (6), thereby reducing and recovering chromium oxide ($Cr_2O_3$) produced during the oxygen blowing. In this case, the flow rate of the argon gas for agitation during the introduction of aluminum for reduction is regulated in the range of 0.1 to 3 Nl/min/t, and, in addition, the degree of vacuum is brought to a low degree of vacuum of not more than 400 Torr. As shown in FIG. 21, this improves the recovery of chromium oxide ($Cr_2O_3$).

Figure 19B:
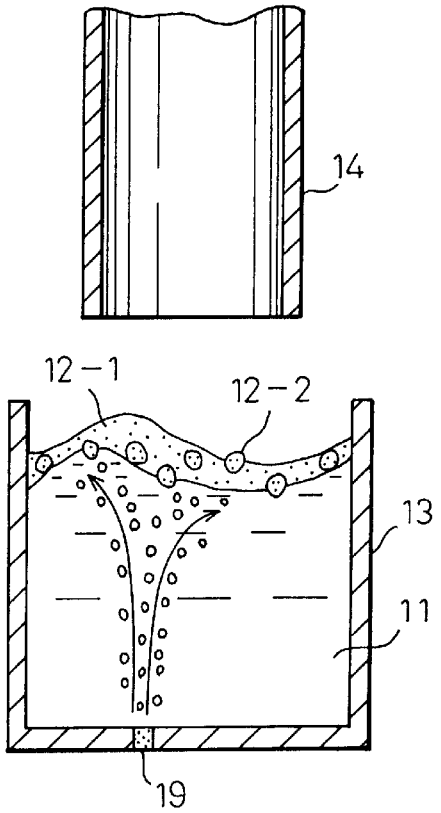

Thereafter, as shown in FIG. 19(B), the pressure of the interior of the snorkel 14 is returned to the atmospheric pressure, and the snorkel 14 is pulled up. At the same time, the flow rate of the argon gas for agitation is increased to the range of from 5 to 10 Nl/min/t. In FIG. 19(A), numeral 12-1 designates melted slag, and numeral 12-3 solid slag present outside the vacuum tank.

Next, another embodiment of the present invention will be described with reference to FIGS. 20(A) to (C).

Figures 20A, 20B, 20C:
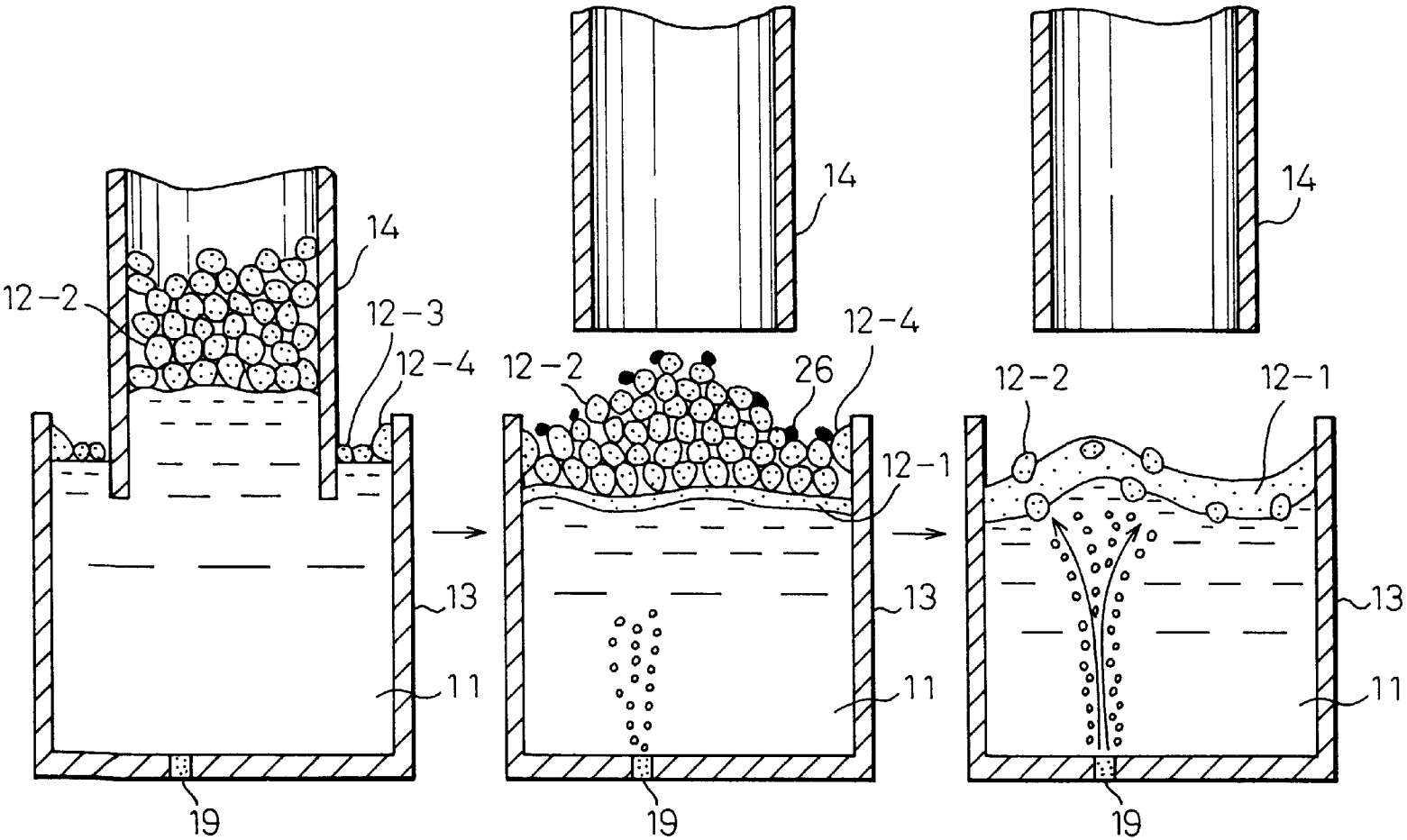
FIGS. 20(A), (B), and (C) are diagrams showing the step of reduction treatment in finishing of a stainless steel according to another embodiment of the present invention (where deposition and solidification of slag onto the upper part of the wall of the ladle occur)

Immediately after the oxygen blowing decarburization refining and the degassing in the same manner as described above, the pressure within the snorkel 14 is returned to the atmospheric pressure (FIG. 20(A)), and, in addition, as shown in FIG. 20(B), the snorkel 14 is pulled up. At the same time, aluminum 26 for reduction is simultaneously introduced. The flow rate of the argon gas for agitation is regulated in the range of from 0.1 to 3 Nl/min/t during the introduction of aluminum for reduction.

Slag 12-4 deposited on the upper part of the ladle comes into contact with the aluminum 26 for reduction, permitting the reduction to proceed.

Figure 22:
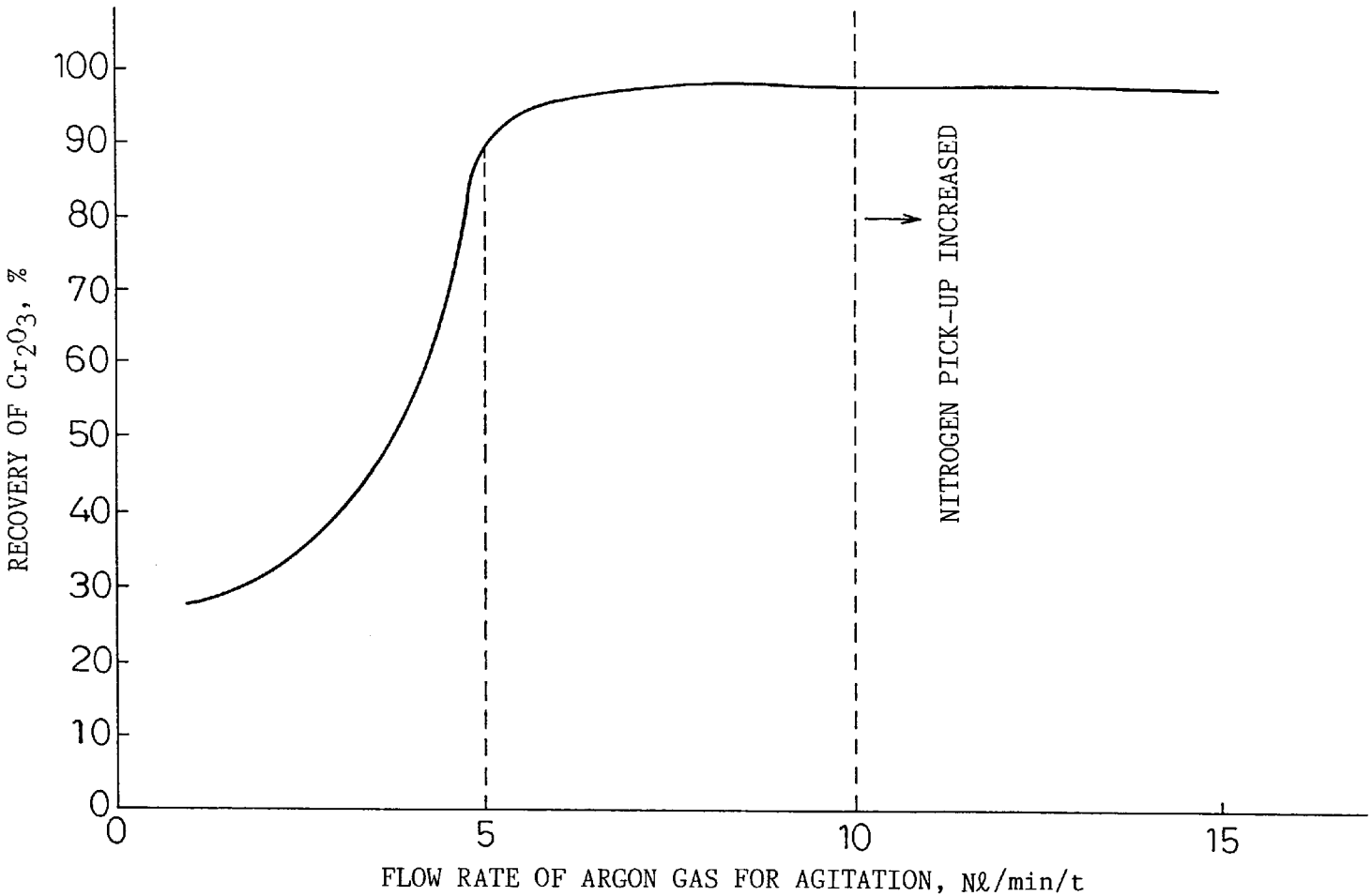
FIG. 22 is a diagram showing the relationship between the flow rate of an argon gas for agitation after the reducing aluminum introduction period and the recovery of chromium oxide.

Subsequently, the flow rate of the argon gas for agitation is increased to the range of from 5 to 10 Nl/min/t to fluctuate the molten steel as shown in FIG. 20(C), thereby promoting the contact of the solid or deposited slag with the high-temperature molten steel. This melts the slag and allows the reduction of the slag with aluminum to proceed. The relationship between the recovery of $Cr_2O_3$ and the flow rate of the argon gas for agitation in this embodiment is shown in FIG. 22. As can be seen from this drawing, when the flow rate of the argon gas for agitation is 5 to 10 Nl/min/t, the recovery of $Cr_2O_3$ can be improved and, in addition, an increase in pick-up of nitrogen can be prevented.

As described above, in vacuum decarburization refining using a vacuum tank provided with a one-legged, straight-barrel type snorkel, a snorkel in a lower tank of the vacuum tank is submerged in the molten steel within the ladle. In this case, for example, the fluidity of the molten steel, such as molten stainless steel, is large, and high-temperature refining, such as oxygen blowing decarburization, is carried out. This causes refractories constituting the snorkel to undergo melt loss due to the flow of the molten stainless steel created by oxygen blowing or agitation, or otherwise causes the refractories to be worn by spalling or the like due to a rapid temperature change involved in the transfer from the refining period to the standing period.

The wear of the refractories constituting the snorkel leads to a lowering in rate of operation of the vacuum refining apparatus, and the lowered throughput capacity in the vacuum refining makes it impossible to treat the object steel species. As a result, the production of high grade steels per se becomes difficult.

On the other hand, the wear of the snorkel used in the vacuum refining in an early stage leads to increased cost of refractories constituting the snorkel, and a lot of time and labor are required in the replacement of the vacuum tank and the snorkel.

According to the present invention, the above problem has been solved by immersing the snorkel, after the completion of the refining, in slag having a regulated composition to coat the slag onto the surface of the snorkel.

Specifically, the slag after the completion of the refining under reduced pressure is regulated so as to comprise 55 to 90% by weight in total of $Al_2O_3$ and CaO, 1 to 10% by weight of $Cr_2O_3$, and 7 to 25% by weight of $SiO_2$ with the balance consisting of 2 to 10% by weight of at least one member selected from FeO, $Fe_2O_3$, and MgO.

In the above composition of the slag, when the total amount of $Al_2O_3$ and CaO is less than 55% by weight, the slag coating on the snorkel has poor corrosion resistance and, in this case, the effect of protecting the snorkel cannot be attained by the slag coating. On the other hand, when the total amount of $Al_2O_3$ and CaO exceeds 90% by weight, the melting point of the slag becomes high and slagging is poor. This makes it difficult to coat the slag onto the snorkel and is an obstacle to the reduction of the chromium oxide in the reduction refining as the previous step.

When the $Cr_2O_3$ content is less than 1% by weight, the anticorrosion effect derived from the formation of a highly viscous material upon reaction with slag or the like is lowered. On the other hand, when the $Cr_2O_3$ content exceeds 10% by weight, slagging is poor, making it difficult to coat the slag onto the snorkel.

When the content of $SiO_2$ in the slag composition formed upon completion of the reduction refining is less than 7% by weight, the slag has lowered viscosity and higher melting point. In this case, as with the case of increased total amount of $Al_2O_3$ and CaO, the slagging is poor, and coating becomes difficult.

When the $SiO_2$ content exceeds 25% by weight, the melting point of the slag is significantly lowered, making it impossible to form a satisfactory coating protective layer.

In the slag composition, FeO, $Fe_2O_3$, and MgO as the balance are produced in the refining under reduced pressure and included in the previous step, and the slag contains 2 to 10% by weight of at least one member selected from FeO, $Fe_2O_3$, and MgO. When the amount of FeO, $Fe_2O_3$, and MgO is increased, the corrosion resistance of the slag is lowered due to a lowering in melting point. In particular, when the amount of MgO is less than 2% by weight, the melt loss of refractories constituting the snorkel is significant, while when the amount exceeds 10% by weight, MgO should be additionally added.

In the composition of slag 12, which has been finally formed through the above steps, $SiO_2$ comprises a slag component (the content of $SiO_2$ in the slag included: 30% by weight) included at the time of tapping of the molten steel 11 from a decarburization refining furnace (not shown), such as a converter, into the ladle 13, and Si (0.03 to 0.20% by weight) contained in the molten steel 11 before the decarburization refining under reduced pressure.

The $SiO_2$ content can be previously determined by analysis. The whole amount of Si in the molten steel 11 is expressed in terms of $SiO_2$, and the total of both the $SiO_2$ contents is regarded as the $SiO_2$ content.

The SiO2 content in terms of the total of both the above contents is regulated in the range of from 7 to 25% by weight by regulating any one of or both the amount of the inflow slag and the amount of silicon added to the molten steel 11.

The amount of CaO to be added in the degassing refining is determined from the amount of chromium oxide and the like to be reduced in the reduction refining by the following method.

At the outset, the amount of chromium oxide produced is predicted from the above-described decarburization refining conditions, that is, the amount of blown oxygen and the attained final carbon concentration. Alternatively, a method may be used wherein the molten steel or slag is analyzed, and the amount of metallic aluminum to be added for reducing the amount of the produced chromium oxide and, in addition, the amount of $Al_2O_3$ produced are determined according to the equation (8):

$$Cr_2O_3+2\ Al \rightarrow Al_2O_3+2\ Cr \quad (8)$$

The amount of CaO is determined from the amount of $Al_2O_3$, and regulation is carried out so that the total amount of CaO and $Al_2O_3$ is 55 to 90% by weight. The regulation of CaO and $Al_2O_3$ may be made by varying the amount of both or any one of CaO and $Al_2O_3$ added.

The amount of $Cr_2O_3$ is determined by the amount of metallic aluminum added in the reduction refining, and decreases with increasing the amount of the metallic aluminum added. Therefore, the amount of $Cr_2O_3$ is regulated in the range of from 1 to 10% by weight.

In the composition constituting the slag 12, FeO, $Fe_2O_3$, and MgO as the balance are produced in the refining under reduced pressure and included in the previous step. The amount of slag included, the amount of metallic aluminum added in the reduction refining and the like are regulated so that the slag contains 2 to 10% by weight of at least one member selected from FeO, $Fe_2O_3$, and MgO.

The $Al_2O_3$/CaO ratio in the slag is brought to the range of from 0.25 to 3.0.

In the slag, after the refining under reduced pressure, wherein the total content of $Al_2O_3$ and CaO is in the range of from 55 to 90% by weight, when the $Al_2O_3$/CaO ratio is less than 0.25, phase transformation occurs upon cooling of the slag, causing the slag to crumble and disintegrate, which results in separation of the slag coating.

On the other hand, when the $Al_2O_3$/CaO ratio exceeds 3.0, slagging is poor, rendering coating of the snorkel with the slag difficult.

Figure 23:
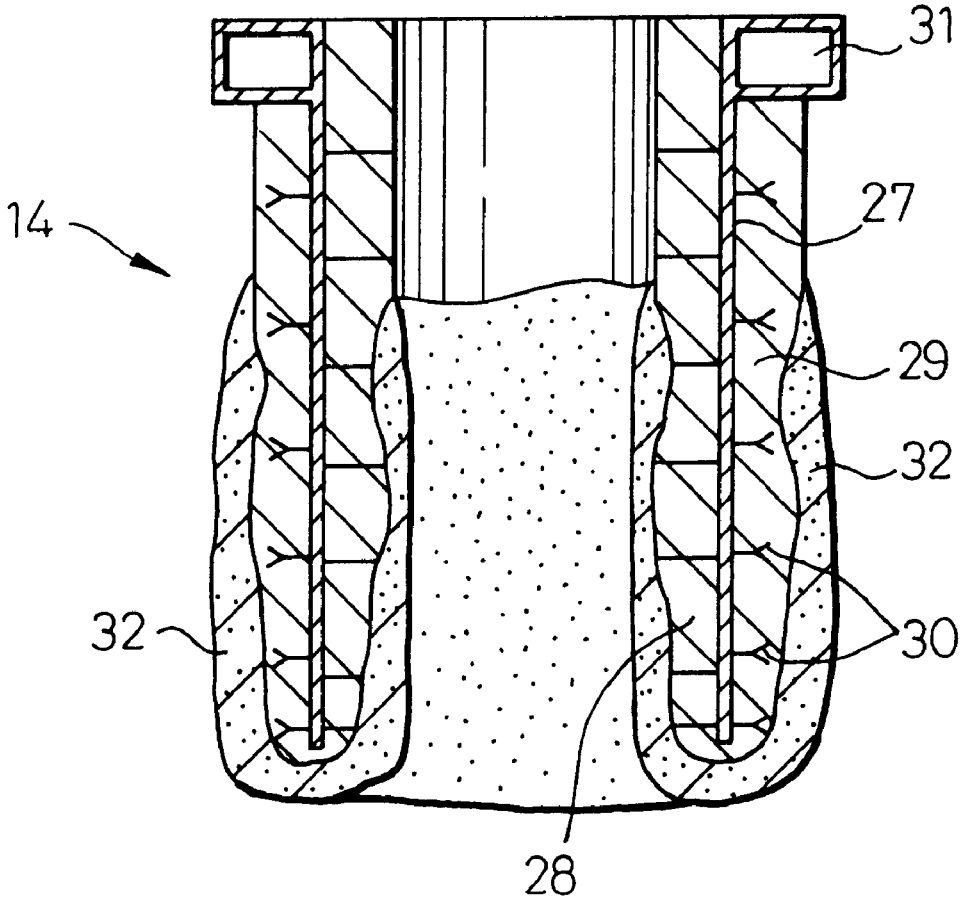
FIG. 23 is a partially sectional view of a snorkel, for a vacuum tank, coated with slag.

Coating of the slag 12 regulated in each refining onto the snorkel 14 will be described with reference to FIG. 23 showing the structure of the snorkel 14.

Regulated slag 12 after each refining and refining under reduced pressure is melted at a temperature of 1650 to 1750° C.

Regarding the snorkel 14 which is submerged in the slag 12 and the molten steel 11, upon the completion of the refining under reduced pressure, the pressure of the interior of the vacuum tank 15 and the snorkel 14 are returned to the atmospheric pressure. The snorkel 14, the pressure of which has been returned to the atmospheric pressure, is lifted above the slag 12 and then stands by. At the point of time immediately after lifting of the snorkel, both the temperature of chromia-magnesia bricks 28 constituting the inside of the snorkel 14 and the temperature of high alumina, prepared unshaped refractories 29 constituting the outside of the snorkel 14 are substantially the same as the temperature of the slag 12, that is, 1650 to 1750° C. The temperature is lowered to 1200 to 1300° C. by the standing-by of the snorkel 14 in the lifted state for about 0.5 to 1 min. Next, the snorkel is submerged in the slag 12 layer by 270 to 530 mm from the front end of the snorkel 14, and, immediately after that, the snorkel 14 is slowly lifted to form a 30 mm-thick coating 32.

After the formation of the coating 32, the snorkel 14 is further allowed to stand by for additional 5 min. When the temperature of the surface of the coating 32 has reached about 800° C., the snorkel 14 is submerged in the molten steel 11 within the next ladle 13, followed by the next refining under reduced pressure. Thereafter, the formation of the coating 32 on the snorkel 14 and the refining under reduced pressure are repeatedly carried out.

After the formation of a 30 mm-thick coating, the snorkel may be again submerged in the slag 12 and allowed to stand by, thereby forming a 60 mm-thick coating.

The coating 32 formed by double coating procedure has the effect of preventing both breaking and melt loss of refractories derived from spalling created by a rapid temperature change from 1750° C. to the atmospheric temperature, or from 800° C. to the temperature of the molten steel 11 around 1750° C. at the time of immersion of the snorkel in the molten steel.

The bricks 28, 29 constituting the snorkel 14 are held by a core metal 27 provided with a flange 31, and the prepared unshaped refractory brick 29 is held by a stud 30.

Next, an apparatus which is most preferred in practicing the above-described vacuum degassing refining method will be described.

While the method according to the present invention can prevent splashing per se created during decarburization refining, the apparatus of the present invention is characterized by means that, when dust and the like are created, can trap and melt the dust in the vacuum tank and, also when a dust-containing gas is introduced into an evacuation duct, can inhibit the deposition and accumulation of the dust, and, in addition, can prevent damage to refractories constituting the lower tank in the vacuum tank caused by heat of radiation from the molten steel (mainly from a hot spot) during the vacuum refining.

A vacuum decarburization refining apparatus according to one embodiment of the present invention will be described.

Figure 24:
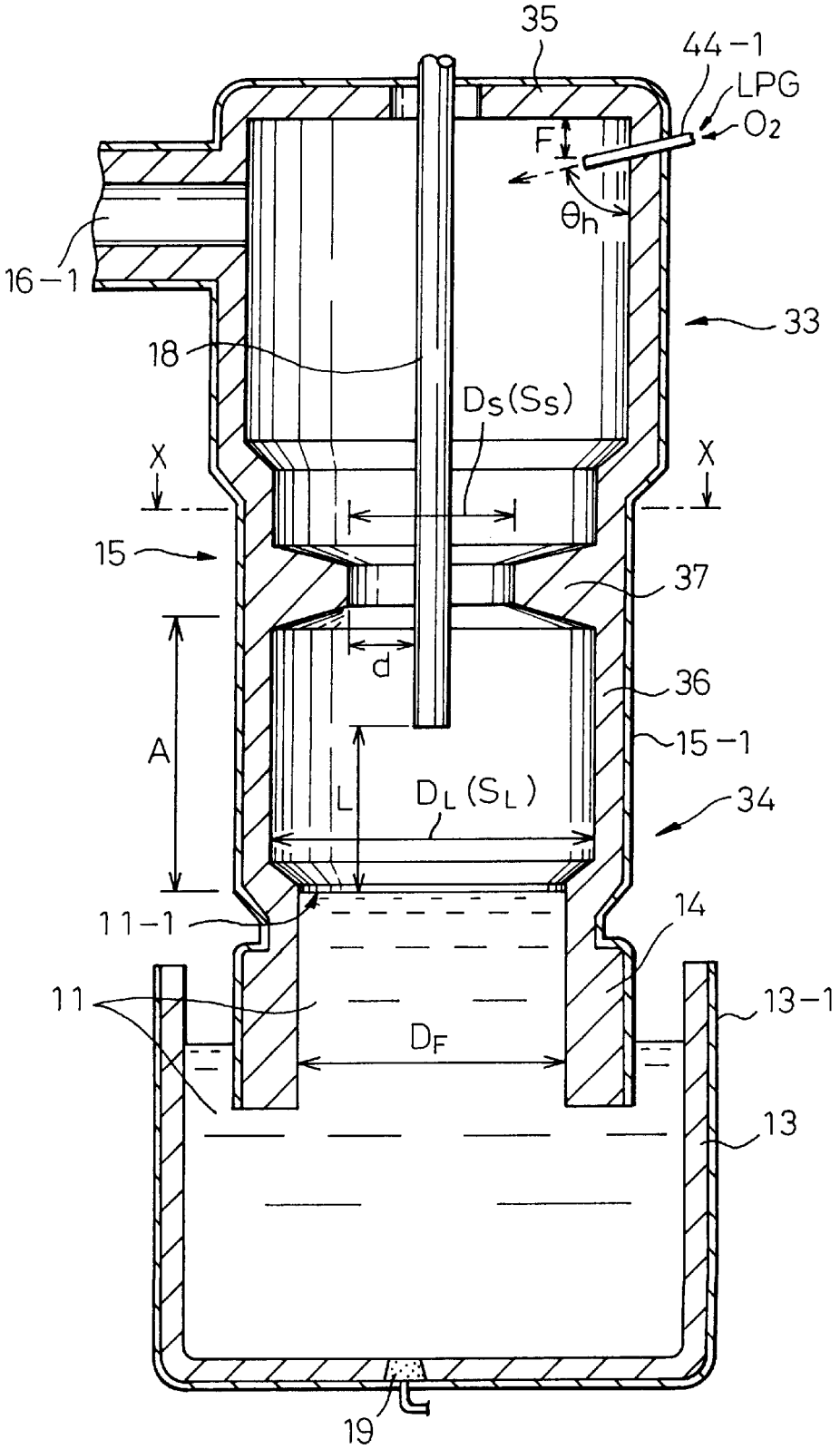
FIG. 24 is a sectional side view of a vacuum decarburization refining apparatus according to one embodiment of the present invention.
Figure 25:
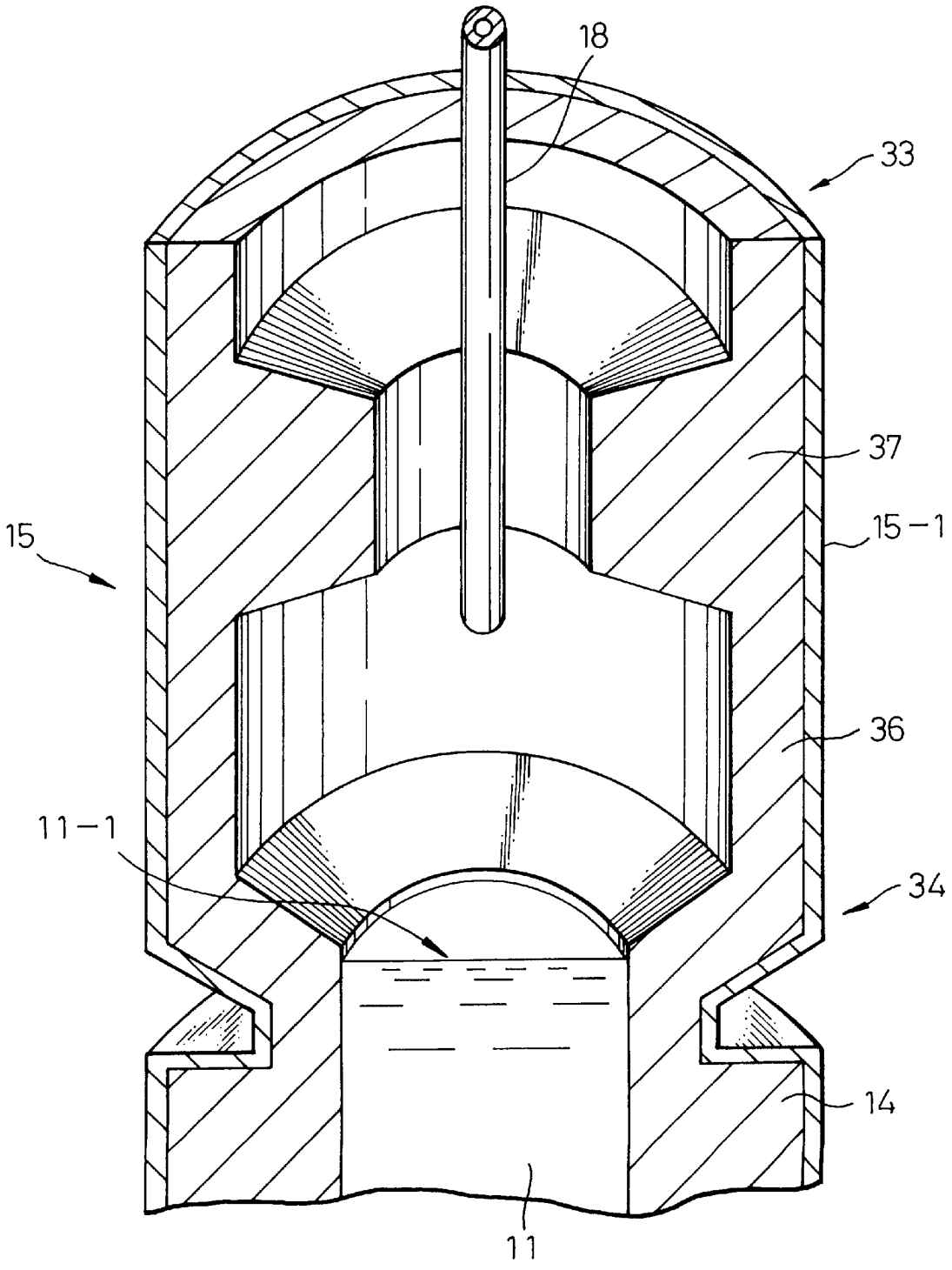
FIG. 25 is a partially sectional perspective view of the vacuum decarburization refining apparatus shown in FIG. 24.
Figure 26:
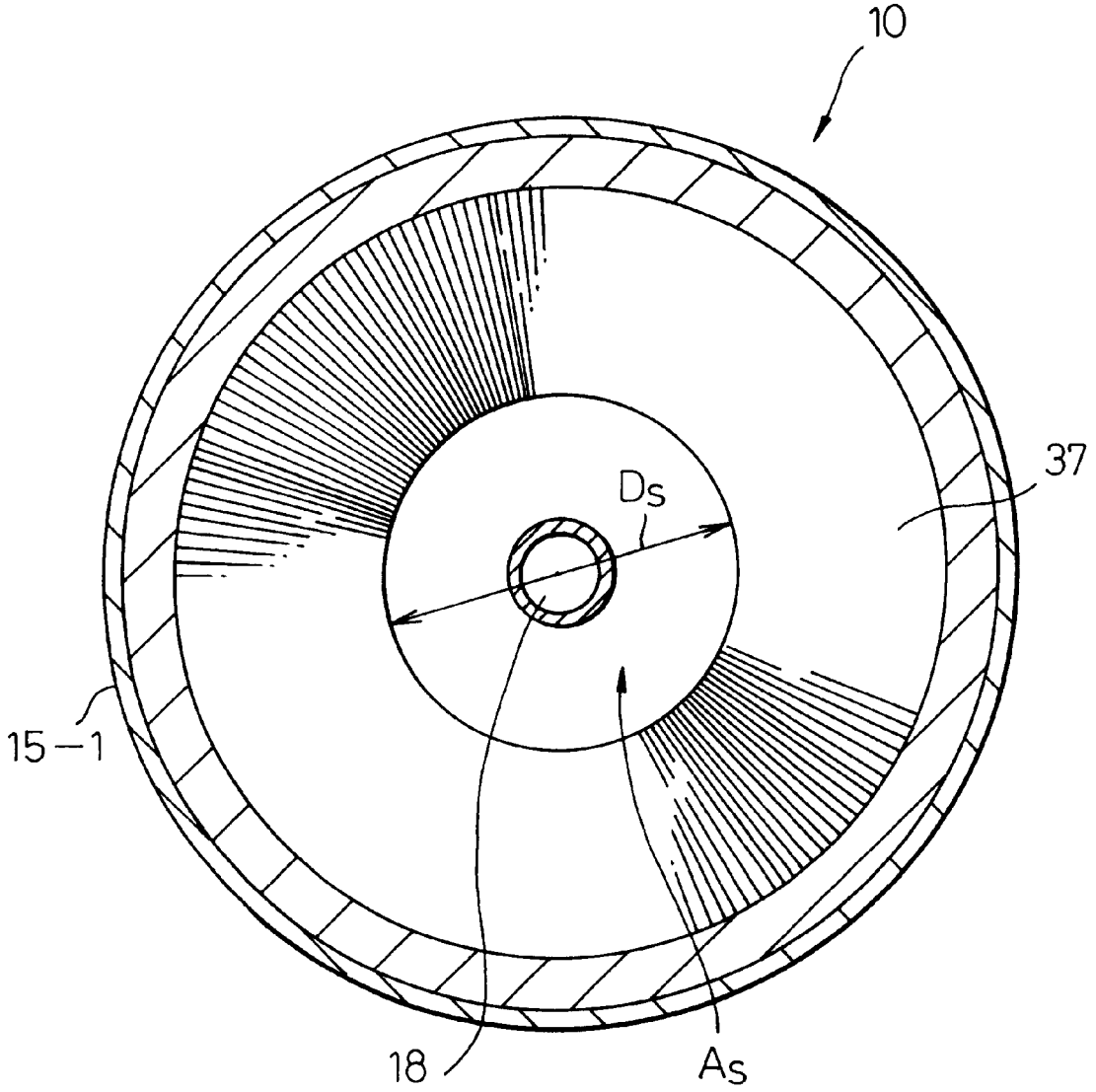
FIG. 26 is a cross-sectional view taken on line X—X of FIG. 24.

As shown in FIGS. 24 to 26, a vacuum decarburization refining apparatus 10 comprises: a ladle 13 that is provided, at the bottom thereof, with an inert gas blowing nozzle 19 and contains a molten steel 11; a vacuum tank 15 provided with a snorkel 14, submerged in the molten steel 11 within the ladle 13, and an evacuation hole 16-1 connected to an evacuation apparatus (not shown); and an oxygen lance 18 that is liftably provided in a canopy 35 of the vacuum tank 15.

The above elements constituting the vacuum decarburization refining apparatus will be described in more detail.

The ladle 13 is a substantially cylindrical iron container, and the inner wall in contact with the molten steel 11 is lined with a refractory, for example, an alumina-silica or alumina-zircon refractory.

The molten steel 11 within the ladle 13 is agitated by an ascending, and the kinetic energy of, an inert gas blowing into the molten steel 11 through a gas blown nozzle 19 provided in the ladle 13, thereby enhancing the vacuum refining reaction in the molten steel 11.

The vacuum tank 15 is a container for vacuum refining that is mainly lined with a refractory brick such as a magnesia-chromia brick (a part of the container may be constituted by a prepared unshaped refractory). The vacuum tank 15 comprises an upper tank 33 and a lower tank 34, the lower end of the lower tank serves as a snorkel 14 and is submerged in the molten steel.

When the vacuum tank is evacuated, the molten steel ascends through the snorkel, permitting a molten steel surface 11-1 different from the molten steel surface within the ladle 13 to be formed within the snorkel. An oxygen gas is blown against the surface through the lance.

In the present invention, the snorkel refers to a lower end portion of the vacuum tank which is located below the position, of the vacuum tank, where the uppermost surface of the sucked molten steel is in contact with the vacuum tank.

The snorkel 14 is in a substantially cylindrical form having an inner diameter $D_F$, and the snorkel 14, particularly in its portion which is submerged in the molten steel 11 and through which the molten steel ascends, is coated with a prepared unshaped refractory, for example, an alumina-silica, by casting. When a splash is scattered from the surface of the molten steel within the snorkel 14 in the same density, the amount of the splash decreases with reducing the sectional area of the snorkel. Therefore, the inner diameter of the snorkel is minimized while taking into consideration the decarburization efficiency.

The present invention is characterized by providing a larger-diameter section 36, having an inner diameter $D_L$ larger than the inner diameter $D_F$ of the snorkel and having a length A in the vertical direction, in the lower tank 34 continued to the snorkel 14. The larger-diameter section serves to disperse a splash created by an oxygen jet gas blown through the oxygen lance 18 against the molten steel surface 11-1 and, at the same time, to reduce the thermal influence of a hot spot created by the oxygen jet gas or heat of radiation from the molten steel surface 11-1 on the side wall section of the vacuum tank, and is a constituent element important to the vacuum tank of the present invention.

The inner diameter $D_L$ of the larger-diameter section is specified, in relation with the position of a gas blown hole of the oxygen lance 18, so that the ratio of the inner diameter $D_L$ to the oxygen gas blowing distance L (distance between the lower end of the oxygen lance and the molten steel surface 11-1), $D_L/L$, is in the range of from 0.5 to 1.2. This offers the above effect.

Further, a smaller-diameter section (a diameter-reduced section) 37 having an inner diameter Ds is provided, at a position a vertical length A from the lower end of the larger-diameter section 36, connected to the larger-diameter section 36. The smaller-diameter section 37 functions to inhibit the introduction of splash or dust into the upper tank in the vacuum tank, and melts dust and the like, deposited on the bottom face thereof, by heat of radiation from the molten steel surface to remove the dust and the like from the smaller-diameter section. For this reason, in order that the smaller-diameter section 37 attains the above effect, the relationship between the inner diameter Ds of the smaller-diameter section and the inner diameter $D_L$ of the larger-diameter section, that is, the relationship between the sectional area Ss of the space As of the smaller-diameter section and the sectional area $S_L$ of the space $A_L$ of the larger-diameter section, is important. According to the present invention, the ratio $S_S/S_L$ is specified to the range of from 0.5 to 0.9. Further, the smaller-diameter section is provided at a position against which a stream of the oxygen gas blown through the lance does not directly impact and where melt loss of the refractory derived from the heat of radiation from the hot spot and the molten steel surface does not occur and only the dust deposited onto the refractory can be remelted (for example, at a position where the surface temperature of the refractory constituting the smaller-diameter section is 1200 to 1700° C.). In this case, the length A is specified to be 1 to 3 m.

The difference between the inner diameter $D_s$ of the smaller-diameter section and the outer diameter of the oxygen lance 18 in the radial direction is preferably small. When the difference is excessively small, the exhaust gas passage becomes so narrow that the decarburization efficiency lowers. Therefore, the difference d is preferably in the range of from 100 to 300 mm.

Specifically, in the decarburization refining in vacuo, like the present invention, the melt loss of the refractory in the side wall section of the vacuum tank (freeboard section) not directly submerged in the molten steel 11 is governed by the surface temperature of the refractory, the temperature of the atmosphere gas, and the flow rate of a gas that collides with the working face of the refractory.

Therefore, in order to prolong the service life of the refractory in the freeboard section, it is important to maximize the distance of the refractory from a high-temperature hot spot created by oxygen blowing and a decarburization reaction and to reduce the flow rate of the gas which collides with the working face of the refractory.

In the impinging region (the hot spot) in which a jet stream of the oxygen gas blown from the oxygen lance 18 impinges with the molten steel 11, carbon contained in the molten steel is oxidized with the oxygen gas to evolve a CO gas and the temperature in the vicinity of the hot spot is as high as about 2400° C. due to the calorific value involved in the decarburization reaction.

Further, a secondary combustion reaction occurs wherein the evolved CO gas is burned in the atmosphere ($CO+(½)O_2 \rightarrow CO_2$). Therefore, the gas temperature (atmosphere temperature) at a portion just above the hot spot becomes very high.

The CO gas flow rate also becomes maximum at the portion just above the hot spot immediately after the evolution of the CO gas.

Thus, the freeboard section in the vacuum decarburization refining undergoes wearing action due to heat of radiation, a gas stream or the like which occurs by the hot spot having a high-temperature and the portion just above the hot spot. Therefore, it is important to properly maintain geometrical arrangement between the hot spot and the freeboard section.

According to this embodiment of the present invention, setting of the geometrical arrangement between the hot spot and the refractory of the vacuum tank in the above manner can minimize the melt loss of the refractory in the freeboard section, the oxygen lance and the like and, at the same time, can prevent the introduction of dust created by splashing of the molten steel 11 into the evacuation system, realizing the operation of vacuum decarburization refining with high productivity.

Next, a vacuum decarburization refining apparatus according to another preferred embodiment of the present invention will be described.

Figure 27:
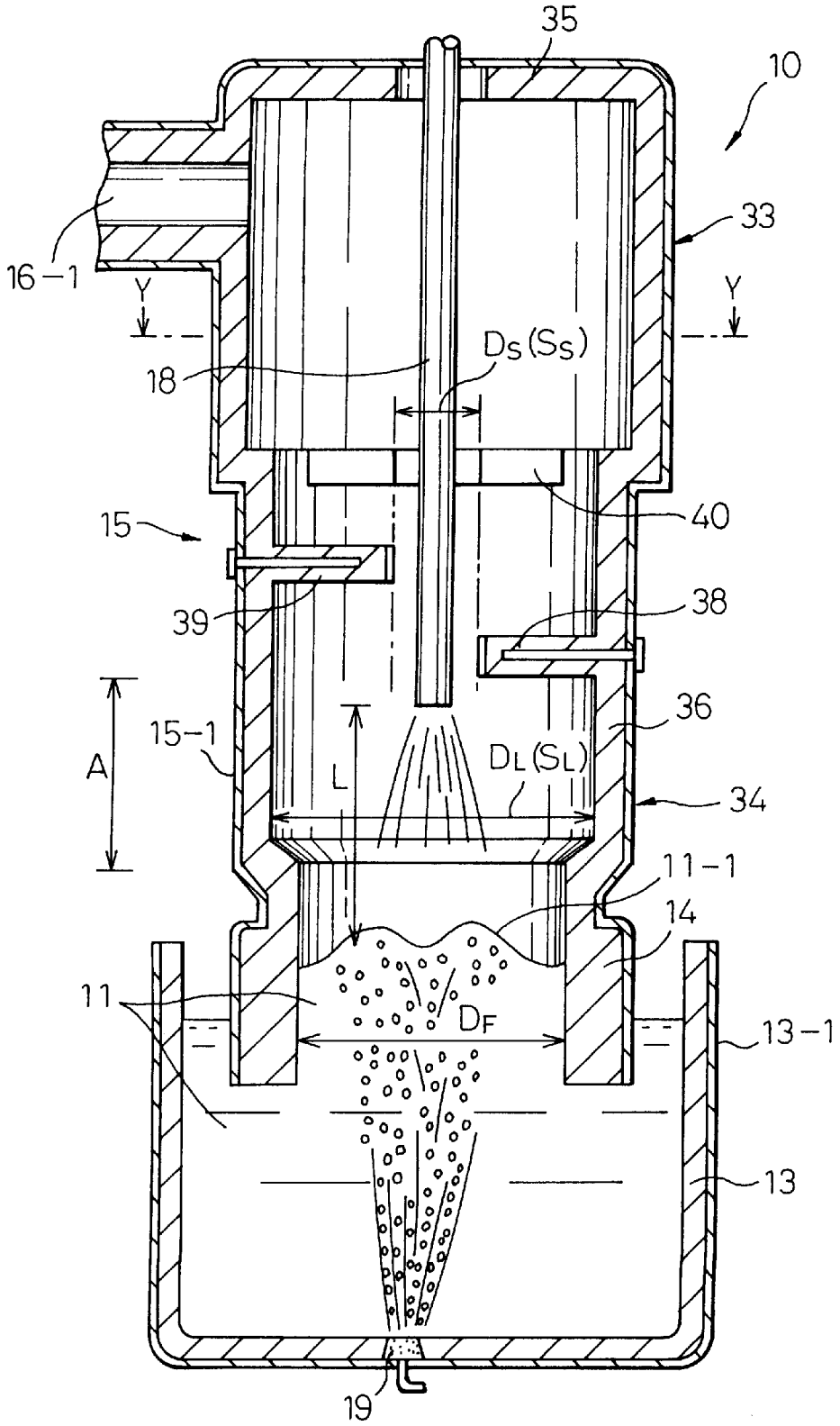
FIG. 27 is a sectional side view of a vacuum decarburization refining apparatus according to another embodiment of the present invention.
Figure 28:
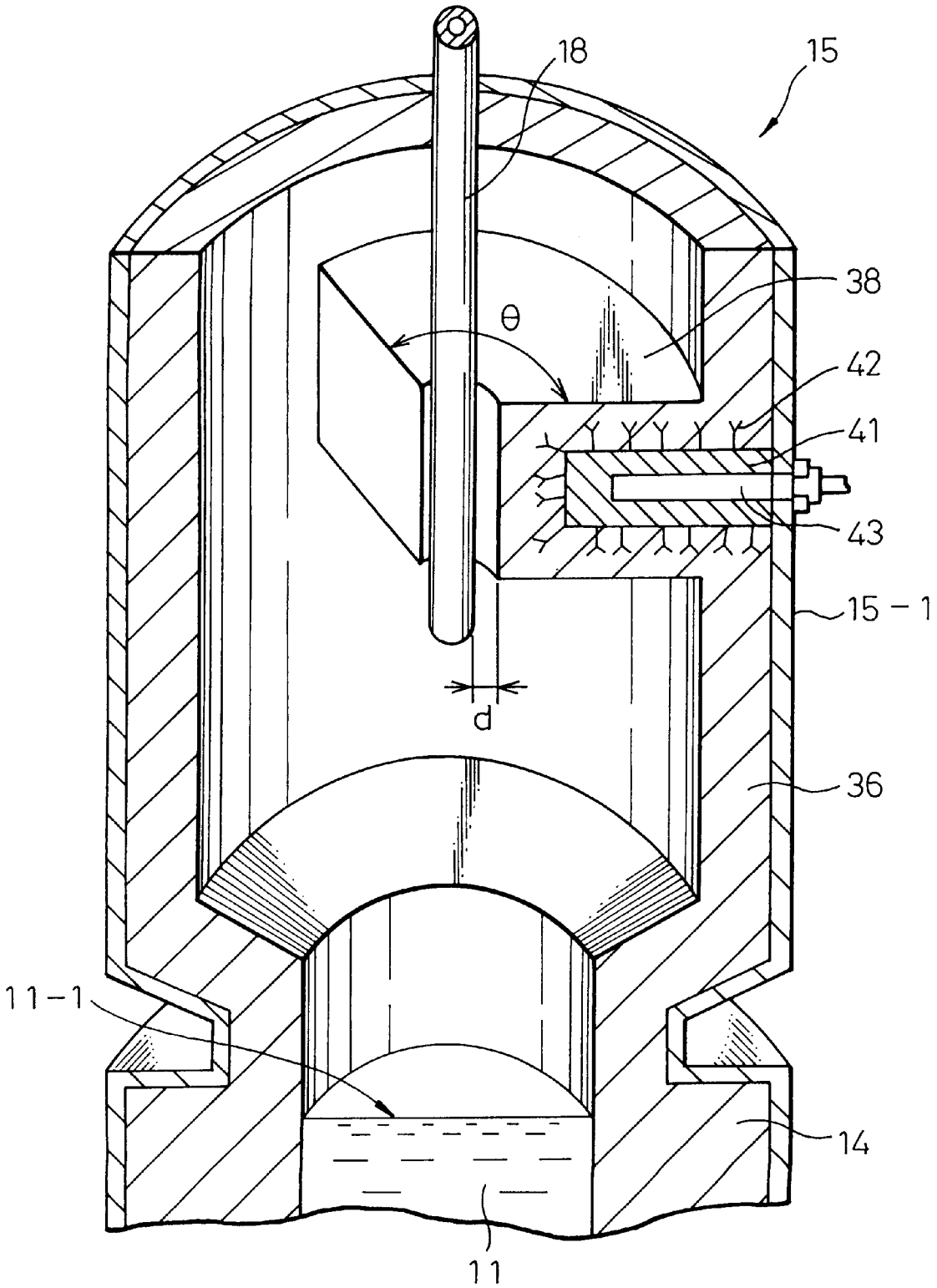
FIG. 28 is a partially sectional perspective view of the vacuum decarburization refining apparatus shown in FIG. 27.
Figure 29:
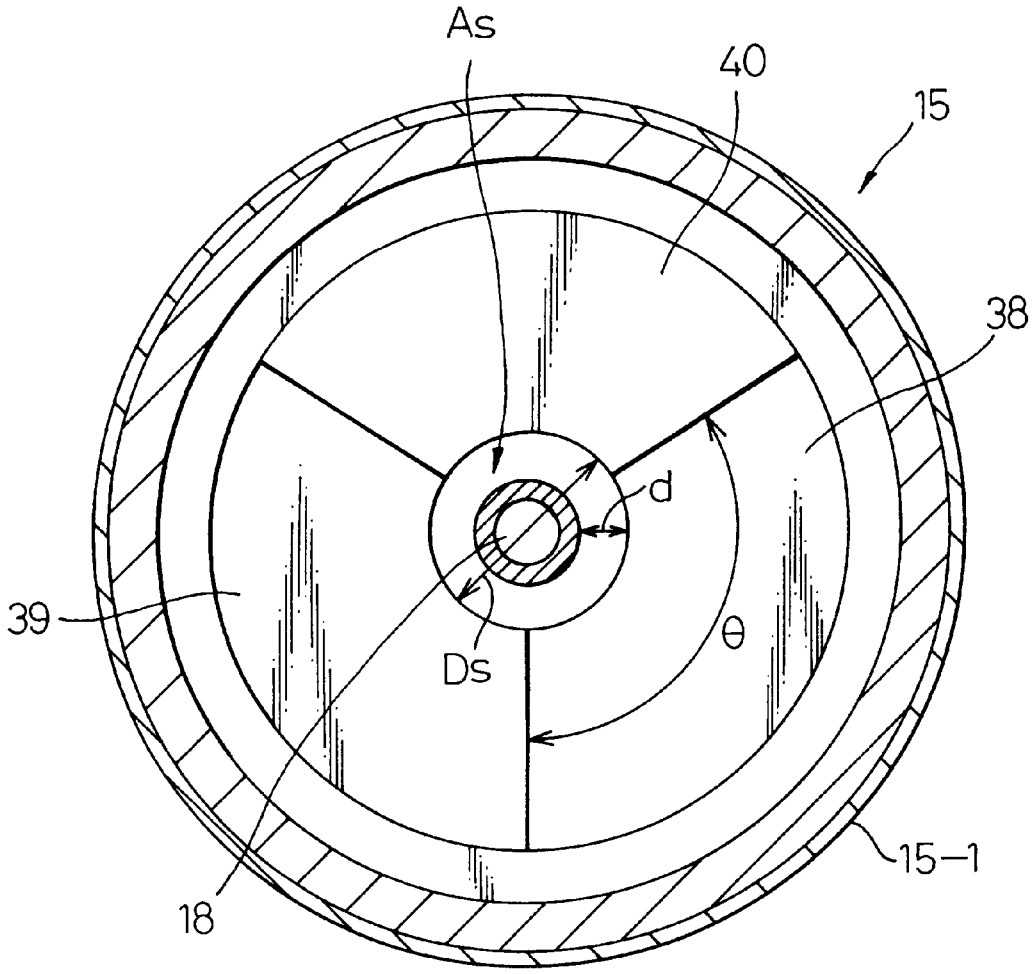
FIG. 29 is a cross-sectional view taken on line Y—Y of FIG. 27.

As shown in FIGS. 27 to 29, the construction of a vacuum decarburization refining furnace 10 according to the second preferred embodiment is substantially the same as that according to the first preferred embodiment, except that the structure of the smaller-diameter section 37 of the vacuum tank 15 in the vacuum decarburization refining apparatus 10 described in the first preferred embodiment has been changed to the structure of fan-shaped shields 38, 39, 40. Therefore, like parts have the same index numerals, and detailed description thereof will be omitted.

As shown in FIG. 27, the fan-shaped shields 38–40 are provided so as to be different from one another in position as well as in level in the vertical direction. Further, as shown in FIG. 29, the shields are provided at a fan angle θ for covering the whole molten steel surface within the vacuum tank except for the sectional area Ss in the space As defined by the shields.

As shown in FIG. 28, regarding the fan-shaped shields 38 to 40, for example, the fan-shaped shield 38 is provided by fixing a core metal 41, with a cooling air passage 43 provided therein, onto the inner side of an iron skin 15-1 in the vacuum tank and fixing a prepared unshaped refractory, such as alumina castable refractory, onto the core metal 37 through a Y-shaped stud 42 mounted on the core metal 41.

Thus, provision, as the smaller-diameter section, of a plurality of fan-shaped shields so as to be different from one another in level can effectively shield the heat of radiation from the hot spot on the molten steel surface 11-1, and splash and, in addition, enables vacuum decarburization refining while maintaining the evacuation passage in the vacuum tank 15 so as not to avoid an increase in evacuation resistance.

In this preferred embodiment, the formation of the fan-shaped shield using a prepared unshaped refractory has been described. It is also possible to form the fan-shaped shield using a shaped refractory, for example, a magnesia-chromia refractory brick.

The fan angle θ in each fan-shaped shield may not be necessarily identical so far as the whole molten steel surface except for the space around the oxygen lance is covered with the surface of the fan-shaped shields. Further, the number of fan-shaped shields is not limited to three.

Furthermore, no operation problem occurs when the fan-shaped shields respectively in their surfaces facing the molten steel surface partially overlap with each other or one another. This also falls within the scope of the present invention.

FIGS. 27 and 28 shows such a state that blowing is carried out under a low degree of vacuum within the vacuum tank. Therefore, in this state, the height of the surface of the molten steel within the snorkel is low.

In the vacuum tank having the above structure according to the present invention, a space is provided in the smaller-diameter section so that the oxygen nozzle 18 is passed through the space. Therefore, there is a possibility that an exhaust gas containing dust ascends through the space, reaches the side wall of the upper tank in the vacuum tank, particularly the canopy and the side wall near the canopy, causing the dust to deposit and accumulate.

The present invention further provides means for preventing the deposition of the dust.

Figure 30:
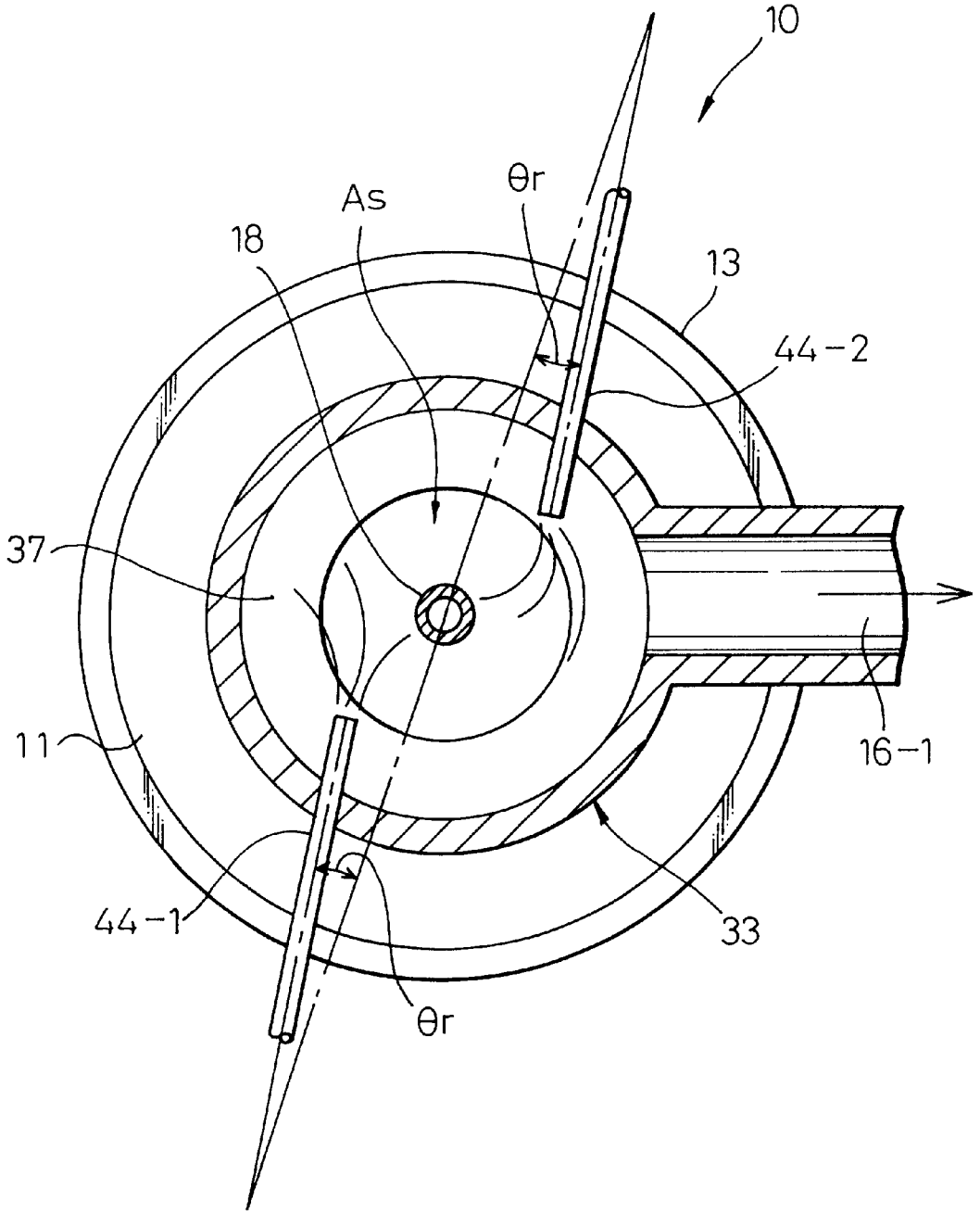
FIG. 30 is a sectional plan view of an vacuum decarburization refining apparatus provided with burners according to one embodiment of the present invention.

Specifically, as shown in FIGS. 24 and 30, burners 44-1, 44-2 are provided so that the front end thereof is located below the canopy 35 by a distance F (burner front end distance F). In this case, these burners are inserted and provided in the upper tank 33 so as to face each other so that the gas ejection direction has a predetermined burner ejection angle θh to the vertical direction and a burner whirling angle θr.

The burner front end distance F is preferably in a range of from 0.3 to 3 m, the burner ejection angle θh is preferably in a range of from 20° to 90°, and the whirling angle θr is preferably in a range of from 15° to 30°.

By virtue of the construction of the burners, an oxygen gas, a fuel gas, or a mixed gas composed of the oxygen gas and the fuel gas blown through the burners 44-1, 44-2 into the upper tank 33 forms a whirling stream within the upper tank 33, permitting a refining gas evolved in the course of the oxygen blowing refining to be efficiently mixed with the oxygen gas, fuel gas and the like and, at the same time, permitting the temperature of the canopy 35 to be properly held.

Figure 31:
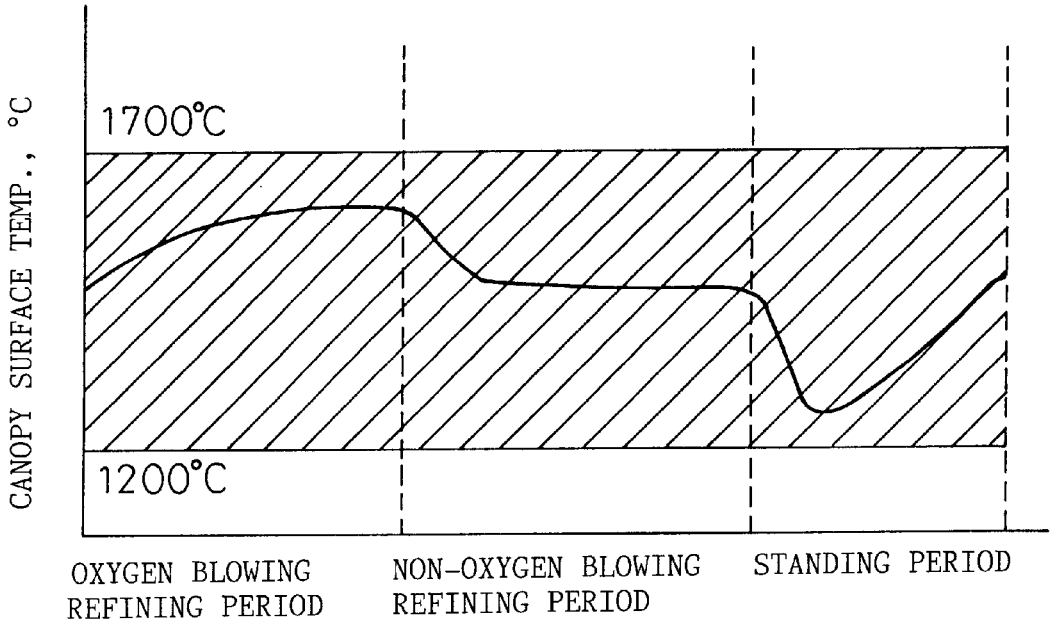
FIG. 31 is a typical diagram showing a change in surface temperature of a canopy over time.

Specifically, the above burners are applied during the oxygen blowing decarburization refining, the surface temperature of the canopy is detected with a plurality of thermocouples buried in the canopy 35, and the surface temperature of the canopy is kept in a range of 1200 to 1700° C. as shown in FIG. 31. In this case, an inspection hole for measurement of the temperature may be provided in the side wall of the upper tank so that the surface temperature of the canopy is directly measured with an optical pyrometer. The dust, which has reached around the canopy, is melted and removed, preventing a lowering in yield of chromium or iron derived from the deposition of the dust.

In the subsequent non-oxygen blowing refining period, the blowing of the oxygen gas through the oxygen lance 18 is ended, and an argon gas is injected from the low portion of the ladle 13 into the molten steel 11 to agitate the molten steel 11 in the snorkel 14.

This can homogenize the remaining refining reaction, the molten steel temperature, and the constituents of the molten steel.

Therefore, also in the non-oxygen blowing refining period, the accumulation of dust, onto the canopy 35, produced by the agitation of the molten steel and the evacuation of the interior of the snorkel 14 by an evacuating apparatus can be prevented.

In the standing-by period, the evacuating apparatus is stopped, the pressure within the snorkel 14 is returned to the atmospheric pressure, and the lower end of the snorkel 14 is pulled up from the molten steel 11 in the ladle 13 and is held in a standing-by state. During this period, the surface temperature of the canopy is regulated in a predetermined temperature range (1200 to 1700° C.) using the burners 44-1, 44-2.

In the standing-by period, use of air instead of the oxygen gas for burning the fuel gas is preferred from the viewpoint of cost and, in addition, avoiding damage to the refractory by oxidation.

Thus, even though dust is accumulated on the canopy 35 or a portion around the canopy 35, it can be melted and allowed to flow down and removed. In addition, it is possible to effectively prevent the damage to the refractory of the snorkel 14 due to thermal stress, created by excessive thermal shock in the initiation of the subsequent oxygen blowing refining period.

In the present invention, when the vacuum decarburization refining is carried out, the degree of vacuum within the vacuum tank is maintained at a predetermined value while sucking an exhaust gas evolved during the refining through a steam ejector. In this case, the sucked exhaust gas is cooled by means of a gas cooler and fed into an exhaust gas treatment system.

Figure 35:
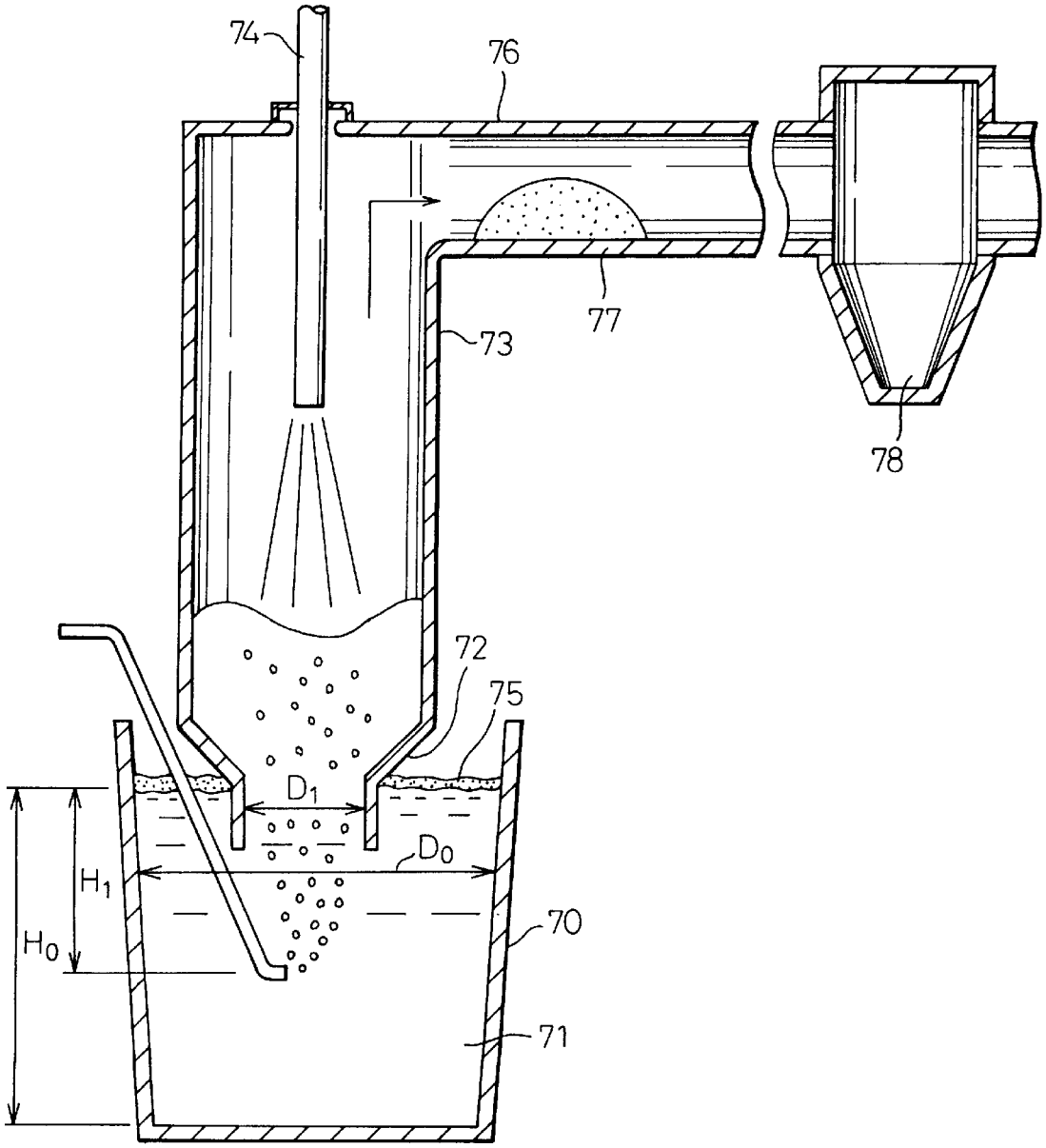
FIG. 35 is a cross-sectional side view of a conventional vacuum refining apparatus using an evacuation duct.

Therefore, there is a possibility that the dust contained in the exhaust gas is sucked, together with the exhaust gas through a duct, and, as shown in FIG. 35, the dust is deposited and accumulated within the duct to inhibit the flow of the exhaust gas.

Accordingly, the present invention further provides a vacuum refining apparatus that can prevent clogging of an evacuation duct with dust introduced into the evacuation duct, permitting the attained degree of vacuum within the vacuum tank to be maintained on a predetermined level and, in addition, can facilitate the removal of dust.

The present invention will be described with reference to FIGS. 32 to 34. As shown in the drawing, in an exhaust gas treating apparatus used in the vacuum refining apparatus 10, an evacuation duct 16-1 is provided in the upper tank of the vacuum tank 15, and an duct inlet 45 is connected to an inlet of a gas cooler 55 for cooling the exhaust gas through the duct.

A dust pot 53 for collecting the dust contained in the exhaust gas is provided in the course of the passage of the evacuation duct 16-1 having an actual length $L_0$ of about 15 to 50 m, and the evacuation duct extending from the upper tank to the dust pot is constructed so that the dust is not accumulated within the evacuation duct.

Figure 32:
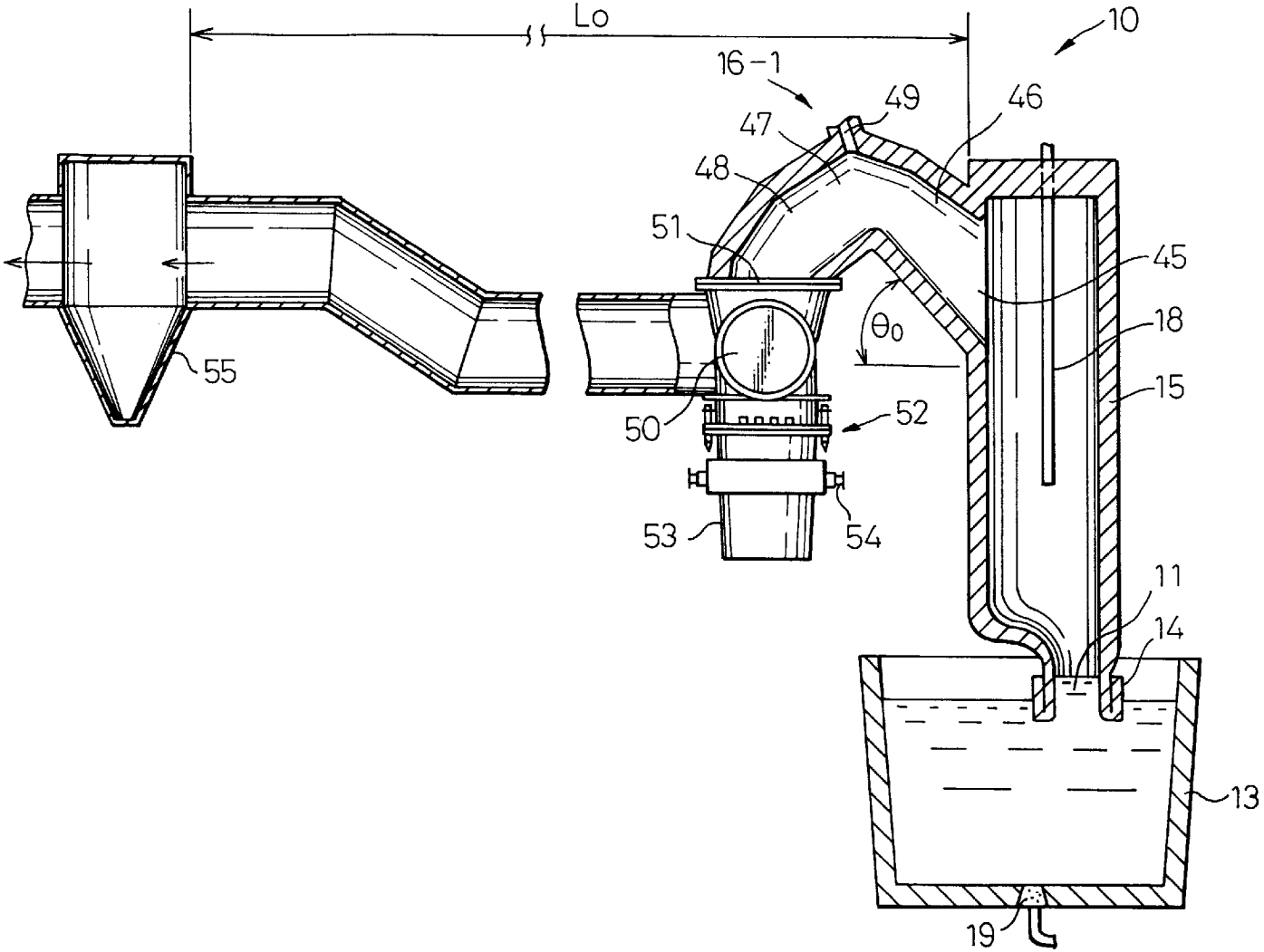
FIG. 32 is a partially sectional side view of a vacuum refining apparatus according to one embodiment of the present invention.

Specifically, as shown in FIG. 32, the evacuation duct 16-1 leading to the dust pot 53 comprises an ascendingly inclined section 46, having a total length of about 1.5 m, inclined upward from the duct inlet 45 at an inclination angle ($\theta_0$) of 30° to 60°, and a descendingly inclined section 48, having a total length of about 1.5 m, inclined downward from the top 47 of the ascendingly inclined section 46 at an inclination angle of about 45°.

When the upward inclination angle is less than 30°, this angle is smaller than the angle of repose of a powder constituted by dust contained in the exhaust gas. This causes the dust, which has reached the ascendingly inclined section, to be gradually accumulated without slipping down into the vacuum tank.

On the other hand, the adoption of an inclination angle exceeding 60° is difficult from the viewpoint of a design due to the restriction of the system. Further, when the inclination angle exceeds 60°, the effect of dropping the dust on the ascendingly inclined section into the vacuum tank is substantially saturated. For this reason, the upper limit of the inclination angle is 60°.

The actual length $L_0$ of the evacuation duct refers to the length of the evacuation duct along the evacuation direction, that is, the total length from the duct inlet to the gas cooler.

When the actual length is less than 15 m, the amount of the dust in the exhaust gas introduced from the vacuum tank into the gas cooler is remarkably increased and, at the same time, the exhaust gas temperature becomes so high that the load of the gas cooler is unfavorably increased.

On the other hand, when the actual length exceeds 50 m, the load imposed on the evacuating apparatus is beyond a limit, making it difficult to attain the necessary degree of vacuum.

A heating device 49 is provided aslant toward the ascendingly inclined section 46 around the top 47 of the ascendingly inclined section 46 so that dust and the like accumulated on the top 47, the ascendingly inclined section 46, or the descendingly inclined section 48 are heat-melted and flow down into the vacuum tank 11 or the dust pot 53.

A branched section 50 is provided below the descendingly inclined section 48, and the dust pot 53 is detachably disposed at the lower part of the branched section 50 so that the dust and the like dropped along the inside of the inclined duct in the descendingly inclined section 48 are collected in the dust pot 53.

Figure 33:
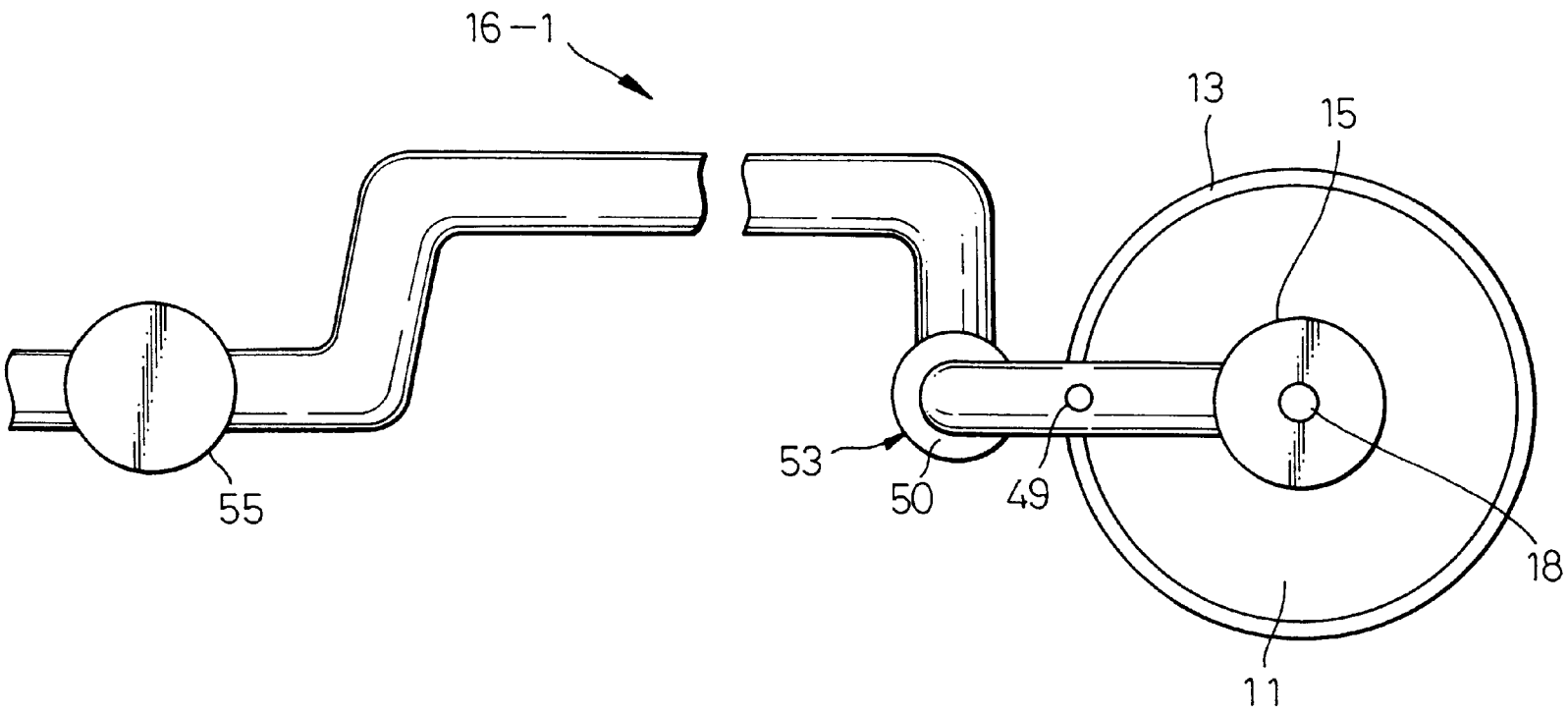
FIG. 33 is a plan view of the vacuum refining apparatus shown in FIG. 32.

As shown in FIG. 33 (plan view), the evacuation duct 16-1 is constructed so that the flow direction of the exhaust gas is changed by about 90° in the branched section 50. Changing the direction and speed of the exhaust gas in this way can accelerate the dropping of the dust contained in the exhaust gas into the dust pot 53.

The body of the evacuation duct 16-1 further extends, from the end portion of the descendingly inclined section 48 as the branched section 50 located just above the dust pot 53, through a curved portion and a linear portion to an inlet of the gas cooler 55.

The system is constructed so that the actual length ($L_0$) of the evacuation duct 16-1 extending from the duct inlet 45 to the inlet of the gas cooler 55 and the inclination angle ($\theta_0$) are if necessary set as desired.

The gas cooler 55 is a cooling device, for an exhaust gas, with a cooling plate or the like provided therein, and is constructed so that the gas within the cooler is discharged by means of an evacuation apparatus (not shown). Solid particles (dust) in the exhaust gas, which have collided against the cooling plate or the inner wall of the cooler and consequently lost speed, are collected in a inverted conical lower part of the gas cooler 55 and hence may be recovered according to need.

Figure 34:
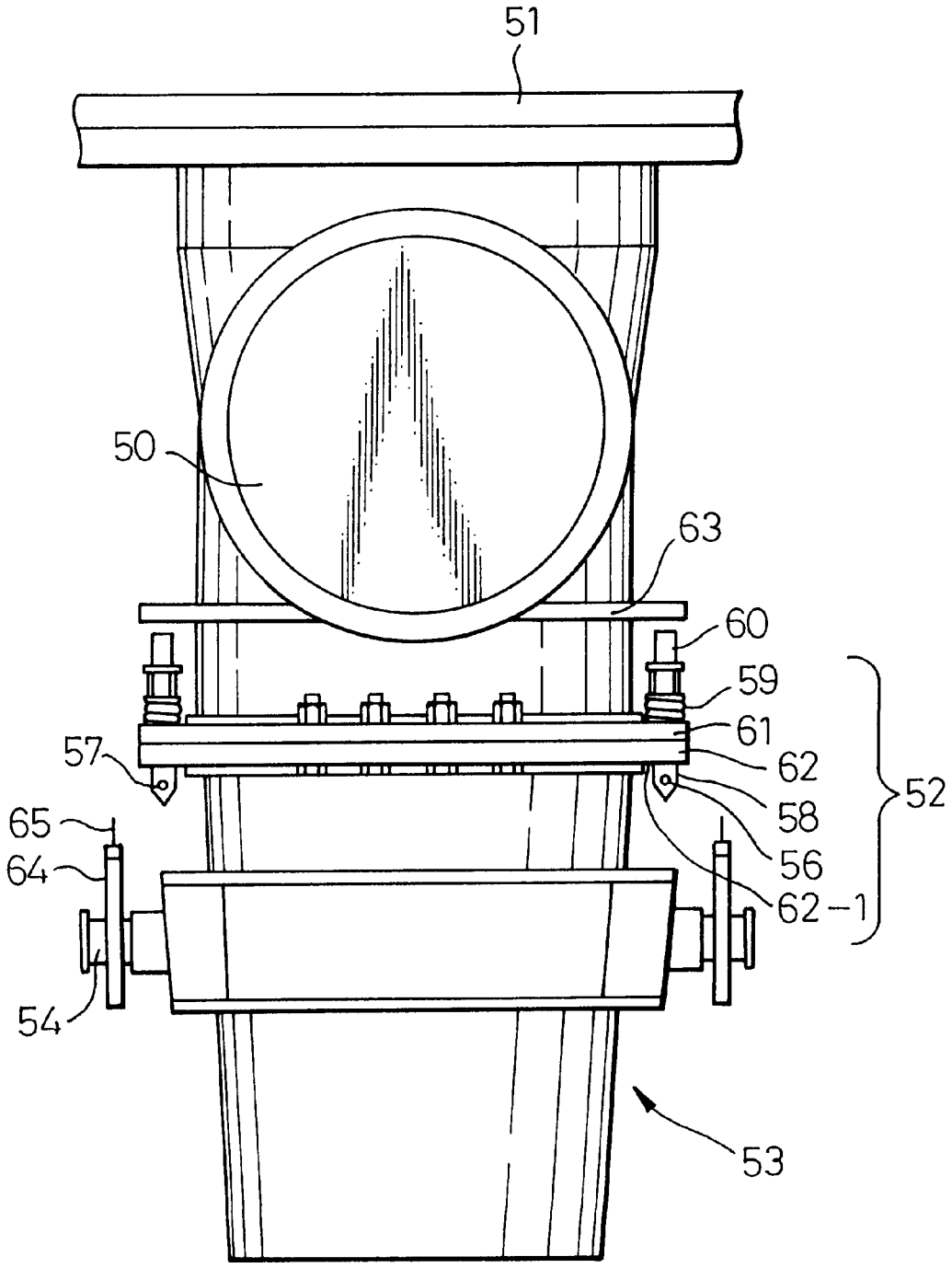
FIG. 34 is a side view showing a dust pot attached to a vacuum refining apparatus.

As shown in FIG. 34, a pot detaching device 52 comprises: a guide rod 58 having in its front end a cotter hole 57; a hydraulic cylinder 60 for vertically moving the guide rod 58 through a disc spring 59; an upper flange 63 for fixing the hydraulic cylinder 60; and a fixed flange 61 for movably holding the guide rod 58 through a guide hole (not shown) for connection to a receiving flange 62 of the dust pot 53.

The dust pot 53 is a substantially cylindrical container, having a bottom section, made of steel or a casting and comprises: a receiving flange 62 disposed in the upper end portion; a guide rod insertion hole for inserting therein the guide rod 58 of the pot detaching device 52 provided in the receiving flange; and a pair of suspension trunnions 54 provided, so as to face each other, in the outer periphery of the dust pot 53.

The dust pot 53 is constructed so that, if necessary, the inner wall may be covered with a refractory lining material, such as a castable refractory lining material.

When a large amount of dust has been collected in the dust pot 53, the dust pot 53 may be detached using the pot detaching device 52, permitting the dust collected in the dust pot 53 to be easily removed and, at the same time, enabling maintenance, such as cleaning around the branched section 50, to be carried out.

The dust pot 53 may be detached from the evacuation duct 16-1 as follows. At the outset, a chain 65 is mounted on a metal hanger 64 mounted on the trunnion 54 of the dust pot 53, and the dust pot 53 is supported by means of a chain block (not shown). In this state, fixing bolt and nut between the receiving flange 62 and the fixing flange 61 are removed.

Next, the hydraulic cylinder 60 is operated using a hydraulic unit (not shown) to depress the guide rod 58 while pressing the disc spring 59.

This permits the force of constraint, applied to the cotter 56, to be released, and the cotter 56 inserted in the cotter hole 57 of the guide rod 58 can be removed.

The cotter 56 is removed from the cotter hole 57, and, in addition, the dust pot 53 is lowered using the chain block.

In this way, the guide rod 58 may be pulled out from the guide rod inserting hole 62-1 of the receiving flange 62 to completely separate the dust pot 53 from the evacuation duct 16-1, followed by removal of the dust, containing metal and the like, collected in the dust pot 53.

As described above, the evacuation duct of the present invention can effectively prevent dust from accumulating within the duct. Therefore, a predetermined degree of vacuum can be maintained without increasing the pressure loss involved in evacuation of the evacuation duct.

The apparatus of the present invention has at least one of the above features, realizing stable operation of the vacuum refining apparatus.

EXAMPLES

Example 1

In this example, vacuum oxygen blowing refining of a stainless steel according to one embodiment of the present invention was carried out using a vacuum oxygen blowing refining apparatus on a scale of 150 tons.

In a converter, a molten steel having [% C] 0.6 to 0.7% and [% Cr] 10 to 20% was prepared by the melt process, and temperature elevation and oxygen blowing decarburization were carried out using an oxygen blowing refining apparatus shown in FIG. 1.

In this case, the oxygen blowing rate was regulated in such a manner that, for all the cases independently of the temperature elevation period and the decarburization refining period, the oxygen blowing rate was kept at a constant rate of 23.3 $Nm^3/h/t$ until [% C] reached 0.3%; when [% C] was in the range of from 0.15% to 0.05%, the oxygen blowing rate was reduced from 23.3 $Nm^3/h/t$ to 10.5 $Nm^3/h/t$ at a constant rate; and when [% C] reached 0.05%, the blowing of oxygen was stopped. The flow rate of an argon gas for agitation was evenly 4.0 Nl/min/t for the temperature elevation period and 2.7 Nl/min/t for the decarburization refining period.

Figure 4:
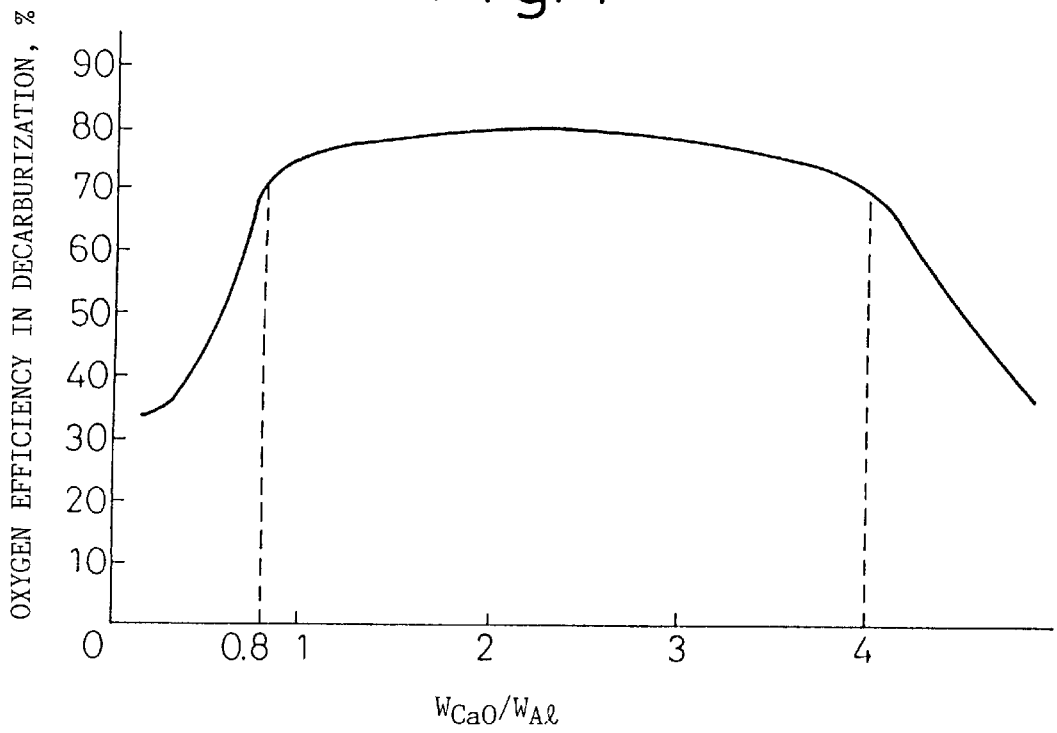
FIG. 4 is a diagram showing the relationship between $W_{CaO}/W_{Al}$ and the oxygen efficiency in decarburization.

Conditions and results for runs according to Example 1 of the present invention are given, in comparison with comparative runs, in Table 1 and FIG. 4. Run Nos. 1 to 5 fall within the scope of the present invention, and run Nos. 6 to 11 are comparative runs.

For run Nos. 1 to 5 according to the present invention, as shown in FIG. 4, since both the G value for the aluminum temperature elevation period and the G value for the decarburization refining period satisfy the formula (1), in the temperature elevation period and the decarburization refining period, the amount of chromium oxidized and the amount of splashing were very small.

On the other hand, in run No. 6 wherein the G value in the aluminum temperature elevation period was larger than −20 on the average, the oxidation of chromium significantly proceeded in the temperature elevation period. Run No. 7 is a run where, although the G value in the aluminum temperature elevation period was not more than −20 on the average, it exceeded −20 (maximum value −18) during the temperature elevation period. In this run, the oxidation of chromium proceeded in the period where the G value exceeded −20.

In run No. 8 where the average G value (−18) in the decarburization refining period exceeded −20, the oxidation of chromium excessively proceeded. On the other hand, run No. 9 is a run where although the average G value (−24) was in the range of from −20 to −35, it exceeded −20 in a part of the decarburization refining period. In this run, the oxidation of chromium proceeded during this period. In run No. 10 where the G value (−37) was less than −35 in a part of the decarburization refining period, splashing was significantly created in this period posing a problem of deteriorated operation, although the oxidation of chromium was prevented. In run No. 11 where aluminum for an increase in temperature was introduced at once during the temperature elevation/oxygen blowing period, the oxidation of chromium was increased in the temperature elevation period.

In run No. 4, according to the present invention, the G value in the decarburization refining period was regulated as specified in Table 1 (2). Specifically, decarburization refining was carried out in such a manner that in the course of the decarburization wherein [% C] of the molten steel was decreased from 0.7% to 0.05% (at the time of stopping of the oxygen blowing), [% Cr] and T were determined, and, based on the data, P within the vacuum tank was regulated to regulate the G value as shown in Table 1 (2). In the refining, as indicated in Table 1 (2), good decarburization results could be obtained when the regulation was carried out so that, for the G value, the maximum value was −21 with the minimum value being −25 and the average value being −23.

TABLE 1

| | | G value during Al temp. elevation | | | G value in decarburization refining period | | | Introduction of Al | Amount of Cr oxidized, kg/t | | | | |
|---|---|---|---|---|---|---|---|---|---|---|---|---|---|
| | Run No. | Average | Max. | Min. | Average | Max. | Min. | for temp. elevation | Temp. elevation period | Decarburization period | Total | Splashing | Evaluation |
| Inv. | 1 | −25 | −22 | −27 | −28 | −27 | −30 | Dividedly | 0.2 | 0.7 | 0.9 | Slight | ○ |
| | 2 | −23 | −21 | −25 | −27 | −25 | −31 | Dividedly | 0.3 | 0.8 | 1.0 | Slight | ○ |
| | 3 | −22 | −20 | −24 | −25 | −23 | −29 | Dividedly | 0.5 | 0.9 | 1.4 | Slight | ○ |
| | 4 | −22 | −21 | −23 | −23 | −21 | −25 | Dividedly | 0.4 | 1.1 | 1.5 | Slight | ○ |
| | 5 | −26 | −21 | −28 | −30 | −25 | −35 | Dividedly | 0.2 | 0.4 | 0.6 | Slight | ○ |
| Comp. | 6 | −16 | −15 | −17 | −27 | −25 | −29 | Dividedly | 2.4 | 0.7 | 3.1 | Slight | X |
| | 7 | −21 | −18 | −23 | −24 | −22 | −26 | Dividedly | 2.1 | 0.9 | 3.0 | Slight | X |
| | 8 | −22 | −20 | −24 | −18 | −15 | −26 | Dividedly | 0.5 | 4.6 | 5.1 | Slight | X |
| | 9 | −24 | −23 | −25 | −24 | −18 | −29 | Dividedly | 0.3 | 2.7 | 3.0 | Slight | X |
| | 10 | −22 | −21 | −25 | −29 | −26 | −37 | Dividedly | 0.5 | 0.2 | 0.7 | Severe | X |
| | 11 | −23 | −21 | −26 | −27 | −25 | −29 | At one time | 2.7 | 0.4 | 3.1 | Slight | X |

| No. | G | pTorr | T* | C, % | Cr, % |
|---|---|---|---|---|---|
| 1 | −21 | 160 | 1630 | 0.7 | 16.3 |
| 2 | −22 | 130 | 1650 | 0.5 | 16.3 |
| 3 | −24 | 80 | 1670 | 0.3 | 16.2 |
| 4 | −25 | 30 | 1690 | 0.1 | 16.1 |
| 5 | −25 | 20 | 1720 | 0.05 | 15.9 |

Example 2

In order to demonstrate the effect attained by adding CaO, the procedure of Example 1 was repeated, except that CaO together with aluminum was introduced during the aluminum temperature elevation period.

Runs according to the present invention, together with comparative runs, are shown in Tables 2 and 3. Run Nos. 1 to 12 are runs according to the present invention. On the other hand, for run No. 13, since the $W_{cao}/W_{Al}$ ratio was less than 0.8, the production of calcium aluminate was not accelerated, causing slag to remain solidified, which made it difficult to sample the molten steel and at the same time resulted in deteriorated oxygen efficiency in decarburization. In run No. 14, due to excessive CaO, the amount of slag was so large that the decarburization by oxygen jet in the decarburization period was inhibited. Run Nos. 15 and 16 are runs where the immersion depth of the snorkel in the temperature elevation period was less than 200 mm and exceeded 400 mm. A immersion depth of less than 200 mm made it difficult to sample the molten steel and at the same time resulted in lowered oxygen efficiency in decarburization. On the other hand, when the immersion depth exceeded 400 mm, the oxygen efficiency in decarburization was lowered due to unsatisfactory discharge of the slag within the tank (that is, due to inhibition of decarburization caused by covering), although the molten steel could be easily sampled. Run Nos. 17 and 18 are runs where the immersion depth of the snorkel in the decarburization period was less than 500 mm and exceeded 700 mm. When the immersion depth was less than 500 mm, solidification of slag (difficulty of sampling the molten steel) due to outflow of $Cr_2O_3$-rich slag into the outside of the snorkel in an early stage and lowering in oxygen efficiency in decarburization were observed. On the other hand, when the immersion depth exceeded 700 mm, the oxygen efficiency in decarburization was unfavorably lowered due to worsening of circulation of the molten steel. Nos. 19 and 20 are runs where the flow rate of an argon gas for agitation in the temperature elevation period was less than 3.3 Nl/min/t and exceeded 4.7 Nl/min/t. When the flow rate of the argon gas was less than 3.3 Nl/min/t, the oxygen efficiency in decarburization was deteriorated and attributable to the occurrence of a large amount of residual slag within the tank. On the other hand, when the flow rate of the argon gas exceeded 4.7 Nl/min/t, it became difficult to sample the molten steel due to unsatisfactory production of calcium aluminate. Run Nos. 21 and 22 are runs where the flow rate of the argon gas for agitation in the decarburization period was less than 1.7 Nl/min/t and exceeded 6.0 Nl/min/t. When the flow rate of the argon gas was less than 1.7 Nl/min/t, the oxygen efficiency in decarburization was deteriorated due to unsatisfactory circulation, while when the flow rate exceeded 6.0 Nl/min/t, the oxygen efficiency in decarburization was deteriorated due to the outflow of the produced $Cr_2O_3$ into the outside of the snorkel in an early stage.

Example 3

The effect of addition of CaO and the influence of the slag thickness were examined by adding CaO in the oxygen blowing decarburization refining period to the vacuum tank under the following experimental conditions.

Runs of Example 3 were carried out in a 150-t molten steel ladle using a molten 16% Cr stainless steel, which had been roughly decarburized to [% C]=0.7% in a converter. For the runs, oxygen blowing decarburization was carried out at an oxygen blowing rate of 24.0 $Nm^3/h/t$ until [% C] reached 0.05%. Further, for all the runs, the flow rate of an argon gas for agitation in the oxygen blowing decarburization period was 3.3 Nl/min/t.

Experimental results show that, when the experimental conditions fell within the scope of the present invention, as shown in Table 4, oxygen blowing decarburization of a molten steel in vacuo could be carried out while maintaining high productivity without deterioration in operation derived from splashing.

TABLE 2

| | | | Immersion depth, mm | | Flow rate of Ar gas for agitation, Nl/min/t | | Oxygen efficiency in decarburization | | |
|---|---|---|---|---|---|---|---|---|---|
| | Run No. | $W_{CaO}/W_{Al}$ | Temp. elevation period | Decarburization period | Temp. elevation period | Decarburization period | in decarburization period, % | Sampling | Evaluation |
| Inv. | 1 | 1.0 | 300 | 600 | 4.0 | 2.7 | 75 | ○ | ○ |
| | 2 | 1.4 | 350 | 650 | 3.7 | 2.3 | 73 | ○ | ○ |
| | 3 | 0.8 | 300 | 600 | 3.9 | 2.5 | 71 | ○ | ○ |
| | 4 | 4.0 | 300 | 600 | 3.8 | 4.3 | 70 | ○ | ○ |
| | 5 | 1.5 | 200 | 600 | 4.2 | 2.9 | 74 | ○ | ○ |
| | 6 | 1.1 | 400 | 650 | 3.5 | 3.2 | 71 | ○ | ○ |
| | 7 | 1.7 | 300 | 500 | 3.8 | 5.4 | 75 | ○ | ○ |
| | 8 | 2.6 | 250 | 700 | 4.1 | 3.1 | 73 | ○ | ○ |
| | 9 | 1.5 | 350 | 550 | 3.3 | 2.6 | 70 | ○ | ○ |
| | 10 | 3.4 | 300 | 600 | 4.7 | 3.3 | 72 | ○ | ○ |
| | 11 | 1.2 | 300 | 600 | 3.9 | 1.7 | 68 | ○ | ○ |
| | 12 | 1.8 | 300 | 550 | 4.0 | 6.0 | 76 | ○ | ○ |

TABLE 3

| | | | Immersion depth, mm | | Flow rate of Ar gas for agitation, Nl/min/t | | Oxygen efficiency in decarburization | | |
|---|---|---|---|---|---|---|---|---|---|
| | Run No. | $W_{CaO}/W_{Al}$ | Temp. elevation period | Decarburization period | Temp. elevation period | Decarburization period | in decarburization period, % | Sampling | Evaluation |
| Comp. | 13 | 0.6 | 250 | 600 | 3.9 | 2.6 | 48 | X | X |
| | 14 | 4.5 | 300 | 600 | 4.1 | 2.9 | 43 | Δ | X |
| | 15 | 1.9 | 50 | 600 | 3.8 | 3.2 | 44 | X | X |
| | 16 | 1.0 | 450 | 600 | 4.2 | 3.5 | 42 | ○ | X |
| | 17 | 2.1 | 300 | 400 | 4.0 | 2.7 | 49 | X | X |
| | 18 | 1.5 | 300 | 800 | 3.9 | 3.0 | 43 | ○ | X |
| | 19 | 1.3 | 300 | 600 | 2.5 | 2.7 | 45 | ○ | X |
| | 20 | 2.1 | 350 | 650 | 5.6 | 3.3 | 48 | X | X |
| | 21 | 1.6 | 300 | 650 | 3.5 | 1.2 | 34 | ○ | X |
| | 22 | 1.8 | 300 | 600 | 4.0 | 8.5 | 49 | X | X |

TABLE 4

| | Run No. | Thickness of slag in tank, mm | Composition of slag (% Cao/% $SiO_2$) | (% $Al_2O_3$) | (% $Cr_2O_3$) | Splashing | Oxygen efficiency in decarburization, % | Melt loss of refractories | Evaluation |
|---|---|---|---|---|---|---|---|---|---|
| Inv. | 1 | 350 | 2.5 | 21 | 28 | Slight | 76 | Slight | ○ |
| | 2 | 600 | 2.3 | 25 | 35 | Slight | 74 | Slight | ○ |
| | 3 | 100 | 3.1 | 16 | 26 | Slight | 70 | Slight | ○ |
| | 4 | 1000 | 2.7 | 18 | 29 | Slight | 71 | Slight | ○ |
| | 5 | 250 | 2.1 | 15 | 31 | Slight | 78 | Slight | ○ |
| | 6 | 400 | 2.9 | 22 | 35 | Slight | 68 | Slight | ○ |
| | 7 | 650 | 1.0 | 10 | 38 | Slight | 75 | Slight | ○ |
| | 8 | 500 | 4.0 | 23 | 24 | Slight | 72 | Slight | ○ |
| | 9 | 350 | 3.4 | 5 | 26 | Slight | 76 | Slight | ○ |
| | 10 | 550 | 2.5 | 30 | 27 | Slight | 71 | Slight | ○ |
| | 11 | 600 | 2.4 | 20 | 40 | Slight | 74 | Slight | ○ |
| Comp. | 12 | 70 | 3.1 | 15 | 31 | Severe | 72 | Slight | X |
| | 13 | 1200 | 2.5 | 18 | 24 | Slight | 34 | Severe | X |
| | 14 | 300 | 0.6 | 24 | 36 | Slight | 71 | Severe | X |
| | 15 | 250 | 4.5 | 21 | 27 | Severe | 72 | Slight | X |
| | 16 | 600 | 2.7 | 3 | 29 | Severe | 74 | Slight | X |
| | 17 | 750 | 2.4 | 38 | 24 | Slight | 70 | Severe | X |
| | 18 | 450 | 3.0 | 19 | 55 | Severe | 71 | Slight | X |

TABLE 5

| Run No. of Ex. | | 1 | 2 | 3 | 4 | 5 |
|---|---|---|---|---|---|---|
| High carbon concentration region | h/H | 0.3 | 0.4 | 0.1 | 0.6 | 0.2 |
| | Flow rate of inert gas*, Nl/min | 1.7 | 1.9 | 1.8 | 1.6 | 0.3 |
| Low carbon concentration region | Reduction rate of oxygen gas flow rate*, $Nm^3$/hr/min | 6.7 | 7.1 | 5.2 | 2.6 | 3.1 |
| | Increase or decrease in snorkel depth h | Done | Done | Done | Done | Done |
| (i) Splashing | | ○ | ○ | ○ | ○ | ○ |
| (ii) Oxygen efficiency in decarburization, %: | | | | | | |
| High carbon conc. region | | 74 | 71 | 71 | 70 | 75 |
| Low carbon conc. region | | 72 | 71 | 70 | 69 | 70 |
| (iii) Fixation between vacuum tank and ladle | | None | None | None | None | None |
| (iv) Productivity Chromium loss | | ○ | ○ | ○ | ○ | ○ |
| Overall evaluation of (i) to (iv) | | ○ | ○ | ○ | ○ | ○ |

*Amount per ton of molten steel to be treated

TABLE 6

| Run No. of Ex. | | 6 | 7 | 8 | 9 |
|---|---|---|---|---|---|
| High carbon concentration region | h/H | 0.3 | 0.2 | 0.2 | 0.6 |
| | Flow rate of inert gas*, Nl/min | 4.0 | 1.9 | 2.3 | 2.1 |
| Low carbon concentration region | Reduction rate of oxygen gas flow rate*, $Nm^3$/hr/min | 5.6 | 0.6 | 12.5 | 6.1 |
| | Increase or decrease in snorkel depth h | Done | Done | Done | Done |
| (i) Splashing | | ○ | ○ | ○ | ○ |
| (ii) Oxygen efficiency in decarburization, %: | | | | | |
| High carbon conc. region | | 71 | 72 | 71 | 77 |
| Low carbon conc. region | | 72 | 68 | 76 | 71 |
| (iii) Fixation between vacuum tank and ladle | | None | None | None | None |
| (iv) Productivity Chromium loss | | ○ | ○ | ○ | ○ |
| Overall evaluation of (i) to (iv) | | ○ | ○ | ○ | ○ |

*Amount per ton of molten steel to be treated

TABLE 7

| Comp. run No. | | 1 | 2 | 3 | 4 | 5 |
|---|---|---|---|---|---|---|
| High carbon concentration region | h/H | 0.06 | 0.8 | 0.2 | 0.3 | 0.3 |
| | Flow rate of inert gas*, Nl/min | 1.9 | 1.8 | 0.15 | 5.5 | 2.2 |
| Low carbon concentration region | Reduction rate of oxygen gas flow rate*, $Nm^3$/hr/min | 6.6 | 5.9 | 5.7 | 6.3 | 0.2 |
| | Increase or decrease in snorkel depth h | Done | Done | Done | Done | Done |
| (i) Splashing | | ○ | ○ | ○ | ○ | ○ |
| (ii) Oxygen efficiency in decarburization, %: | | | | | | |
| High carbon conc. region | | 43 | 45 | 38 | 42 | 73 |
| Low carbon conc. region | | 71 | 70 | 33 | 69 | 31 |
| (iii) Fixation between vacuum tank and ladle | | None | None | None | None | None |
| (iv) Productivity Chromium loss | | ○ | ○ | ○ | ○ | ○ |
| Overall evaluation of (i) to (iv) | | X | X | X | X | X |

*Amount per ton of molten steel to be treated

TABLE 8

| Comp. run No. | | 6 | 7 |
|---|---|---|---|
| High carbon concentration region | h/H | 0.2 | 0.2 |
| | Flow rate of inert gas*, N1/min | 1.4 | 2.0 |

TABLE 8-continued

| Comp. run No. | | 6 | 7 |
|---|---|---|---|
| Low carbon concentration region | Reduction rate of oxygen gas flow rate*, $Nm^3hr/min$ | 16.2 | 6.6 |
| | Increase or decrease in snorkel depth h | Done | Done |
| (i) Splashing | | O | O |
| (ii) Oxygen efficiency in decarburization, %: | | | |
| HIgh carbon conc. region | | 70 | 71 |
| Low carbon conc. region | | 78 | 72 |
| (iii) Fixation between vacuum tank and ladle | | None | None |
| (iv) Productivity Chromium loss | | X | O |
| Overall evaluation of (i) to (iv) | | X | X |

*: Amount per ton of molten steel to be treated

Example 4

An detailed experiment on decarburization refining in a high carbon concentration region and a low carbon concentration region was carried out in the same manner as in Example 1.

Experimental results are summarized in Tables 5 10 to 8.

Figure 15:
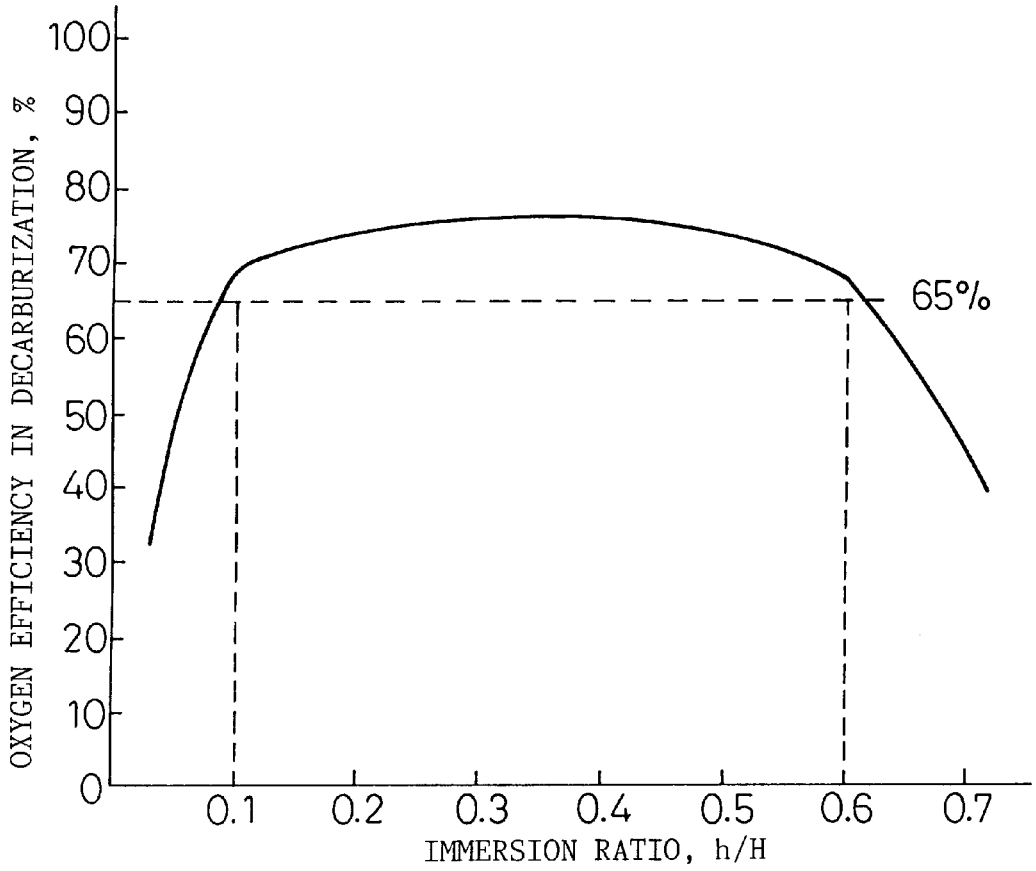
FIG. 15 is a diagram showing the relationship between the oxygen efficiency in decarburization and the immersion ratio (h/H)

FIGS. 15 to 17 are graphs respectively showing the relationship between the oxygen efficiency in decarburization and the immersion ratio (h/H), the relationship between the oxygen efficiency in decarburization and the flow rate (N) of an inert gas, and the relationship between the reduction rate (R) of the flow rate of an oxygen gas.

As shown in FIGS. 15 and 16, the oxygen efficiency in decarburization can be brought to not less than 65% by maintaining the immersion ratio (h/H) at 0.1 to 0.6 and maintaining the flow rate (N) of the inert gas at 0.3 to 4.0 Nl/min/t.

Further, as is apparent from FIG. 17, the oxygen efficiency in decarburization can be maintained at not less than 65% without deteriorating the productivity by bringing the reduction rate (R) of the oxygen gas flow rate to the range of 0.6 to 12.5 $Nm^3/h/t/min$. In FIG. 17, the hatched portion is a region where the productivity is deteriorated due to prolonged treatment time and the like in the whole refining treatment.

For example, run No. 1 of Example 4 is a run where in the high carbon concentration region, the oxygen gas flow rate was maintained in the specified range, that is, at 3 to 25 $Nm^3/h/t$, while, as specified in Table 5, maintaining the immersion ratio (h/H) and the inert gas flow rate (N) respectively at 0.3 and 1.7 Nl/min/t, and, in the subsequent low carbon concentration region, the oxygen gas flow rate (Q) was reduced at a rate of 6.7 $Nm^3/h/t/min$ and the immersion depth (h) of the snorkel 14 was decreased and/or increased.

As is apparent from the results shown in the columns (i) to (iv) of Tables 5 and 6, for example, in run No. 1 of Example 4, the splashing (i) was small, that is, the prevention of splashing was good (O), and the oxygen efficiency in decarburization (ii) in the high carbon concentration region and the oxygen efficiency in decarburization (ii) in the low carbon concentration region were respectively 74% and 72% which were a higher level than a predetermined level (65%) required for production control.

Further, fixation between the vacuum tank and the ladle (iii) was not observed, and the chromium loss (iv) was on a lower level than a predetermined level, that is, the prevention of the chromium loss was good (O).

Thus, run No. 1 of Example 4 satisfied all the requirements (i) to (iv), and the overall evaluation was good (O).

As is apparent from the results, in all of runs No. 1 to No. 9 of Example 4, good overall evaluation (O) could be obtained by properly regulating and maintaining various conditions for the decarburization refining.

On the other hand, Tables 7 and 8 show comparative runs No. 1 to No. 8 where the conditions were outside the scope of the present invention. For all of runs No. 1 to No. 8, the overall evaluation was poor (X).

Run No. 1 is a comparative run wherein the immersion ratio (h/H) was set at 0.06 which was a value outside the range (0.1 to 0.6) specified in the present invention. In this case, the oxygen efficiency in decarburization in the high carbon concentration region was 43%, i.e., a lower value than the reference value 65% for the evaluation.

Run No. 2 is a comparative run wherein the oxygen gas flow rate (Q) was set at a value which was outside and higher than the range (3 to 25 $Nm^3/h/t$) specified in the present invention. In this run, the oxygen efficiency in decarburization in the high carbon concentration region was as low as 45%.

Run No. 3 is a comparative run wherein the inert gas flow rate (N) was set at 0.15 Nl/min/t, i.e., a value outside the range (0.3 to 4.0 Nl/min/t) specified in the present invention. In this run, the oxygen efficiency in decarburization in the high carbon concentration region was 38%, a lower value than that in run No. 2.

Run No. 4 is a comparative run wherein the oxygen gas flow rate in the high carbon concentration region was set at a value which was outside and lower than the range (3 to 25 $Nm^3/h/t$) specified in the present invention. In this run, the oxygen efficiency in decarburization in the high carbon concentration region was 42%, i.e., poor.

Run No. 5 is a comparative run wherein the reduction rate (R) of the oxygen gas flow rate in the low carbon concentration region was set at 0.2 $Nm^3/h/t/min$, a value outside the range (0.5 to 12.5 $Nm^3/h/t/min$) specified in the present invention. In this run, the oxygen efficiency in decarburization in the low carbon concentration region was as low as 31%.

Run No. 6 is a comparative run wherein the reduction rate (R) of the oxygen gas flow rate in the low carbon concentration region was set at 16.2 $Nm^3/h/t/min$, a value exceeding the range (0.5 to 12.5 $Nm^3/h/t/min$) specified in the present invention. In this run, the amount of chromium loss or the like became large and not negligible, resulting in remarkably lowered productivity.

Run No. 7 is a last comparative run wherein the decarburization refining was carried out with the immersion depth (h) of the snorkel 14 submerged in the vacuum tank in the low carbon concentration region being fixed. In this run, slag 12 was deposited on the molten steel surface of the inner wall of the ladle 13 and the outer wall of the snorkel 14, causing fixation between the ladle and the snorkel, which was an obstacle to the production.

Example 5

An experiment on degassing was carried out using a vacuum refining apparatus on a scale of 150 tons (t). Table 9 shows runs according to the present invention, and Table 10 shows comparative runs.

In any of run Nos. 1 to 14 according to the present invention shown in Table 9 and run Nos. 15 and 25 (comparative runs) shown in Table 10, after a molten crude stainless steel having a chromium concentration of not less than 5% (mainly 10 to 20%) was roughly decarburized to a carbon concentration of about 0.7% in a converter, the molten steel was subjected to oxygen blowing decarburization refining in vacuo followed by degassing for 30 to 60 min. The target carbon concentration of the steel species in all runs according to the present invention is not more than 0.002% (20 ppm). The oxygen gas blowing rate during the oxygen blowing decarburization refining was kept constant, i.e., at 20 $Nm^3/h/t$.

Run No. 15 is a comparative run wherein [% C] during a stop of oxygen blowing was 0.012% (lower than 0.02%). This resulted in increased oxidation of chromium during oxygen blowing. Run No. 16 is a comparative run wherein [% C] during a stop in oxygen blowing was 0.125% (larger than 0.1%). This resulted in increased attained carbon concentration, making it impossible to produce desired stainless steel within a predetermined treatment time range. Run No. 17 is a comparative run wherein the degree of vacuum during a top of oxygen blowing was higher than the degree of vacuum specified in the present invention. In this run, due to an insufficient amount of oxygen during degassing, the decarburization could not be smoothly carried out. Run No. 18 is a comparative run wherein the degree of vacuum during a stop of oxygen blowing was lower than the degree of vacuum specified in the present invention. In this run, the oxidation of chromium was unfavorably increased.

Run No. 19 is a comparative run wherein the attained degree of vacuum at the time of degassing was 12 Torr. In this run, the attained [% C] was high due to high equilibrium attained value. Run No. 20 is a comparative run wherein the amount of oxygen reblown at the time of degassing was small. In this run, the amount of oxygen in the molten steel during degassing was so low that the decarburization could not smoothly proceed, resulting in high attained [% C]. Run No. 21 is a comparative run wherein the amount of oxygen reblown was large. In this run, chromium was oxidized due to the presence of excessive oxygen.

Run No. 22 is a comparative run wherein the degree of vacuum during reblowing of oxygen was higher than the range specified in the present invention. In this run, the amount of oxygen to be dissolved in the molten steel was insufficient. This caused a lowered decarburization rate, resulting in high attained [% C]. Run No. 23 is a comparative run wherein the degree of vacuum during reblowing of oxygen was lower than the range specified in the present invention. In this run, the oxidation of chromium proceeded. Run No. 24 is a comparative run wherein the amount of an argon gas, which is one example of the gas for agitation, was smaller than that specified in the present invention. In this run, since the agitation of the molten steel was unsatisfactory, the attained [% C] was high. Run No. 25 is a comparative run wherein the amount of the argon gas for agitation was larger than the range specified in the present invention. In this run, the attack of the refractory by the gas was severe, resulting in increased damage to the refractory. Run No. 26 is a comparative run wherein the amount of the residual slag was increased. In this run, since the free surface, which is a main site for the decarburization reaction, was not satisfactorily ensured, the decarburization rate was so low that the attained [% C] was large.

TABLE 9

| | Run No. | [c] during stop of oxygen blowing, % | Degree of vacuum during stop of oxygen blowing, Torr | Attained degree of vacuum, Torr | Amount of oxygen reblown, $Nm^3/t$ | Degree of vacuum during re-blowing, Torr | Flow rate of Ar gas for agita-tion, Nl/min/t | Amount of residual slag within tank, $t/m^3$ | Decarbu-rization rate constant, l/min | Attain-ed [C], ppm | Damage to refrac-tory | Amount of chromium oxidized during oxygen blowing | Evalu-ation |
|---|---|---|---|---|---|---|---|---|---|---|---|---|---|
| Inv. | 1 | 0.025 | 50 | 1.5 | 1.9 | 15 | 5.5 | 0.35 | 0.19 | 7 | Small | Small | ◎ |
| | 2 | 0.034 | 65 | 2.0 | 2.5 | 23 | 6.1 | 0.42 | 0.17 | 9 | Small | Small | ◎ |
| | 3 | 0.01 | 45 | 2.5 | 1.5 | 27 | 6.3 | 0.28 | 0.11 | 9 | Small | Small | ◎ |
| | 4 | 0.10 | 75 | 1.0 | 2.3 | 18 | 4.8 | 0.35 | 0.14 | 11 | Small | Small | ◎ |
| | 5 | 0.041 | 10 | 2.3 | 1.8 | 8 | 5.2 | 0.44 | 0.15 | 12 | Small | Small | ◎ |
| | 6 | 0.029 | 100 | 0.9 | 2.8 | 25 | 6.6 | 0.38 | 0.12 | 8 | Small | Small | ◎ |
| | 7 | 0.031 | 35 | 5.0 | 3.3 | 22 | 5.9 | 0.41 | 0.13 | 11 | Small | Small | ◎ |
| | 8 | 0.043 | 60 | 1.1 | 0.3 | 19 | 3.9 | 0.45 | 0.11 | 9 | Small | Small | ◎ |
| | 9 | 0.051 | 65 | 3.4 | 5.0 | 26 | 6.8 | 0.22 | 0.13 | 12 | Small | Small | ◎ |
| | 10 | 0.032 | 45 | 2.9 | 2.1 | 5 | 5.2 | 0.19 | 0.15 | 11 | Small | Small | ◎ |
| | 11 | 0.036 | 40 | 1.6 | 3.9 | 30 | 4.9 | 0.25 | 0.14 | 13 | Small | Small | ◎ |
| | 12 | 0.024 | 25 | 0.8 | 1.7 | 17 | 2.5 | 0.36 | 0.11 | 8 | Small | Small | ◎ |
| | 13 | 0.037 | 15 | 1.4 | 4.1 | 20 | 8.5 | 0.28 | 0.12 | 10 | Small | Small | ◎ |
| | 14 | 0.028 | 20 | 2.1 | 2.4 | 9 | 5.0 | 1.2 | 0.12 | 11 | Small | Small | ◎ |

TABLE 10

| | Run No. | [c] during stop of oxygen blowing, [%] | Degree of vacuum during stop of oxygen blowing, Torr | Attained degree of vacuum, Torr | Amount of oxygen reblown, $Nm^3/t$ | Degree of vacuum during re-blowing, Torr | Flow rate of Ar gas for agita-tion, Nl/min/t | Amount of residual slag within tank, $t/m^3$ | Decarbu-rization rate constant, l/min | Attain-ed [C], ppm | Damage to refrac-tory | Amount of chromium oxidized during oxygen blowing | Evalu-ation |
|---|---|---|---|---|---|---|---|---|---|---|---|---|---|
| Comp. | 15 | 0.012 | 15 | 3.5 | 2.2 | 15 | 6.3 | 0.36 | 0.10 | 17 | Small | Large | X |
| | 16 | 0.125 | 75 | 2.6 | 1.7 | 21 | 5.9 | 0.24 | 0.06 | 89 | Small | Small | X |
| | 17 | 0.031 | 7 | 0.6 | 2.9 | 10 | 4.5 | 0.19 | 0.03 | 96 | Small | Small | X |

TABLE 10-continued

| Run No. | [c] during stop of oxygen blowing, [%] | Degree of vacuum during stop of oxygen blowing, Torr | Attained degree of vacuum, Torr | Amount of oxygen reblown, $Nm^3/t$ | Degree of vacuum during re-blowing, Torr | Flow rate of Ar gas for agita-tion, Nl/min/t | Amount of residual slag within tank, $t/m^3$ | Decarbu-rization rate constant, l/min | Attain-ed [C], ppm | Damage to refrac-tory | Amount of chromium oxidized during oxygen blowing | Evalu-ation |
|---|---|---|---|---|---|---|---|---|---|---|---|---|
| 18 | 0.039 | 125 | 3.2 | 1.3 | 18 | 3.9 | 0.45 | 0.12 | 15 | Small | Large | X |
| 19 | 0.041 | 25 | 12 | 3.6 | 21 | 4.6 | 0.23 | 0.07 | 104 | Small | Small | X |
| 20 | 0.036 | 30 | 2.2 | 0.2 | 20 | 6.4 | 0.35 | 0.05 | 83 | Small | Small | X |
| 21 | 0.045 | 25 | 2.6 | 6.7 | 16 | 6.6 | 0.38 | 0.13 | 13 | Small | Large | X |
| 22 | 0.052 | 45 | 3.3 | 3.4 | 3.5 | 7.3 | 0.24 | 0.04 | 79 | Small | Small | X |
| 23 | 0.027 | 20 | 3.5 | 2.6 | 50 | 7.5 | 0.22 | 0.11 | 17 | Small | Large | X |
| 24 | 0.036 | 20 | 1.6 | 1.6 | 13 | 1.8 | 0.31 | 0.03 | 87 | Small | Small | X |
| 25 | 0.026 | 25 | 2.7 | 2.3 | 19 | 12.5 | 0.44 | 0.14 | 11 | Large | Small | X |
| 26 | 0.043 | 35 | 3.9 | 1.9 | 23 | 6.6 | 1.45 | 0.04 | 74 | Small | Small | X |

Example 6

This example was carried out using a vacuum degassing apparatus on a scale of 175 tons. After a molten steel having [% C] about 0.7% and [% Cr] not less than 5% (mainly 10 to 20%) was produced by the melt process in a converter, the molten steel was then subjected to oxygen blowing decarburization refining to [% C]=0.01% in a vacuum refining apparatus having a construction shown in FIG. 1. After the oxygen blowing was stopped, the molten steel was degassed for 30 min by mere agitation through blowing of an inert gas from the bottom of the ladle, thereby bringing the C concentration to not more than 20 ppm.

Table 11 shows runs in the degassing period according to the present invention in comparison with comparative runs. Run No. 5 is a comparative run wherein the K value exceeded 3.5. In this run, the area of the gas bubble activated surface and the agitation intensity were satisfactorily maintained, and the attained [C] was low. However, the erosion of the refractory was accelerated due to increased amount of the gas blown and the like. Therefore, conditions in run No. 5 are unsuitable for practical use.

As is apparent from Table 11, according to the present invention, a reduction in loss of chromium by oxidation by utilizing the effect attained by properly regulating the oxygen feed rate and properly regulating the state of agitation in the molten steel within the snorkel in the oxygen blowing period and, in addition, maintaining the gas bubble activated area and the surface agitation intensity in the degassing period advantageously enables a high-purity stainless steel to be efficiently produced by the melt process.

TABLE 11

| | Run No. | K-value | Proportion of activated surface based on total molten steel surface area, % | Carbon conc. before treatment, ppm | Carbon conc. after treatment, ppm | Damage to refractory | Evalu-ation |
|---|---|---|---|---|---|---|---|
| Inv. | 1 | 2.4 | 85 | 100 | 8 | ○ | ◎ |
| | 2 | 0.5 | 80 | 102 | 10 | ○ | ◎ |
| | 3 | 3.5 | 85 | 104 | 6 | ○ | ◎ |
| | 4 | 3.1 | 10 | 105 | 12 | ○ | ◎ |
| Comp. | 5 | 4.5 | 85 | 111 | 7 | X | X |
| | 6 | 0.2 | 75 | 101 | 40 | ○ | X |
| | 7 | 2.7 | 7 | 106 | 37 | ○ | X |
| VOD | 8 | — | — | 104 | 45 | Δ | X |

Example 7

An experiment was carried out, as follows, wherein aluminum for reduction was added after vacuum refining and degassing according to the present invention.

The experiment in this example was carried out using a vacuum refining apparatus on a scale of 150 tons. A molten crude stainless steel containing a chromium concentration of not less than 5% (mainly 10 to 20%) tapped from a converter was subjected to oxygen blowing decarburization refining in vacuum and then degassed, followed by addition of aluminum from the top of the vacuum tank to reduce $Cr_2O_3$ produced during oxygen blowing, thereby recovering Cr. For all runs, the reduction time was 5 min.

Table 12 shows runs according to the present invention in comparison with comparative runs.

Runs No. 1 to No. 9 are runs according to the present invention. Run No. 10 is a comparative run wherein the argon gas flow rate for agitation at the time of the introduction of aluminum for reduction was less than 0.1 Nl/min/t. In this run, the molten steel penetrated the porous plug, adversely influencing subsequent reduction. Run No. 11 is a comparative run wherein the argon gas flow rate at the time of the introduction of aluminum was excessive. In this run, bumping occurred immediately after the introduction of aluminum. Run No. 12 is a comparative run wherein the degree of vacuum during the reduction was higher than 400 Torr. In this run as well, bumping occurred. Run Nos. 13 and 14 are comparative runs wherein the flow rate of the argon gas for agitation after the introduction of aluminum was less than 5 Nl/min/t or exceeded 10 Nl/min/t. In this case, when the argon gas flow rate was less than 5 Nl/min/t, the recovery of $Cr_2O_3$ was lowered. On the other hand, when the argon gas flow rate exceeded 10 Nl/min/t, a large pick-up of nitrogen was observed. Run No. 15 is a comparative run wherein, when the deposition and solidification of $Cr_2O_3$-containing slag on the upper part of the wall of the ladle was observed, aluminum was introduced with the vacuum tank submerged in the molten steel. In this case, the recovery of $Cr_2O_3$ was remarkably lowered.

TABLE 12

| | Run No. | Ar flow rate during introduction of Al for reduction, Nl/min/t | Degree of vacuum during introduction of aluminum for reduction, Torr | Ar flow rate after introduction of Al, Nl/min/t | Bumping | State of vacuum tank during introduction of aluminum | Deposition and soldification of $Cr_2O_3$-containing slag on upper part of ladle wall | Pick-up of [N], ppm | Recovery of $Cr_2O_3$, % | Evaluation |
|---|---|---|---|---|---|---|---|---|---|---|
| Inv. | 1 | 0.3 | 450 | 8.0 | None | Submerged in molten steel | None | 3 | 97 | ○ |
| | 2 | 0.5 | 600 | 5.7 | None | Submerged in molten steel | None | 2 | 96 | ○ |
| | 3 | 0.1 | 550 | 7.5 | None | Submerged in molten steel | None | 2 | 96 | ○ |
| | 4 | 3.0 | 630 | 8.2 | None | Submerged in molten steel | None | 3 | 97 | ○ |
| | 5 | 0.8 | 760 | 7.6 | None | Submerged in molten steel | None | 4 | 95 | ○ |
| | 6 | 2.4 | 400 | 7.5 | None | Submerged in molten steel | None | 1 | 97 | ○ |
| | 7 | 1.3 | 500 | 5.0 | None | Submerged in molten steei | None | 2 | 95 | ○ |
| | 8 | 0.9 | 650 | 10.0 | None | Submerged in molten steel | None | 3 | 98 | ○ |
| | 9 | 1.7 | 760 | 8.3 | None | Lifted | Fixed | 4 | 96 | ○ |
| Comp. | 10 | 0.05 | 560 | Ar did not flow* | None | Submerged in molten steel | None | 1 | 34 | X |
| | 11 | 4.2 | 450 | 8.5 | Bumped | Submerged in molten steel | None | 5 | 65 | X |
| | 12 | 0.8 | 200 | 7.4 | Bumped | Submerged in molten steel | None | 1 | 63 | X |
| | 13 | 0.4 | 480 | 3.5 | None | Submerged in molten steel | None | 3 | 73 | X |
| | 14 | 0.6 | 550 | 12.9 | None | Submerged in molten steel | None | 15 | 98 | X |
| | 15 | 0.3 | 760 | 7.8 | None | Submerged in molten steel | Fixed | 2 | 65 | X |

*Ar did not flow due to a trouble of penetration of the molten steel into the porous plug.

Example 8

The protection of a snorkel in a vacuum tank for vacuum refining of a molten stainless steel according to the present invention was carried out as follows.

At the outset, a molten steel, having a weight of 150 tons (t), comprising 13% by weight of chromium, 0.7% by weight of carbon, and 0.03 to 0.20% by weight of silicon was prepared by the melt process in a converter, and the molten steel was poured into a ladle 13.

In pouring the molten steel, the amount of slag poured from the converter was regulated to about 1000 kg (containing 30% by weight of $SiO_2$), and, in the vacuum refining apparatus 10 shown in FIG. 1, decarburization refining, degassing refining, and reduction refining were further carried out.

Further, in order to regulate the slag and the acceleration of reduction refining, CaO and metallic aluminum were added in such a manner that CaO was dividedly added in two or three portions in the degassing refining and the metallic aluminum was dividedly added in two or three portions at the time of the initiation of the reduction of the reduction refining and in the course of the reduction refining.

In this case, for slags No. 1 to No. 4 according to the present invention shown in Table 13, CaO was regulated to 8 to 18 kg/t, and the metallic aluminum was regulated to 6 to 18 kg/t in terms of $Al_2O_3$. In particular, in slag No. 4, the amount of slag poured from the converter was about 1.5 times, resulting in increased $SiO_2$ content derived from the slag composition.

Next, the slag regulated to the composition shown in Table 13 was coated onto the snorkel 14 in its portion from the lower end thereof to 500 mm from the lower end to form a 30 mm-thick coating by single immersion. Further, the coating, standing-by, and refining under reduced pressure were repeated. The results were compared with the conventional technique where there was no slag coating.

Regarding the number of times of use of the snorkel, as compared with the conventional technique where vacuum refining is repeatedly carried out under reduced pressure with no coating being provided, the present invention could increase the number of times of use of the snorkel by 1.5 times by virtue of a reduction in melt loss caused by the molten steel or slag and a reduction in spalling due to heat load.

By virtue of the increase in number of times of use of the snorkel, the refractory cost of the snorkel of the present invention, when the refractory cost of the conventional technique was presumed to be 1, was about 0.6, indicating that a marked reduction in cost of 40% could be achieved.

Further, since the slag for coating utilizes additives and the produced composition, which can effectively function also in decarburization refining and degassing refining in the refining apparatus under reduced pressure, particularly the acceleration of the reduction refining reaction, both the protection of the refractory constituting the snorkel and the acceleration of the refining can be synergistically utilized, simultaneously improving the refining efficiency, the service life of the snorkel, the reduction in refractory cost and the like.

Substantially the same effect could be attained when coating was carried out a plurality of times by repeating the immersion and standing to form a 60 mm-thick coating. Coating by a plurality of times permitted the loss attributable to spalling created by the high-temperature molten steel and the heat of slag to be prevented in reuse of the snorkel, offering better results.

TABLE 13

| No. | 1 | 2 | 3 | 4 |
|---|---|---|---|---|
| CaO, wt % | 50.0 | 37.0 | 22.0 | 48.0 |
| $SiO_2$, wt % | 7.0 | 10.0 | 17.0 | 25.0 |
| $Al_2O_3$, wt % | 35.0 | 41.0 | 48.0 | 17.0 |
| $Cr_2O_3$, wt % | 2.0 | 5.0 | 6.0 | 4.0 |
| MgO | 5.5 | 6.0 | 6.0 | 5.0 |
| Total of FeO and $Fe_2O_3$, wt % | 0.5 | 1.0 | 1.0 | 1.0 |
| Total of $Al_2O_3$ and CaO, wt % | 85.0 | 78.0 | 70.0 | 65.0 |
| $Al_2O_3$/CaO | 0.70 | 1.11 | 2.18 | 0.35 |

Example 9

The following experiment was carried out using a vacuum refining apparatus shown in FIG. 24 according to the present invention.

Tables 14 and 15 show the results of vacuum decarburization refining for run Nos. 1 to 6 according to the present invention wherein vacuum decarburization refining conditions, such as the inner diameter $D_L$ and the inner sectional area $S_L$ ($m^2$) of a larger-diameter section 36 corresponding to a freeboard section, the length A of the larger-diameter section, the oxygen gas blowing distance L, and the inner sectional area $S_s$ ($m^2$) of a smaller-diameter section 37 having an inner diameter $D_s$, were set at respective various values.

As is apparent from Tables 14 and 15, in run Nos. 1 to 6 according to the present invention wherein the ($D_L$/L) ratio and the ($S_s/S_L$) ratio, which specify the geometrical configuration of the vacuum tank 15 in the vacuum refining, were set respectively at 0.5 to 1.2 and 0.5 to 0.9, the deposition of the metal within the vacuum tank and the melt loss of the refractory corresponding to the horizontal position of the portion just above the molten steel surface (the portion just above the hot spot) were very small (or did not occur), and it is apparent that, as indicated by mark O in the table, the refractory cost was maintained within a predetermined level range and the overall evaluation was regarded as good (O).

The term "oxygen efficiency in decarburization" refers to the proportion of the amount of the oxygen gas contributed to the decarburization reaction relative to the total amount of the oxygen gas fed through the oxygen lance. For runs No. 1 to No. 6 according to the present invention, the oxygen efficiency in decarburization was on a level of 68 to 78%.

The intimately mixing time is an index of the degree of agitation of the molten steel 11 in the vacuum refining and, for example, is expressed in the time taken from the introduction of a metallic element or the like as a label in the molten steel to the point of time when the concentration of the metallic element become even or constant. For runs No. 1 to No. 6 according to the present invention, the intimately mixing time was in the range of from 38 to 51 sec.

Incidentally, in Table 16, runs No. 1 to No. 4 are comparative runs wherein any one of the ($D_L$/L) ratio and the ($S_S/S_L$) ratio was outside the proper range.

Run No. 1 is a comparative run wherein the ($D_L$/L) ratio was 0.4 and outside the proper range. In this run, the melt loss of the refractory corresponding to the horizontal position of the portion immediately above the molten steel surface was significant. As a result, run No. 1 was evaluated as unacceptable (X).

Run No. 2 is a comparative run wherein the ($D_L$/L) ratio was 1.5, that is, significantly outside the proper range. In this run, the force by which oxygen was blown against the molten steel surface was so weak that the decarburization reaction efficiency was remarkably lowered. As a result, run No. 2 was evaluated as unacceptable (X).

Run No. 3 is a comparative run wherein the ($S_S/S_L$) ratio was 0.4, that is, lower than the proper range. In this run, the flow resistance of the exhaust gas was so large that the degree of vacuum was lowered. As a result, run No. 3 was evaluated as unacceptable (X).

Run No. 4 is a comparative run wherein the ($S_S/S_L$) ratio was 1.0, that is, larger than the proper range. In this run, the deposition of the metal within the vacuum tank was significant. As a result, run No. 4 was evaluated as unacceptable (X).

TABLE 14

| Run No. of inv. | | | | 1 | 2 | 3 | 4 |
|---|---|---|---|---|---|---|---|
| Conditions for vacuum decarburization refining | Larger-diameter section | Length | A | 2300 | 2300 | 2300 | 2300 |
| | | Inner diameter | $D_L$ | 2100 | 2100 | 2100 | 2100 |
| | | Inner sectional area | $S_L$ | 3.46 | 3.46 | 3.46 | 3.46 |
| | Oxygen gas | | | | | | |
| | Blowing distance | | L | 2625 | 2334 | 2334 | 3000 |
| | Inner sectional area of Smaller-diameter section | | $S_s$ | 2.76 | 2.42 | 1.86 | 2.76 |
| Unit of area: $m^2$ | | $D_L$/L | | 0.8 | 0.9 | 0.9 | 0.7 |
| | | $S_S/S_L$ | | 0.8 | 0.7 | 0.54 | 0.8 |
| | Fan-shaped shields | | | | | | |
| | Number of shields disposed | | | 0 | 0 | 0 | 0 |
| | Interval, mm | | | — | — | — | — |
| Results of vacuum decarburization refining | Deposition of metal within vacuum tank | | | None | None | None | None |
| | Melt loss of refractory on portion immediately above molten steel surface | | | None | None | None | None |
| | Oxygen efficiency in decarburization, % | | | 75 | 78 | 68 | 75 |
| | Intimately mixing time | | | 45 sec | 43 sec | 51 sec | 38 sec |
| | Refractory cost | | | ○ | ○ | ○ | ○ |
| | Overall evaluation | | | ○ | ○ | ○ | ○ |

TABLE 15

| Run No. of inv. | | | | 5 | 6 | 7 |
|---|---|---|---|---|---|---|
| Conditions for vacuum decarburization refining | Larger-diameter section | Length | A | 2300 | 2300 | 2300 |
| | | Inner diameter | $D_L$ | 2100 | 2100 | 2100 |
| | | Inner sectional area | $S_L$ | 3.46 | 3.46 | 3.46 |
| | Oxygen gas | | | | | |
| | | Blowing distance | L | 4200 | 1750 | 2330 |
| | Inner sectional area of Smaller-diameter section | | $S_s$ | 3.11 | 2.76 | 3.46 |
| Unit of area: $m^2$ | | $D_L/L$ | | 0.5 | 1.2 | 0.9 |
| | | $S_s/S_L$ | | 0.9 | 0.8 | 1.0 |
| | Fan-shaped shields | | | | | |
| | | Number of shields disposed | | 0 | 0 | 3 |
| | | Interval, mm | | — | — | 150 |
| Results of vacuum decarburization refining | Deposition of metal within vacuum tank | | | None | None | None |
| | Melt loss of refractory on portion immediately above molten steel surface | | | None | None | None |
| | Oxygen efficiency in decarburization, % | | | 74 | 73 | 76 |
| | Intimately mixing time | | | 42 sec | 46 sec | 46 sec |
| | Refractory cost | | | ○ | ○ | ○ |
| | Overall evaluation | | | ○ | ○ | ○ |

TABLE 16

| Comp. run No. | | | | 1 | 2 | 3 | 4 |
|---|---|---|---|---|---|---|---|
| Conditions for vacuum decarburization refining | Larger-diameter section | Length | A | 2300 | 2300 | 2300 | 2300 |
| | | Inner diameter | $D_L$ | 2100 | 2100 | 2100 | 2100 |
| | | Inner sectional area | $S_L$ | 3.46 | 3.46 | 3.46 | 3.46 |
| | Oxygen gas | | | | | | |
| | | Blowing distance | L | 5250 | 1400 | 3500 | 2625 |
| | Inner sectional area of smaller-diameter section | | $S_s$ | 2.76 | 2.76 | 1.38 | 3.46 |
| Unit of area: $m^2$ | | $D_L/L$ | | 0.4 | 1.5 | 0.6 | 0.8 |
| | | $S_s/S_L$ | | 0.8 | 0.8 | 0.4 | 1.0 |
| | Fan-shaped shields | | | | | | |
| | | Number of shields disposed | | 0 | 0 | 0 | 0 |
| | | Interval, mm | | — | — | — | — |
| Results of vacuum decarburization refining | Deposition of metal within vacuum tank | | | None | None | None | Severe |
| | Melt loss of refractory on portion immediately above molten steel surface | | | Severe | None | None | None |
| | Oxygen efficiency in decarburization, % | | | 72 | 70 | 38 | 75 |
| | Intimately mixing time | | | 72 sec | 70 sec | 38 sec | 75 sec |
| | Refractory cost | | | X | X | ○ | ○ |
| | Overall evaluation | | | X | X | X | X |

Example 10

An experiment on burner blowing at the time of oxygen blowing according to the present invention was carried out as follows.

Runs No. 1 to No. 7 according to the present invention are runs wherein vacuum refining was carried out under down-blown oxygen decarburization refining conditions in vacuo as specified in Tables 17 and 18. The results (deposition of metal, state of damage to refractory, and evaluation) are summarized in these tables.

In the tables, the surface temperature in the canopy is the average temperature (° C.) in each period, and, in the column of the burner blowing gas during oxygen blowing, the type of gas fed into burners 44-1 and 44-2 shown in FIGS. 24 and 30 is indicated.

For example, run No. 1 is a run according to the present invention wherein oxygen blowing decarburization refining was carried out in vacuo in such a manner that the front end distance L of the burner and the burner ejection angle θh were set respectively at 2.3 m and 50°, and the average surface temperature in the canopy in the oxygen blowing refining period, the average surface temperature in the canopy in the non-oxygen blowing refining period, and the average surface temperature in the canopy in the standing period were regulated respectively at 1520° C., 1500° C., and 800° C. by means of the burners 44-1 and 44-2.

In run No. 1 according to the present invention, there was no deposition of the metal in the canopy 35, and the loss of the refractory was very small. As a result, run No. 1 was evaluated good (O).

In runs No. 1 to No. 7 according to the present invention, maintaining the surface temperature of the canopy during oxygen blowing (in the oxygen blowing refining period) and during non-oxygen blowing (in the non-oxygen blowing refining period) in a predetermined range of 1200 to 1700° C. by means of burners 16 and 17 resulted in prevention of the deposition of the metal and minimized loss of the refractory, that is, provided good results (O).

Comparative runs No. 1 to No. 4 shown in Table 19 are comparative runs wherein the surface temperature of the canopy in any one of the oxygen blowing period (oxygen blowing refining period) and the non-oxygen blowing period (non-oxygen blowing refining period) was outside the predetermined range of from 1200 to 1700° C. For all of comparative runs No. 1 to No. 4, the deposition of the metal or the loss of the refractory was significant. As a result, these comparative runs were evaluated as unacceptable (X).

For example, comparative run No. 1 is a comparative run wherein oxygen blowing decarburization refining was carried out in vacuo in such a manner that the front end distance L of the burner and the burner ejection angle θh were set respectively at 3.5 m and 65°, and the average surface temperature in the canopy in the oxygen blowing refining period, the average surface temperature in the canopy in the non-oxygen blowing refining period, and the average surface temperature in the canopy in the standing period were regulated respectively at 1150° C., 1100° C., and 800° C.

In this case, as is apparent from Table 19, the front end distance of the burner was large, and the position of the front end was so low that the temperature of the canopy 35 was below the predetermined range, resulting in increased amount of deposition of the metal in the canopy 35.

TABLE 17

| | Run No. of inv. | 1 | 2 | 3 | 4 |
|---|---|---|---|---|---|
| Conditions for oxygen blowing decarburization refining in vacuo | Surface temp. in canopy during oxygen blowing, ° C. | 1520 | 1560 | 1610 | 1520 |
| | Surface temp. in canopy during non-oxygen blowing, ° C. | 1500 | 1480 | 1470 | 1500 |
| | Surface temp. in canopy during standing, ° C. | 800 | 1200 | 1200 | 1200 |
| | Front end distance of burner L, m | 2.3 | 1.8 | 2.1 | 1.5 |
| | Burner ejection angle θh, ° | 50 | 55 | 45 | 47 |
| | Burner blowing gas during oxygen blowing | Oxygen gas + LPG | Oxygen gas + LPG | Oxygen gas + LPG | Oxygen gas + LPG |
| Results | Deposition of metal within vacuum tank | None | None | None | None |
| | Loss of refractory | Very small | Very small | Very small | Very small |
| | Evaluation | ○ | ○ | ○ | ○ |

TABLE 18

| | Run No. of inv. | 5 | 6 | 7 |
|---|---|---|---|---|
| Conditions for oxygen blowing decarburization refining in vacuo- | Surface temp. in canopy during oxygen blowing, ° C. | 1520 | 1700 | 1530 |
| | Surface temp. in canopy during non-oxygen blowing, ° C. | 1500 | 1200 | 1300 |
| | Surface temp. in canopy during standing, ° C. | 1200 | 800 | 1200 |
| | Front end distance of burner L, m | 2.5 | 0.3 | 3.0 |
| | Burner ejection angle θh, ° | 47 | 20 | 90 |
| | Burner blowing gas during oxygen blowing | Oxygen gas + LPG | Oxygen gas + LPG | Oxygen gas + LPG |
| Results | Deposition of metal within vacuum tank | None | None | None |
| | Loss of refractory | Very small | Very small | Very small |
| | Evaluation | ○ | ○ | ○ |

TABLE 19

| | Comp. run No. | 1 | 2 | 3 | 4 |
|---|---|---|---|---|---|
| Conditions for oxygen blowing decarburization refining in | Surface temp. in canopy during oxygen blowing, ° C. | 1150 | 1760 | 1505 | 1625 |
| | Surface temp. in canopy during non-oxygen blowing, ° C. | 1100 | 1495 | 1080 | 1810 |
| | Surface temp. in canopy during standing, ° C. | 800 | 1200 | 1200 | 1200 |

TABLE 19-continued

| | Comp. run No. | 1 | 2 | 3 | 4 |
|---|---|---|---|---|---|
| vacuo | Front end distance of burner L, m | 3.5 | 2.4 | 2.2 | 0.2 |
| | Burner ejection angle θh, ° | 65 | 100 | 10 | 70 |
| | Burner blowing gas during oxygen blowing | Oxygen gas + LPG | Oxygen gas + LPG | Oxygen gas + LPG | Oxygen gas + LPG |
| Results | Deposition of metal within vacuum tank | Severe | None | Severe | None |
| | Loss of refractory | Very small | Severe | Very small | Severe |
| | Evaluation | X | X | X | X |

Example 11

An experiment on an evacuation duct shown in FIG. 32 was carried out as follows.

Runs No. 1 to No. 4 according to the present invention shown in Table 20 are runs wherein vacuum refining was carried out in such a manner that operation conditions, such as the inclination angle ($\theta_0$) in an ascendably inclined section 46 of an evacuation duct 16-1 and the actual length ($L_0$) of the evacuation duct 16-1, were varied. The results of the operation are summarized in Table 20.

For example, run No. 1 according to the present invention in Table 20 is a run wherein vacuum refining was carried out for about 5 days in such a manner that the inclination angle ($\theta_0$) was brought to 45°, the actual length ($L_0$) was brought to 22 m, and a dust pot 53 (metal pot) was disposed below a descendably inclined section 48.

As shown in the column of the results of operation, the state of deposition of dust in a duct inlet 45 was very small, there was no damage to a gas cooler 55 caused by the deposition of dust, and the attained degree of vacuum could be maintained at 0.5 Torr. As a result, run No. 1 was evaluated as good (O).

As is apparent from the results of runs No. 2 to No. 4, good results could be obtained by bringing the inclination angle ($\theta_0$) and the actual length ($L_0$) to respective predetermined ranges and providing the metal pot 53.

For example, comparative runs No. 1 and No. 2 in Table 21 are comparative runs wherein the inclination angle ($\theta_0$) in the ascendably inclined section 46 was set at 15° for comparative run No. 1 and 0° for comparative run No. 2 which were outside the proper range of from 30 to 60°. In these runs, the deposition of dust in the duct inlet 45 was significant, the pressure loss in the evacuation duct 16-1 was increased, and the attained degree of vacuum was on a level of 35 Torr and 45 Torr. As a result, comparative runs No. 1 and No. 2 were evaluated as unacceptable (X).

Comparative run No. 3 is a comparative run wherein no metal pot was provided. In this run, the deposition of dust in the duct inlet 45 was very small. However, dust, which flowed in the duct beyond the top 47 of the ascendably inclined section 46, reached the gas cooler 55 without being collected. This caused remarkable damage to the gas cooler and resulted in a low attained degree of vacuum of 40 Torr.

Comparative run No. 4 is a comparative run wherein the actual length ($L_0$) of the evacuation duct 16-1 was 6 m, that is, outside the proper range (15 to 50 m). In this run, despite the provision of the metal pot 53, since the actual length ($L_0$) was short, the amount of inflow of the dust in the gas cooler 55 was increased, resulting in increased damage to the gas cooler 55.

TABLE 20

| | Run No. of inv. | 1 | 2 | 3 | 4 |
|---|---|---|---|---|---|
| Operating conditions | Inclination angle in ascendably inclined section, $\theta_0$ | 45° | 60° | 30° | 40° |
| | Actual length of evacuation duct, $L_0$ | 22 m | 25 m | 20 m | 15 m |
| | Metal pot | Provided | Provided | Provided | Provided |
| Results of Operation | Deposition of metal in duct inlet | Very small | Very small | Very small | Very small |
| | Damage to gas cooler | None | None | None | None |
| | Attained degree of vacuum, Torr | 0.5 | 0.8 | 0.9 | 1.0 |
| | Evaluation | ○ | ○ | ○ | ○ |

TABLE 21

| | Comp. run No. | 1 | 2 | 3 | 4 |
|---|---|---|---|---|---|
| Operating conditions | Inclination angle in ascendably inclined section, $\theta_0$ | 15° | 0° | 45° | 50° |
| | Actual length of evacuation duct, $L_0$ | 19 m | 23 m | 25 m | 6 m |
| | Metal pot | Provided | Provided | Not provided | Provided |
| Results of Operation | Deposition of metal in duct inlet | Severe | Severe | Very small | Very small |
| | Damage to gas cooler | None | None | Severe | Severe |
| | Attained degree of vacuum, Torr | 35 | 45 | 40 | 45 |
| | Evaluation | X | X | X | X |

Comparative runs No. 1 to No. 4 corresponding to the runs according to the present invention are shown in Table 21.

INDUSTRIAL APPLICABILITY

According to the present invention, in straight-barrel type vacuum refining, optimal regulation of the pressure within a vacuum tank in an aluminum temperature elevation period and, in addition, feed of an oxygen gas at an optimal flow rate according to the carbon concentration while regulating the slag component in the oxygen blowing decarburization period can inhibit oxidation loss of chromium during the aluminum temperature elevation, can improve the oxygen efficiency in decarburization in the oxygen blowing decarburization period, and, in the high carbon concentration region, can prevent splashing within a snorkel of the vacuum tank and the fixation of the submerged section of the nozzle by slag. Therefore, the method for refining of a molten steel according to the present invention is very advantageous from the viewpoint of industry.

What is claimed is:

1. A method for vacuum decarburization refining of a molten steel comprising:

providing molten steel having a carbon concentration of 1.0 to 0.01% by weight in a ladle;

providing a vacuum tank having a one-legged, straight barrel snorkel as a lower portion of said vacuum tank;

immersing said one-legged, straight barrel snorkel of said vacuum tank into said molten steel in said ladle;

evacuating an interior of said vacuum tank resulting in molten steel ascending in an interior of said one-legged, straight barrel snorkel immersed in said molten steel and into said interior of said vacuum tank;

providing a liftable top-blown lance in an insert hole in a canopy of said vacuum tank;

blowing oxygen gas through said top-blown lance into said molten steel at a flow rate in a range of 3 to 25 $Nm^2$/hr/ton-steel;

injecting inert gas into said molten steel from a low position of said ladle at a flow rate in a range of from 0.3 to 10 Nl/min/ton-steel;

regulating a degree of vacuum in said vacuum tank at a high carbon concentration region, said carbon concentration of said molten steel in said high carbon concentration region being not less than a critical carbon concentration, said critical carbon concentration being in a range of 0.3 to 0.1% by weight;

said degree of vacuum at said high carbon concentration region being regulated to a value in a range of −35 to −20 in terms of G defined by the following equation (1):

$$G=5.96\times10^{-3}\times T\times\ln(P/Pco) \quad (1)$$

wherein $$Pco=760\ \{10^{(-13800/T+8.75)}\}\times(\%\ C)/(\%\ Cr) \quad (2)$$

$$P<760$$

wherein T represents molten steel temperature, K, and P represents the degree of vacuum in the vacuum tank, Torr;

thereby conducting oxygen blowing decarburization refining, followed by degassing.

2. The method according to claim 1, wherein the flow rate of the inert gas injected from the low position of the ladle is brought, in the high carbon concentration region above the critical carbon concentration, to a range of from 0.3 to 4 Nl/min/ton-steel and is brought, in a low carbon concentration region not above the critical carbon concentration, to a range of from more than 4 to 10 Nl/min/ton-steel.

3. The method according to claim 1, wherein, in a period of temperature elevation due to an oxidation of aluminum in a step before the oxygen blowing decarburization refining, the temperature of the molten steel is elevated in such a manner that the molten steel is poured into the ladle, the snorkel in the vacuum tank is immersed in the molten steel and, in addition, the degree of vacuum, P, in the atmosphere within the vacuum tank is controlled so as to give a G value, determined by the equation (1), of not more than −20, aluminum is added to the molten steel within the vacuum tank with the controlled degree of vacuum, and the oxygen gas is blown through the top-blown lance into the vacuum tank to oxidize aluminum, thereby elevating the temperature of the molten steel.

4. The method according to claim 1, wherein quick lime in an amount corresponding to 0.8 to 4.0 $W_{Al}$ (kg), wherein $W_{Al}$ represents the amount of aluminum added for the temperature elevation, is introduced into the tank from the temperature elevation period to the oxygen blowing decarburization period and, in addition, the depth of immersion of the snorkel into the molten steel during the temperature elevation period is in the range of from 200 to 400 mm.

5. The method according to claim 1, wherein, in the oxygen blowing decarburization period, an inert gas is injected into the ladle from the low position of the ladle under conditions satisfying a requirement that a activated surface area is brought to not less than 10% of the total surface area of the molten steel and not less than 100% of a surface blown by an oxygen gas jet, thereby agitating the molten steel.

6. The method according to claim 1, wherein, in the high carbon concentration region in the oxygen blowing decarburization period, quick lime and the like are introduced either at once or dividedly into the vacuum tank to form slag having a thickness of 100 to 1000 mm in terms of a still state, on the surface of the molten steel within the snorkel, which is then retained.

7. The method according to claim 1, wherein, in the high carbon concentration region in the oxygen blowing decarburization period, the depth of immersion of the snorkel in the molten steel is in the range of from 500 to 700 mm.

8. The method according to claim 1, wherein, in the low carbon concentration region in the oxygen blowing decarburization period, the oxygen blowing decarburization is carried out while decreasing the oxygen gas flow rate in a range of 0.5 to 12.5 $Nm^3$/h/ton-steel/min and, at the same time, reducing the depth h of immersion of the snorkel in relationship with the depth H of the molten steel so as to satisfy the requirement h/H=0.1 to 0.6.

9. The method according to claim 1, wherein, in the degassing period, the degassing treatment is carried out in such a manner that, during the stop of the blowing of oxygen through the top-blown lance, the degree of vacuum within the vacuum tank is brought to 10 to 100 Torr, and an inert gas is injected from the low portion of the ladle into the ladle while regulating the amount of the slag within the snorkel to not more than 1.2 ton/$m^2$ of the geometrical cross-sectional area of the snorkel and, at the same time, regulating the K value, determined by the following equation (3), to 0.5 to 3.5, thereby agitating the molten steel:

$$K=\log\ \{S\cdot H_v\cdot Q/P\} \quad (3)$$

wherein

K: index of a agitation intensity at the activated surface;

S: activated surface area, $m^2$;

$H_v$: depth of injected inert gas, m;

Q: flow rate of injected inert gas, Nl/min/ton-steel; and

P: degree of vacuum within the tank, Torr.

10. The method according to claim 1, wherein in reducing a metal oxide with aluminum after the completion of the degassing, in the aluminum reduction period, aluminum for reduction is added into the molten steel and, in the aluminum addition period, the flow rate of an inert gas, for agitation from the low portion of the ladle is brought to a range of from 0.1 to 3.0 Nl/min/ton-steel with the degree of vacuum within the tank being brought to not more than 400 Torr and, after the completion of the introduction of aluminum for reduction, the degree of vacuum within the tank is returned to the atmospheric pressure, followed by lifting of the vacuum tank and regulating the flow rate of the inert gas for agitation in a range from 5 to 10 Nl/min/ton-steel to reduce the metal oxide produced during the oxygen blowing, and permitting the recovery of a metal element.

11. The method according to claim 1, wherein in reducing a metal oxide with aluminum after the completion of the degassing, in a period of the metal oxide reduction by aluminum, the pressure of the atmosphere within the vacuum tank is returned to the atmospheric pressure, the vacuum tank is lifted, and, at the same time, aluminum for reduction is added into the molten steel, and, in the aluminum addition period, the flow rate of an inert gas for agitation is brought in a range of from 0.1 to 3.0 Nl/min/ton-steel and, immediately after the completion of the addition of aluminum for reduction, the flow rate of the inert gas for agitation is brought in a range of 5 to 10 Nl/min/ton-steel to reduce the metal oxide produced during the oxygen blowing, and a metal element is recovered.

12. The method according to claim 1, wherein, after the completion of the degassing or the reduction treatment with aluminum, the composition of slag after the completion of the refining is regulated so that the slag comprises by weight 55 to 90% in total of $Al_2O_3$ and CaO, not more than 10% of $Cr_2O_3$, and 7 to 25% of $SiO_2$ with the balance consisting of 2 to 10% in total of at least one member selected from FeO, $Fe_2O_3$, and MgO, the $Al_2O_3$/CaO ratio being in the range of from 0.25 to 3.0, followed by coating of the slag onto the surface of the snorkel of the refining apparatus after the decarburization refining.

13. The method according to claim 1, wherein, during or after the completion of the oxygen blowing decarburization refining period, the vicinity of the canopy is heated, by means of a heating burner inserted into the vacuum tank, so that the surface temperature of the canopy in the vacuum tank is held at 1200 to 1700° C.

* * * * *